US010729949B2

(12) United States Patent
Parsons et al.

(10) Patent No.: US 10,729,949 B2
(45) **Date of Patent: *Aug. 4, 2020**

(54) GOLF CLUB HEADS AND METHODS TO MANUFACTURE GOLF CLUB HEADS

(71) Applicant: Parsons Xtreme Golf, LLC, Scottsdale, AZ (US)

(72) Inventors: Robert R. Parsons, Scottsdale, AZ (US); Michael R. Nicolette, Scottsdale, AZ (US); Bradley D. Schweigert, Anthem, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/793,648

(22) Filed: Oct. 25, 2017

(65) Prior Publication Data

US 2018/0050245 A1 Feb. 22, 2018

Related U.S. Application Data

(63) Continuation-in-part of application No. 15/791,020, filed on Oct. 23, 2017, now abandoned, which is a (Continued)

(51) Int. Cl.
*A63B 53/04* (2015.01)
*A63B 60/54* (2015.01)
(Continued)

(52) U.S. Cl.
CPC ..... *A63B 53/0475* (2013.01); *A63B 60/54* (2015.10); *A63B 60/02* (2015.10);
(Continued)

(58) Field of Classification Search
CPC ..... A63B 53/0475; A63B 2053/0491; A63B 2053/0458; A63B 2053/0408;
(Continued)

(56) References Cited

U.S. PATENT DOCUMENTS 1,133,129 A 3/1915 Govan
1,306,029 A * 6/1919 Robertson ..... A63B 53/04 473/338

(Continued)

FOREIGN PATENT DOCUMENTS

DE 297 15 997 3/1998
GB 2 249 031 4/1992

(Continued)

OTHER PUBLICATIONS

Translated copy, dated Mar. 13, 2018, of Utility Model DE 29715997 U1, by Linphone, titled "Golf club head with good shock absorption properties".*

(Continued)

*Primary Examiner* — Sebastiano Passaniti

(57) ABSTRACT

Embodiments of golf club heads and methods to manufacture golf club heads are generally described herein. In one example, a golf club head may include a body portion including a first material and having a toe portion, a heel portion, a top portion, a sole portion, a back portion, a front portion having a face portion. The golf club head may also include a third mass portion including a second material and coupled to the body portion, and a plurality of mass portions coupled to the third mass portion. The density of the second material is greater than a density of the first material. The interior cavity may include an elastic polymer material. Other examples and embodiments may be described and claimed.

7 Claims, 21 Drawing Sheets

Related U.S. Application Data continuation of application No. 15/785,001, filed on Oct. 16, 2017, now abandoned, application No. 15/793,648, which is a continuation-in-part of application No. 15/687,317, filed on Aug. 25, 2017, now abandoned, which is a continuation of application No. 15/433,753, filed on Feb. 15, 2017, now Pat. No. 9,764,208, which is a continuation of application No. 15/188,718, filed on Jun. 21, 2016, now Pat. No. 9,610,481, application No. 15/793,648, which is a continuation-in-part of application No. PCT/US2016/042075, filed on Jul. 13, 2016, which is a continuation of application No. 15/188,718, filed on Jun. 21, 2016, now Pat. No. 9,610,481, application No. 15/793,648, which is a continuation-in-part of application No. 15/701,131, filed on Sep. 11, 2017, now abandoned, which is a continuation-in-part of application No. 15/685,986, filed on Aug. 24, 2017, now Pat. No. 10,279,233, which is a continuation of application No. 15/628,251, filed on Jun. 20, 2017, now abandoned, which is a continuation of application No. 15/209,364, filed on Jul. 13, 2016, now Pat. No. 10,293,229, which is a continuation of application No. 14/589,277, filed on Jan. 5, 2015, now Pat. No. 9,421,437, which is a continuation of application No. 14/513,073, filed on Oct. 13, 2014, now Pat. No. 8,961,336, which is a continuation of application No. 14/498,603, filed on Sep. 26, 2014, now Pat. No. 9,199,143, said application No. 15/209,364 is a continuation of application No. 14/618,501, filed on Feb. 10, 2015, now Pat. No. 9,427,634, which is a continuation of application No. 14/589,277, filed on Jan. 5, 2015, now Pat. No. 9,421,437, said application No. 15/209,364 is a continuation of application No. PCT/US2015/016666, filed on Feb. 19, 2015, said application No. 15/209,364 is a continuation of application No. PCT/US2014/071250, filed on Dec. 18, 2014, which is a continuation of application No. 14/498,603, filed on Sep. 26, 2014, now Pat. No. 9,199,143, application No. 15/793,648, which is a continuation-in-part of application No. 15/683,564, filed on Aug. 22, 2017, which is a continuation of application No. 15/598,949, filed on May 18, 2017, now Pat. No. 10,159,876, which is a continuation of application No. 14/711,596, filed on May 13, 2015, now Pat. No. 9,675,853, application No. 15/793,648, which is a continuation-in-part of application No. 15/263,018, filed on Sep. 12, 2016, now Pat. No. 9,878,220, which is a continuation of application No. 15/043,090, filed on Feb. 12, 2016, now Pat. No. 9,468,821, application No. 15/793,648, which is a continuation-in-part of application No. 15/631,610, filed on Jun. 23, 2017, now abandoned, which is a continuation of application No. 15/360,707, filed on Nov. 23, 2016, now Pat. No. 10,029,158, which is a continuation of application No. 15/043,106, filed on Feb. 12, 2016, now Pat. No. 9,533,201.

(60) Provisional application No. 62/502,442, filed on May 5, 2017, provisional application No. 62/508,794, filed on May 19, 2017, provisional application No. 62/512,033, filed on May 28, 2017, provisional application No. 62/570,493, filed on Oct. 10, 2017, provisional application No. 62/343,739, filed on May 31, 2016, provisional application No. 62/041,538, filed on Aug. 25, 2014, provisional application No. 61/942,515, filed on Feb. 20, 2014, provisional application No. 61/945,560, filed on Feb. 27, 2014, provisional application No. 61/948,839, filed on Mar. 6, 2014, provisional application No. 61/952,470, filed on Mar. 13, 2014, provisional application No. 61/992,555, filed on May 13, 2014, provisional application No. 62/010,836, filed on Jun. 11, 2014, provisional application No. 62/011,859, filed on Jun. 13, 2014, provisional application No. 62/032,770, filed on Aug. 4, 2014, provisional application No. 62/118,403, filed on Feb. 19, 2015, provisional application No. 62/159,856, filed on May 11, 2015, provisional application No. 62/209,780, filed on Aug. 25, 2015, provisional application No. 62/277,636, filed on Jan. 12, 2016, provisional application No. 62/275,443, filed on Jan. 6, 2016, provisional application No. 62/276,358, filed on Jan. 8, 2016.

(51) Int. Cl.
*A63B 60/02* (2015.01)
*A63B 60/00* (2015.01)

(52) U.S. Cl.
CPC ..... *A63B 2053/0408* (2013.01); *A63B 2053/0412* (2013.01); *A63B 2053/0458* (2013.01); *A63B 2053/0491* (2013.01); *A63B 2060/002* (2015.10); *A63B 2209/00* (2013.01)

(58) Field of Classification Search
CPC ..... A63B 2053/0412; A63B 60/54; A63B 2209/00; A63B 60/02; A63B 2060/002
USPC ..... 473/324–350, 287–292, 256
See application file for complete search history.

(56) References Cited

U.S. PATENT DOCUMENTS

| | | | | | |
|---|---|---|---|---|---|
| 1,534,600 | A | | 7/1921 | Mattern | |
| 1,538,312 | A | | 5/1925 | Beat | |
| 2,328,583 | A | * | 9/1943 | Reach | A63B 53/04 473/338 |
| 2,332,342 | A | * | 10/1943 | Reach | A63B 53/04 473/248 |
| D138,438 | S | | 8/1944 | Link | |
| 3,020,048 | A | | 2/1962 | Carroll | |
| 3,266,805 | A | | 8/1966 | Bulla | |
| D215,101 | S | | 9/1969 | Sabat | |
| D229,431 | S | | 11/1973 | Baker | |
| D234,609 | S | | 3/1975 | Raymont | |
| D239,550 | S | | 4/1976 | Timbrook | |
| D240,748 | S | | 7/1976 | Bock | |
| 4,085,934 | A | | 4/1978 | Churchward | |
| D253,778 | S | | 12/1979 | Madison | |
| 4,502,687 | A | | 3/1985 | Kochevar | |
| 4,523,759 | A | | 6/1985 | Igarashi | |
| 4,545,580 | A | | 10/1985 | Tomita et al. | |
| D294,617 | S | | 3/1988 | Perkins | |
| 4,754,977 | A | | 7/1988 | Sahm | |
| 4,803,023 | A | | 2/1989 | Enomoto et al. | |
| 4,824,116 | A | | 4/1989 | Nagamoto et al. | |
| 4,928,972 | A | | 5/1990 | Nakanishi | |
| 4,988,104 | A | | 1/1991 | Shiotani et al. | |
| 5,028,049 | A | | 7/1991 | McKeighen | |
| 5,158,296 | A | | 10/1992 | Lee | |
| 5,176,384 | A | | 1/1993 | Sata et al. | |
| 5,213,328 | A | | 5/1993 | Long et al. | |
| D336,672 | S | | 6/1993 | Gorman | |
| 5,244,211 | A | | 9/1993 | Lukasiewicz | |
| 5,275,413 | A | * | 1/1994 | Sprague | A63B 53/0487 473/337 |
| D351,883 | S | | 10/1994 | Solheim et al. | |
| 5,351,958 | A | | 10/1994 | Helmstetter | |

(56) References Cited

U.S. PATENT DOCUMENTS 5,419,559 A 5/1995 Melanson et al.
5,419,560 A 5/1995 Bamber
5,425,535 A 6/1995 Gee
D361,358 S 8/1995 Simmons
5,439,223 A * 8/1995 Kobayashi ..... A63B 53/04 473/334
5,447,311 A 9/1995 Viollaz et al.
5,451,056 A 9/1995 Manning
D362,885 S 10/1995 Blough et al.
5,485,998 A 1/1996 Kobayashi
5,518,243 A * 5/1996 Redman ..... A63B 53/04 473/334
5,540,437 A 7/1996 Bamber
D378,111 S 2/1997 Parente et al.
5,613,917 A * 3/1997 Kobayashi ..... A63B 53/04 473/335
5,637,045 A 6/1997 Igarashi
5,647,808 A 7/1997 Hosokawa
5,649,873 A 7/1997 Fuller
5,669,830 A 9/1997 Bamber
5,766,091 A 6/1998 Humphrey et al.
5,766,092 A 6/1998 Mimeur et al.
5,769,735 A 6/1998 Hosokawa
5,772,527 A 6/1998 Liu
5,776,010 A * 7/1998 Helmstetter ..... A63B 53/04 473/334
5,788,584 A 8/1998 Parente et al.
5,797,807 A 8/1998 Moore
5,827,132 A 10/1998 Bamber
5,833,551 A * 11/1998 Vincent ..... A63B 53/04 473/350
D408,485 S 4/1999 Takahashi et al.
5,899,821 A 5/1999 Hsu et al.
5,911,638 A * 6/1999 Parente ..... A63B 53/04 473/338
5,935,016 A 8/1999 Antonious
5,938,540 A * 8/1999 Lu ..... A63B 53/04 473/288
D421,080 S 2/2000 Chen
D426,276 S 6/2000 Besnard et al.
6,077,171 A 6/2000 Yoneyama
6,162,133 A 12/2000 Peterson
6,165,081 A 12/2000 Chou
D442,659 S 5/2001 Kubica et al.
6,231,458 B1 5/2001 Cameron et al.
6,238,302 B1 5/2001 Helmstetter et al.
D445,862 S 7/2001 Ford
6,290,609 B1 9/2001 Takeda
6,386,990 B1 5/2002 Reyes et al.
D469,833 S 2/2003 Roberts et al.
D475,107 S 5/2003 Madore
6,569,029 B1 * 5/2003 Hamburger ..... A63B 53/047 473/238
D478,140 S 8/2003 Burrows
6,638,162 B2 10/2003 Kosmatka
6,695,714 B1 2/2004 Bliss et al.
6,702,693 B2 3/2004 Bamber
6,729,971 B2 * 5/2004 Caldwell ..... A63B 53/04 473/324
6,780,123 B2 8/2004 Hasebe
6,811,496 B2 11/2004 Wahl et al.
6,830,519 B2 12/2004 Reed et al.
6,855,067 B2 2/2005 Solheim et al.
D502,975 S 3/2005 Schweigert et al.
D503,204 S 3/2005 Nicolette et al.
D508,545 S 8/2005 Roberts et al.
D508,969 S 8/2005 Hasebe
6,923,733 B2 8/2005 Chen
6,929,563 B2 * 8/2005 Nishitani ..... A63B 53/047 473/334
D514,183 S 1/2006 Schweigert et al.
6,984,180 B2 * 1/2006 Hasebe ..... A63B 53/04 473/291
7,041,189 B2 * 5/2006 Caldwell ..... A63B 53/04 156/242
D523,501 S 6/2006 Nicolette et al.
7,121,956 B2 10/2006 Lo
7,128,663 B2 10/2006 Bamber
7,153,222 B2 12/2006 Gilbert et al.
D534,595 S 1/2007 Hasebe
7,156,751 B2 1/2007 Wahl et al.
7,182,698 B2 2/2007 Tseng
7,207,900 B2 4/2007 Nicolette et al.
D543,601 S 5/2007 Kawami
7,281,991 B2 10/2007 Gilbert et al.
D555,219 S 11/2007 Lin
7,303,486 B2 12/2007 Imamoto
7,351,164 B2 4/2008 Schweigert et al.
7,396,299 B2 7/2008 Nicolette et al.
7,553,241 B2 * 6/2009 Park ..... A63B 53/047 473/290
7,582,024 B2 9/2009 Shear
7,588,502 B2 9/2009 Nishino
7,611,424 B2 11/2009 Nagai et al.
7,658,686 B2 2/2010 Soracco
D618,293 S 6/2010 Foster et al.
7,744,484 B1 6/2010 Chao
7,744,486 B2 6/2010 Hou et al.
7,744,487 B2 6/2010 Tavares et al.
7,794,333 B2 9/2010 Wallans et al.
7,798,917 B2 9/2010 Nguyen et al.
7,803,068 B2 9/2010 Clausen et al.
7,815,521 B2 10/2010 Ban et al.
7,846,040 B2 12/2010 Ban
7,938,738 B2 5/2011 Roach
7,976,403 B2 * 7/2011 Gilbert ..... A63B 53/0475 473/309
8,062,150 B2 11/2011 Gilbert et al.
8,088,025 B2 1/2012 Wahl et al.
8,092,319 B1 1/2012 Cackett et al.
8,105,180 B1 1/2012 Cackett et al.
8,157,673 B2 * 4/2012 Gilbert ..... A63B 53/047 473/350
8,221,262 B1 7/2012 Cackett et al.
8,246,487 B1 8/2012 Cackett et al.
8,257,196 B1 9/2012 Abbott et al.
8,262,506 B2 9/2012 Watson et al.
8,328,662 B2 12/2012 Nakamura et al.
8,342,985 B2 * 1/2013 Hirano ..... A63B 53/047 473/350
8,376,878 B2 2/2013 Bennett et al.
8,393,976 B2 3/2013 Soracco et al.
D681,142 S 4/2013 Fossum et al.
8,414,422 B2 4/2013 Peralta et al.
8,449,406 B1 5/2013 Frame et al.
8,454,453 B2 * 6/2013 Hettinger ..... A63B 53/02 473/350
8,506,420 B2 8/2013 Hocknell et al.
8,545,343 B2 10/2013 Boyd et al.
8,574,094 B2 11/2013 Nicolette et al.
8,657,700 B2 2/2014 Nicolette et al.
8,663,026 B2 3/2014 Blowers et al.
8,690,710 B2 4/2014 Nicolette et al.
8,753,230 B2 6/2014 Stokke et al.
8,790,196 B2 7/2014 Solheim et al.
8,821,307 B2 * 9/2014 Park ..... A63B 53/04 473/244
8,827,832 B2 9/2014 Breier et al.
8,827,833 B2 9/2014 Amaro et al.
8,845,455 B2 9/2014 Ban et al.
8,858,362 B1 10/2014 Leposky et al.
D722,351 S 2/2015 Parsons et al.
D722,352 S 2/2015 Nicolette et al.
D723,120 S 2/2015 Nicolette et al.
8,961,336 B1 2/2015 Parsons et al.
D724,164 S 3/2015 Schweigert et al.
D725,208 S 3/2015 Schweigert
8,974,318 B1 3/2015 Ogg
D726,265 S 4/2015 Nicolette
D726,846 S 4/2015 Schweigert
9,005,052 B1 4/2015 Parnell
9,005,056 B2 4/2015 Pegnatori

(56) References Cited

U.S. PATENT DOCUMENTS

| | | | | |
|---|---|---|---|---|
| D729,892 | S | 5/2015 | Nicolette et al. | |
| D733,234 | S | 6/2015 | Nicolette | |
| 9,044,653 | B2 | 6/2015 | Wahl et al. | |
| D738,449 | S | 9/2015 | Schweigert | |
| D739,487 | S | 9/2015 | Schweigert | |
| 9,192,830 | B2 | 11/2015 | Parsons et al. | |
| 9,199,143 | B1 | 12/2015 | Parsons et al. | |
| D746,927 | S | 1/2016 | Parsons et al. | |
| D748,214 | S | 1/2016 | Nicolette et al. | |
| D748,215 | S | 1/2016 | Parsons et al. | |
| D748,749 | S | 2/2016 | Nicolette et al. | |
| D753,251 | S | 4/2016 | Schweigert et al. | |
| D753,252 | S | 4/2016 | Schweigert | |
| D755,319 | S | 5/2016 | Nicolette et al. | |
| D756,471 | S | 5/2016 | Nicolette et al. | |
| 9,345,938 | B2 | 5/2016 | Parsons et al. | |
| 9,346,203 | B2 | 5/2016 | Parsons et al. | |
| D759,178 | S | 6/2016 | Nicolette | |
| D760,334 | S | 6/2016 | Schweigert et al. | |
| 9,364,727 | B2 | 6/2016 | Parsons et al. | |
| 9,421,437 | B2 | 8/2016 | Parsons et al. | |
| 9,427,634 | B2 | 8/2016 | Parsons et al. | |
| 9,468,821 | B2 | 10/2016 | Parsons et al. | |
| 9,517,393 | B2 | 12/2016 | Cardani et al. | |
| 9,533,201 | B2 | 1/2017 | Parsons et al. | |
| 9,573,027 | B2 | 2/2017 | Nivanh et al. | |
| 9,610,481 | B2 | 4/2017 | Parsons et al. | |
| 2002/0037775 | A1 | 3/2002 | Keelan | |
| 2002/0082108 | A1* | 6/2002 | Peters | A63B 53/00 473/291 |
| 2002/0107087 | A1 | 8/2002 | Fagot | |
| 2002/0094884 | A1 | 10/2002 | Hocknell et al. | |
| 2003/0139226 | A1* | 7/2003 | Cheng | A63B 53/04 473/334 |
| 2003/0176231 | A1 | 9/2003 | Hasebe | |
| 2003/0194548 | A1 | 10/2003 | McLeod | |
| 2004/0092331 | A1 | 5/2004 | Best | |
| 2004/0204263 | A1 | 10/2004 | Fagot et al. | |
| 2004/0266550 | A1 | 12/2004 | Gilbert et al. | |
| 2005/0009632 | A1 | 1/2005 | Schweigert et al. | |
| 2005/0014573 | A1 | 1/2005 | Lee | |
| 2005/0043117 | A1 | 2/2005 | Gilbert et al. | |
| 2005/0119066 | A1 | 6/2005 | Stites et al. | |
| 2005/0239569 | A1 | 10/2005 | Best et al. | |
| 2005/0277485 | A1 | 12/2005 | Hou et al. | |
| 2006/0111200 | A1 | 5/2006 | Poynor | |
| 2006/0229141 | A1 | 10/2006 | Galloway | |
| 2006/0240909 | A1 | 10/2006 | Breier | |
| 2007/0032308 | A1 | 2/2007 | Fagot et al. | |
| 2007/0225084 | A1 | 9/2007 | Schweigert et al. | |
| 2007/0287556 | A1* | 12/2007 | Nakamura | A63B 53/047 473/350 |
| 2008/0058113 | A1 | 3/2008 | Nicolette et al. | |
| 2008/0188322 | A1 | 8/2008 | Anderson et al. | |
| 2008/0300065 | A1 | 12/2008 | Schweigert | |
| 2008/0318705 | A1 | 12/2008 | Clausen et al. | |
| 2008/0318706 | A1* | 12/2008 | Larson | A63B 53/047 473/334 |
| 2009/0029790 | A1 | 1/2009 | Nicolette et al. | |
| 2009/0075751 | A1* | 3/2009 | Gilbert | A63B 53/047 473/332 |
| 2009/0239681 | A1* | 9/2009 | Sugimoto | A63B 53/047 473/350 |
| 2009/0291772 | A1* | 11/2009 | Boyd | A63B 53/047 473/291 |
| 2010/0130306 | A1 | 5/2010 | Schweigert | |
| 2010/0178999 | A1 | 7/2010 | Nicolette et al. | |
| 2011/0111883 | A1 | 5/2011 | Cackett | |
| 2011/0165963 | A1 | 7/2011 | Cackett et al. | |
| 2011/0269567 | A1 | 11/2011 | Ban et al. | |
| 2011/0294596 | A1 | 12/2011 | Ban | |
| 2012/0071259 | A1* | 3/2012 | Clausen | A63B 53/047 473/290 |
| 2012/0172142 | A1 | 7/2012 | Yashiki | |
| 2013/0137532 | A1 | 5/2013 | Deshmukh et al. | |
| 2013/0225319 | A1 | 8/2013 | Kato | |
| 2013/0281226 | A1 | 10/2013 | Ban | |
| 2013/0288823 | A1 | 10/2013 | Hebreo | |
| 2013/0303303 | A1 | 11/2013 | Ban | |
| 2013/0310192 | A1 | 11/2013 | Wahl et al. | |
| 2013/0316842 | A1 | 11/2013 | Demkowski | |
| 2014/0045605 | A1 | 2/2014 | Fujiwara | |
| 2014/0080621 | A1 | 3/2014 | Nicolette et al. | |
| 2014/0128175 | A1 | 5/2014 | Jertson et al. | |
| 2014/0274441 | A1 | 5/2014 | Greer | |
| 2014/0274442 | A1 | 9/2014 | Honea et al. | |
| 2014/0274451 | A1 | 9/2014 | Knight et al. | |
| 2015/0231454 | A1 | 8/2015 | Parsons et al. | |
| 2015/0231806 | A1 | 8/2015 | Parsons et al. | |
| 2018/0169488 | A1 | 6/2018 | Parsons | |

FOREIGN PATENT DOCUMENTS

| | | |
|---|---|---|
| JP | H10-127832 | 5/1998 |
| JP | H10-277187 | 10/1998 |
| JP | 2001-346924 | 12/2001 |
| JP | 2002143356 | 5/2002 |
| JP | 2004-313777 | 11/2004 |
| WO | 92/15374 | 9/1992 |

OTHER PUBLICATIONS

Machine translation, dated May 23, 2018, of JPH0284972, titled "Iron Club Head for Golf".*

Machine translation, dated May 23, 2018, of JPH08257181, titled "Golf Club Head".*

International Search Report and Written Opinion received in connection with corresponding application No. PCT/US2015/016666, dated May 14, 2015 (8 pages).

U.S. Appl. No. 29/512,313, Nicolette, "Golf Club Head," filed Dec. 16, 2014.

Kozuchowski, Zak, "Callaway Mack Daddy 2 PM Grind Wedges" (http://www.golfwrz.com/276203/callaway-mack-daddy-2-pm-grind-wedges/), www.golfwrx.com, GolfWRX Holdings, LLC, published Jan. 21, 2015.

Wall, Jonathan, "Details: Phil's Prototype Mack Daddy PM-Grind Wedge," (http://www.pgatour.com/equipmentreport/2015/01/21/callaway-wedge.html) www.pgatour.com, PGA Tour, Inc., published Jan. 21, 2015.

International Search Report and Written Opinion received in connection with corresponding PCT Application serial No. PCT/US16/42075 dated Sep. 22, 2016 (13 pages).

Taylor Made Golf Company, Inc., https://taylormadegolf.com/on/demandware.static/-/Sites-TMaG-Library/default/v1459859109590/docs/productspecs/TM_S2013_Catalog18.pdf., published Jan. 2013.

RocketBladez Press Release, "GolfBalled", http://golfballed.com/index.php?option=com_content&view=article&id=724:taylormade- . . . Oct. 13, 2017, published Jan. 3, 2013.

International Search Report and Written Opinion, received in connection with corresponding application No. PCT/US14/71250, dated Mar. 12, 2015 (9 pages).

International Search Report and Written Opinion Received in Connection With Corresponding PCT Application Serial No. PCT/US18/30242 dated Sep. 24, 2018 (24 Pages).

* cited by examiner

GOLF CLUB HEADS AND METHODS TO MANUFACTURE GOLF CLUB HEADS

CROSS REFERENCE

This application is a continuation-in-part application of U.S. patent application Ser. No. 15/791,020, filed Oct. 23, 2017, which is a continuation of U.S. patent application Ser. No. 15/785,001, filed Oct. 16, 2017. This application also claims the benefit of U.S. Provisional Application Ser. No. 62/502,442, filed May 5, 2017, U.S. Provisional Application Ser. No. 62/508,794, filed May 19, 2017, U.S. Provisional Application Ser. No. 62/512,033, filed May 28, 2017, and U.S. Provisional Application Ser. No. 62/570,493, filed Oct. 10, 2017. This application is a continuation-in-part of U.S. Non-Provisional application Ser. No. 15/687,317, filed Aug. 25, 2017, which is a continuation of U.S. Non-Provisional application Ser. No. 15/433,753, filed Feb. 15, 2017, now U.S. Pat. No. 9,764,208, which claims the benefit of U.S. Provisional Application No. 62/343,739, filed May 31, 2016. U.S. Non-Provisional application Ser. No. 15/433,753, now U.S. Pat. No. 9,764,208, is also a continuation application of U.S. Non-Provisional application Ser. No. 15/188,718, filed Jun. 21, 2016, now U.S. Pat. No. 9,610,481, which claims the benefit of U.S. Provisional Application No. 62/343,739, filed May 31, 2016. This application is also a continuation-in-part of U.S. Non-Provisional application Ser. No. 15/701,131, filed Sep. 11, 2017, which is a continuation of U.S. Non-Provisional application Ser. No. 15/685,986, filed Aug. 24, 2017, which is a continuation of U.S. patent application Ser. No. 15/628,251, filed Jun. 20, 2017, which is a continuation of U.S. Non-Provisional application Ser. No. 15/209,364, filed on Jul. 13, 2016, which is a continuation application of U.S. Non-Provisional application Ser. No. 14/589,277, filed Jan. 5, 2015, now U.S. Pat. No. 9,421,437, which is a continuation application of U.S. Non-Provisional application Ser. No. 14/513,073, filed Oct. 13, 2014, now U.S. Pat. No. 8,961,336, which is a continuation application of U.S. Non-Provisional application Ser. No. 14/498,603, filed Sep. 26, 2014, now U.S. Pat. No. 9,199,143, which claims the benefit of U.S. Provisional Application No. 62/041,538, filed Aug. 25, 2014. U.S. Non-Provisional application Ser. No. 15/209,364, filed on Jul. 13, 2016, is also a continuation application of U.S. Non-Provisional application Ser. No. 14/618,501, filed Feb. 10, 2015, now U.S. Pat. No. 9,427,634, which is a continuation application of U.S. Non-Provisional application Ser. No. 14/589,277, filed Jan. 5, 2015, now U.S. Pat. No. 9,421,437. U.S. Non-Provisional application Ser. No. 15/209,364, filed on Jul. 13, 2016, is also a continuation application of International Application No. PCT/US15/16666, filed Feb. 19, 2015, which claims the benefits of U.S. Provisional Application No. 61/942,515, filed Feb. 20, 2014, U.S. Provisional Application No. 61/945,560, filed Feb. 27, 2014, U.S. Provisional Application No. 61/948,839, filed Mar. 6, 2014, U.S. Provisional Application No. 61/952,470, filed Mar. 13, 2014, U.S. Provisional Application No. 61/992,555, filed May 13, 2014, U.S. Provisional Application No. 62/010,836, filed Jun. 11, 2014, U.S. Provisional Application No. 62/011,859, filed Jun. 13, 2014, and U.S. Provisional Application No. 62/032,770, filed Aug. 4, 2014. U.S. Non-Provisional application Ser. No. 15/209,364, filed on Jul. 13, 2016, is also a continuation application of International Application No. PCT/US14/71250, filed Dec. 18, 2014, which is a continuation of U.S. Non-Provisional application Ser. No. 14/498,603, filed Sep. 26, 2014, now U.S. Pat. No. 9,199,143. The disclosures of the referenced applications are incorporated herein by reference.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacturing golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG) and/or the moment of inertia (MOI) of the golf club heads may be optimized to produce certain trajectory and spin rate of a golf ball.

Figure 1:
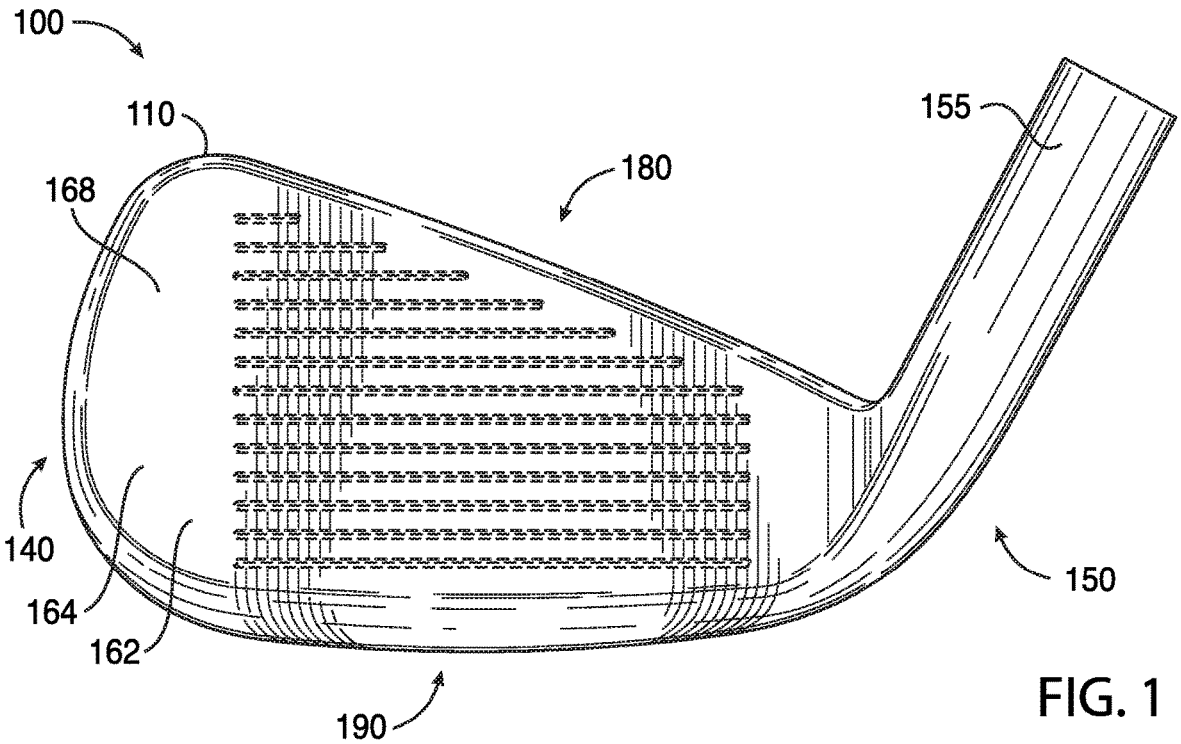
FIG. 1 depicts a front view of a golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

In general, golf club heads and methods to manufacture golf club heads are described herein. The apparatus, methods, and articles of manufacture described herein are not limited in this regard.

In the example of FIGS. 1-14, a golf club head 100 may include a body portion 110 (FIG. 14) having a toe portion 140, a heel portion 150, a front portion 160 with a face portion 162 (e.g., a strike face) having a front surface 164 and a back surface 166, a back portion 170, a top portion 180, and a sole portion 190. The toe portion 140, the heel portion 150, the front portion 160, the back portion 170, the top portion 180, and/or the sole portion 190 may partially overlap each other. For example, a portion of the toe portion 140 may overlap portion(s) of the front portion 160, the back portion 170, the top portion 180, and/or the sole portion 190. In a similar manner, a portion of the heel portion 150 may overlap portion(s) of the front portion 160, the back portion 170, the top portion 180, and/or the sole portion 190. In another example, a portion of the back portion 170 may overlap portion(s) of the toe portion 140, the heel portion 150, the top portion 180, and/or the sole portion 190. The apparatus, methods, and articles of manufacture described herein are not limited in this regard.

The golf club head 100 may be an iron-type golf club head (e.g., a 1-iron, a 2-iron, a 3-iron, a 4-iron, a 5-iron, a 6-iron, a 7-iron, an 8-iron, a 9-iron, etc.) or a wedge-type golf club head (e.g., a pitching wedge, a lob wedge, a sand wedge, an n-degree wedge such as 44 degrees (°), 48°, 52°, 56°, 60°, etc.). Although FIGS. 1-10 may depict a particular type of club head, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The toe portion 140 may include a portion of the body portion 110 opposite of the heel portion 150. The heel portion 150 may include a hosel portion 155 configured to receive a shaft (not shown) with a grip (not shown) on one end and the golf club head 100 on the opposite end of the shaft to form a golf club. The front surface 164 of the face portion 162 may include one or more score lines, slots, or grooves 168 extending to and/or between the toe portion 140 and the heel portion 150. While the figures may depict a particular number of grooves, the apparatus, methods, and articles of manufacture described herein may include more or less grooves. The face portion 162 may be used to impact a golf ball (not shown). The face portion 162 may be an integral portion of the body portion 110. Alternatively, the face portion 162 may be a separate piece or an insert coupled to the body portion 110 via various manufacturing methods and/or processes (e.g., a bonding process such as adhesive, a welding process such as laser welding, a brazing process, a soldering process, a fusing process, a mechanical locking or connecting method, any combination thereof, or other suitable types of manufacturing methods and/or processes). The face portion 162 may be associated with a loft plane that defines the loft angle of the golf club head 100. The loft angle may vary based on the type of golf club (e.g., a long iron, a middle iron, a short iron, a wedge, etc.). In one example, the loft angle may be between five degrees and seventy-five degrees. In another example, the loft angle may be between twenty degrees and sixty degrees. The apparatus, methods, and articles of manufacture described herein are not limited in this regard.

Figure 6:
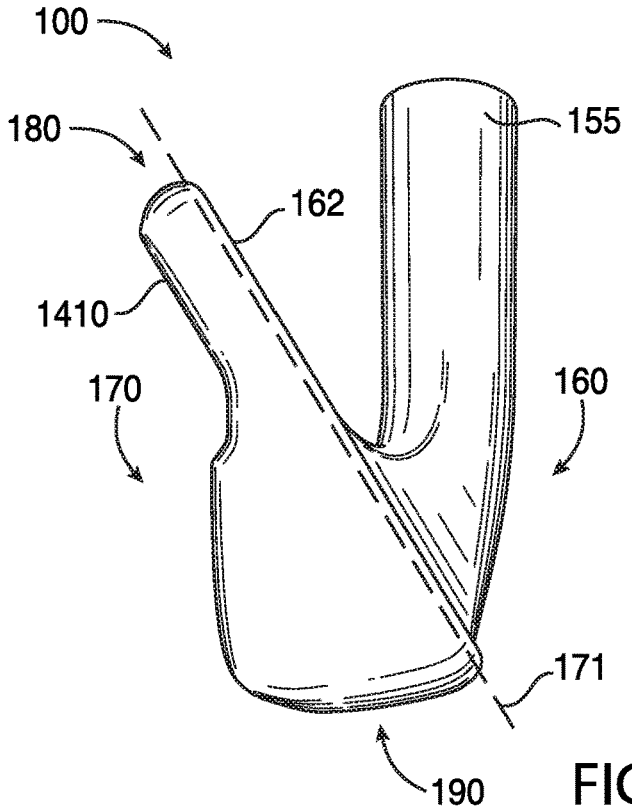
FIG. 6 depicts a right view of the example golf club head of FIG. 1.

The back portion 170 may include a portion of the body portion 110 opposite of the front portion 160. In one example, the back portion 170 may be a portion of the body portion 110 behind the back surface 166 of the face portion 162. As shown in FIG. 6, for example, the back portion 170 may be a portion of the body portion 110 behind a plane 171 defined by the back surface 166 of the face portion 162. In another example, the plane 171 may be parallel to the loft plane of the face portion 162. As mentioned above, for example, the face portion 162 may be a separate piece or an insert coupled to the body portion 110. Accordingly, the back portion 170 may include remaining portion(s) of the body portion 110 other than the face portion 162. The apparatus, methods, and articles of manufacture described herein are not limited in this regard.

Figure 14:
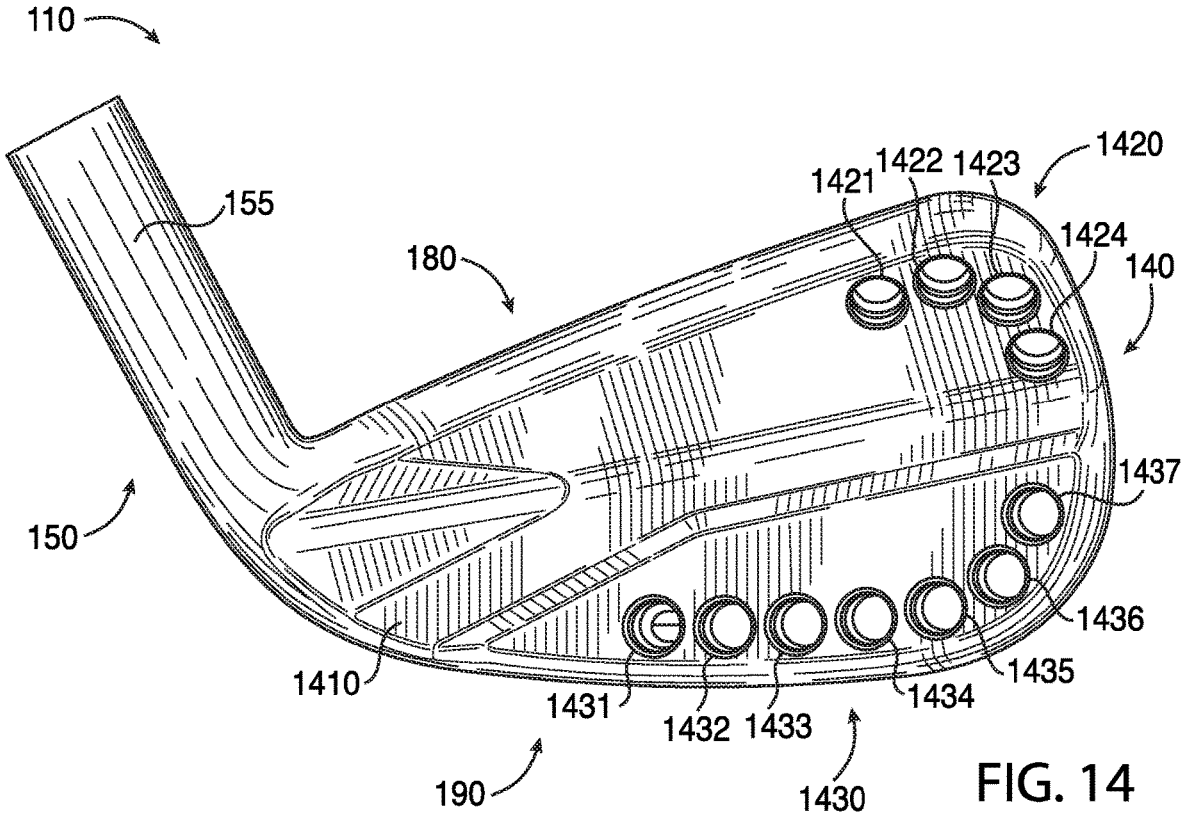
FIG. 14 depicts a rear view of a body portion of the example golf club head of FIG. 1.

Further, the body portion 110 may include one or more ports, which may be exterior ports and/or interior ports (e.g., located inside the body portion 110). The interior walls of the body portion 110 may include one or more ports. In one example, the back portion 170 may include one or more ports (e.g., inside an interior cavity, generally shown as 700 in FIG. 7). In another example, the body portion 110 may include one or more ports along a periphery of the body portion 110. As illustrated in FIG. 14, for example, the body portion 110 may include one or more ports on the back portion 170, generally shown as a first set of ports 1420 (e.g., shown as ports 1421, 1422, 1423, and 1424) and a second set of ports 1430 (e.g., shown as ports 1431, 1432, 1433, 1434, 1435, 1436, and 1437). In another example, one or more ports may be on a back wall portion 1410 of the back portion 170. One or more ports may be associated with a port diameter, which may be defined as the largest distance to and/or between opposing ends or boundaries of a port. For example, a port diameter for a rectangular port (e.g., a slot, slit, or elongated rectangular opening) may refer to a diagonal length of a rectangle. In another example, a port diameter of an elliptical port may refer to the major axis of an ellipse. As shown in FIG. 14, for example, each port may have a circular shape with a port diameter equivalent to a diameter of a circle. In one example, the port diameter of the first set of ports 1420 and/or the second set of ports 1430 may be about 0.25 inch (6.35 millimeters). Any two adjacent ports of the first set of ports 1420 may be separated by less than or equal to the port diameter. In a similar manner, any two adjacent ports of the second set of ports 1430 may be separated by less than or equal to the port diameter. Some adjacent ports may be separated by greater than the port diameter. The apparatus, methods, and articles of manufacture described herein are not limited in this regard.

Figure 2:
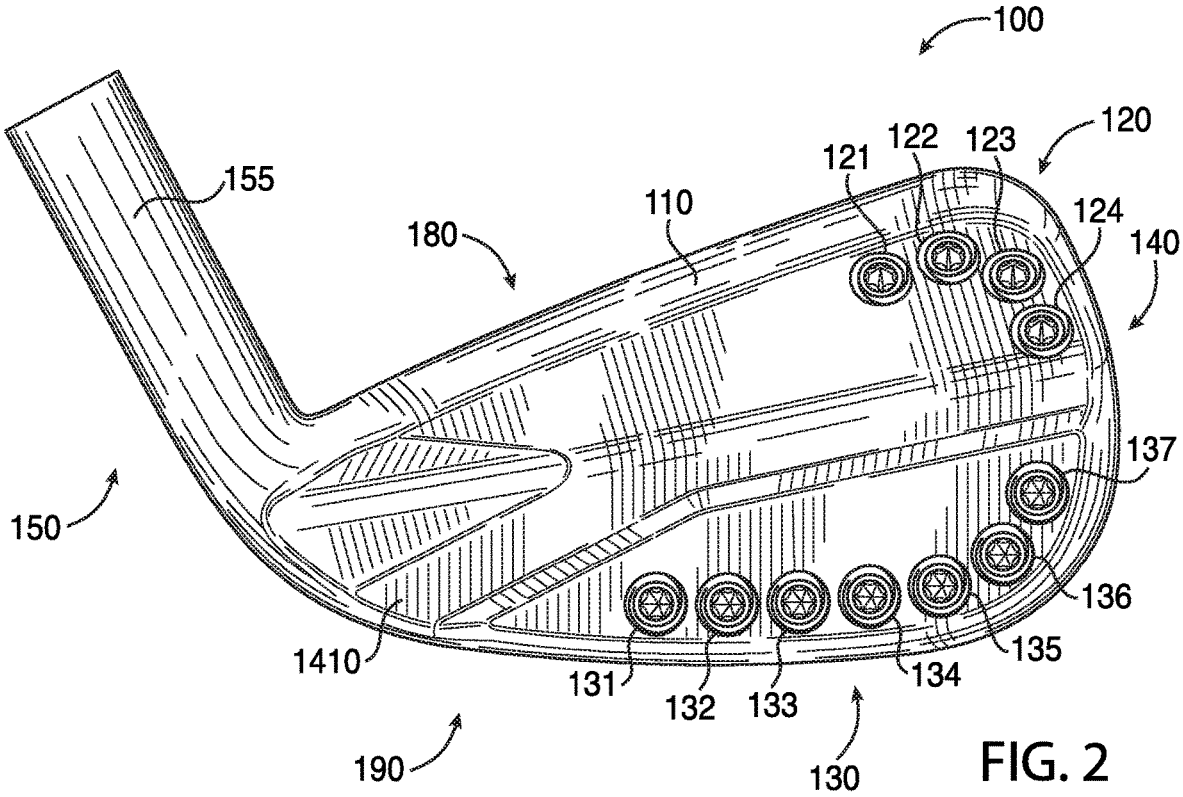
FIG. 2 depicts a rear view of the example golf club head of FIG. 1.
Figure 3:
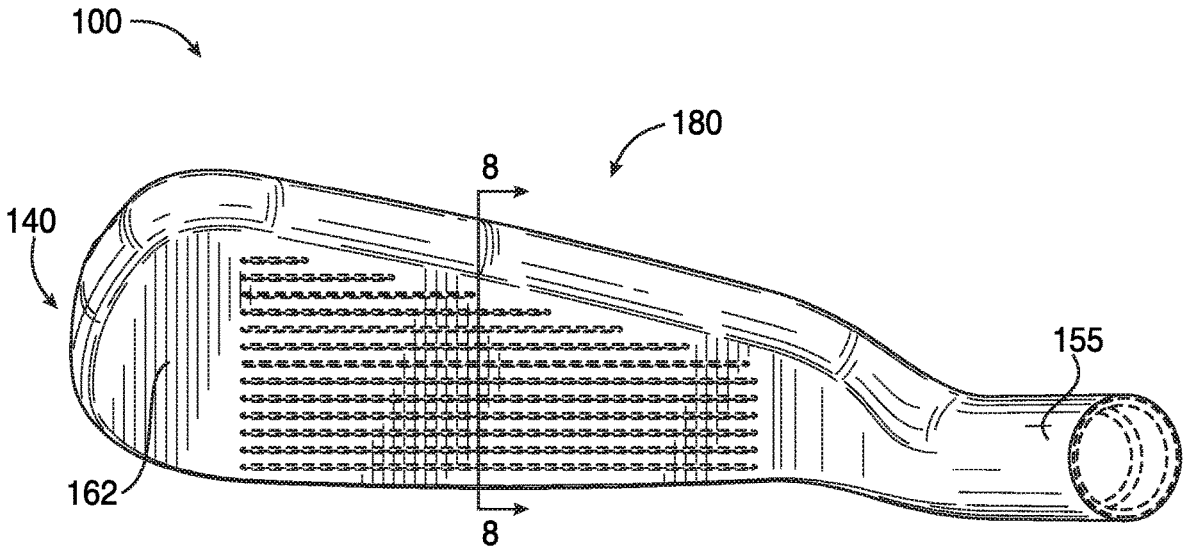
FIG. 3 depicts a top view of the example golf club head of FIG. 1.
Figure 4:
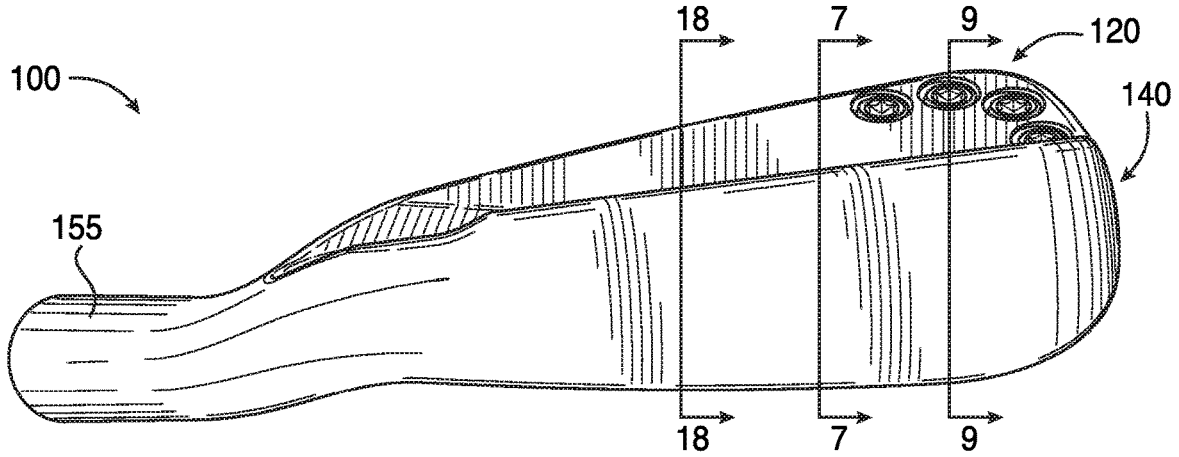
FIG. 4 depicts a bottom view of the example golf club head of FIG. 1.
Figure 5:
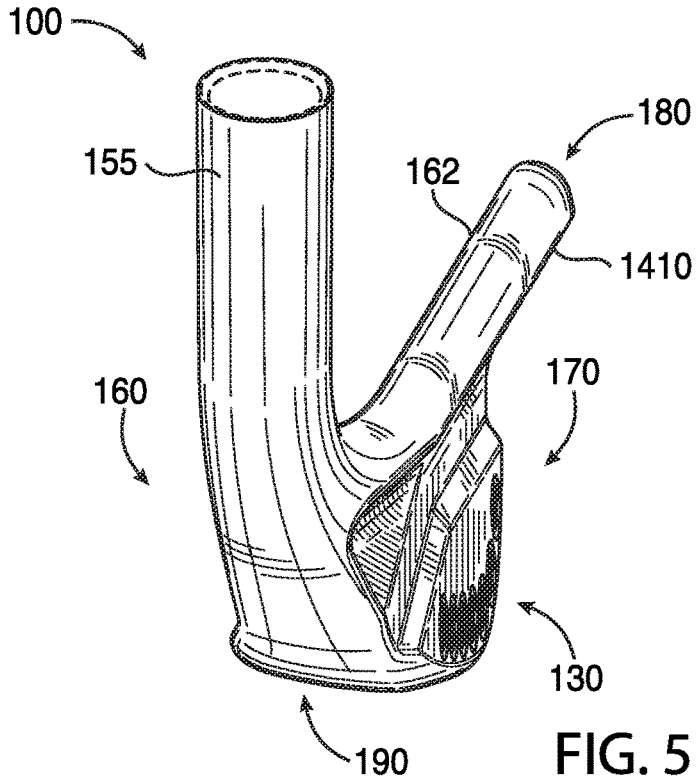
FIG. 5 depicts a left view of the example golf club head of FIG. 1.

The body portion 110 may include one or more mass portions, which may be integral mass portion(s) or separate mass portion(s) that may be coupled to the body portion 110. In the illustrated example as shown in FIG. 2, the body portion 110 may include a first set of mass portions 120 (e.g., shown as mass portions 121, 122, 123, and 124) and a second set of mass portions 130 (e.g., shown as mass portions 131, 132, 133, 134, 135, 136, and 137). While the above example, may describe a particular number or portions of mass portions, a set of mass portions may include a single mass portion or a plurality of mass portions. For example, the first set of mass portions 120 may be a single mass portion. In a similar manner, the second set of mass portions 130 may be a single mass portion. Further, the first set of mass portions or the second set of mass portions 130 may be a portion of the physical structure of the body portion 110. The apparatus, methods, and articles of manufacture described herein are not limited in this regard.

The body portion 110 may be made of a first material whereas the first set of mass portions 120 and/or the second set of mass portions 130 may be made of a second material. The first and second materials may be similar or different materials. For example, the body portion 110 may be partially or entirely made of a steel-based material (e.g., 17-4 PH stainless steel, Nitronic® 50 stainless steel, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. In one example, one or more mass portions of the first set of mass portions 120 and/or the second set of mass portions 130 may be partially or entirely made of a high-density material such as a tungsten-based material or other suitable types of materials. In another example, one more mass portions of the first set of mass portions 120 and/or the second set of mass portions 130 may be partially or entirely made of other suitable metal material such as a stainless steel-based material, a titanium-based material, an aluminum-based material, any combination thereof, and/or other suitable types of materials. Further, one or more mass portions of the first set of mass portions 120 and/or the second set of mass portions 130 may be made of different types of materials (e.g., metal core and polymer sleeve surrounding the metal core). The body portion 110, the first set of mass portions 120, and/or the second set of mass portions 130 may be partially or entirely made of similar or different non-metal materials (e.g., composite, plastic, polymer, etc.). The apparatus, methods, and articles of manufacture are not limited in this regard.

Figure 10:
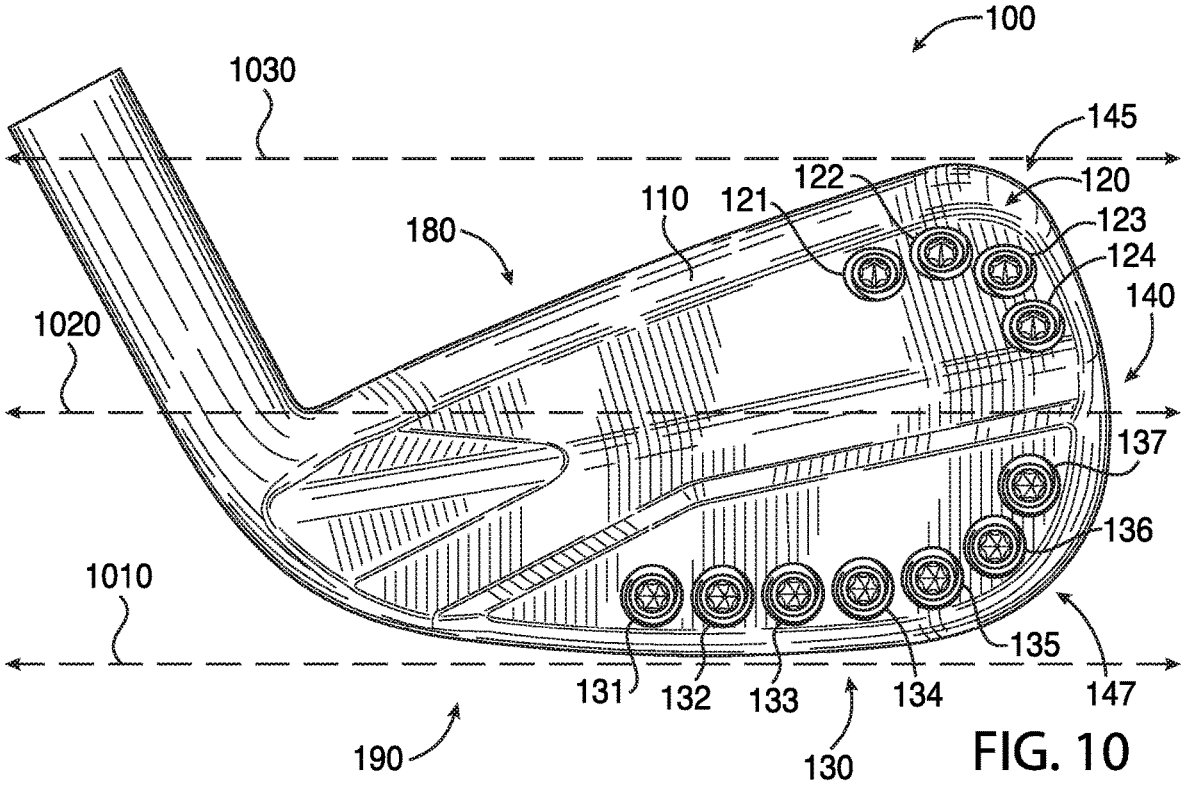
FIG. 10 depicts another rear view of the example golf club head of FIG. 1.

One or more ports may be configured to receive a mass portion having a similar shape as the port. For example, a rectangular port may receive a rectangular mass portion. In another example, an elliptical port may receive an elliptical mass portion. As shown in FIGS. 10 and 14, for example, the first and second sets of ports 1420 and 1430, respectively, may be cylindrical ports configured to receive one or more cylindrical mass portions. In particular, one or more mass portions of the first set 120 (e.g., generally shown as mass portions 121, 122, 123, and 124) may be disposed in a port located at or proximate to the toe portion 140 and/or the top portion 180. For example, the mass portion 121 may be partially or entirely disposed in the port 1421. One or more mass portions of the second set 130 (e.g., generally shown as mass portions 131, 132, 133, 134, 135, 136, and 137) may be disposed in a port located at or proximate to the toe portion 140 and/or the sole portion 190. For example, the mass portion 135 may be partially or entirely disposed in the port 1435. The first set of mass portions 120 and/or the second set of mass portions 130 may be coupled to the body portion 110 with various manufacturing methods and/or processes (e.g., a bonding process, a welding process, a brazing process, a mechanical locking method, any combination thereof, or other suitable manufacturing methods and/or processes).

Alternatively, the golf club head 100 may not include (i) the first set of mass portions 120, (ii) the second set of mass portions 130, or (iii) both the first and second sets of mass portions 120 and 130, respectively. In particular, the body portion 110 may not include ports at or proximate to the top portion 180 and/or the sole portion 190. For example, the mass of the first set of mass portions 120 (e.g., 3 grams) and/or the mass of the second set of mass portions 130 (e.g., 16.8 grams) may be integral part(s) of the body portion 110 instead of separate mass portion(s). In one example, the body portion 110 may include interior and/or exterior integral mass portions at or proximate to the toe portion 140 and/or at or proximate to the heel portion 150. In another example, a portion of the body portion 110 may include interior and/or exterior integral mass portions extending to and/or between the toe portion 140 and the heel portion 150.

The first and/or second set of mass portions 120 and 130, respectively, may affect the mass, the center of gravity (CG), the moment of inertia (MOI), or other physical properties of the golf club head 100. The apparatus, methods, and articles of manufacture described herein are not limited in this regard.

Figure 11:
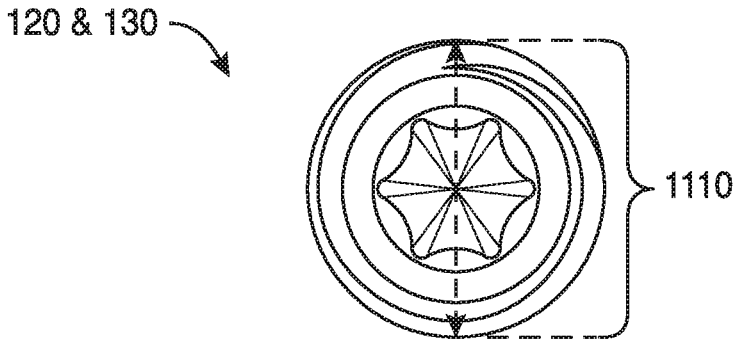
FIG. 11 depicts a top view of a mass portion associated with the example golf club head of FIG. 1.

One or more mass portions of the first set of mass portions 120 and/or the second set of mass portions 130 may have similar or different physical properties (e.g., color, marking, shape, size, density, mass, volume, external surface texture, materials of construction, etc.). Accordingly, the first set of mass portions 120 and/or the second set of mass portions 130 may contribute to the ornamental design of the golf club head 100. In the illustrated example as shown in FIG. 11, one or more mass portions of the first set of mass portions 120 and/or the second set of mass portions 130 may have a cylindrical shape (e.g., a circular cross section). Alternatively, one or more mass portions of the first set 120 may have a first shape (e.g., a cylindrical shape) whereas one or more mass portions of the second set 130 may have a second shape (e.g., a cubical shape). In another example, the first set of mass portions 120 may include two or more mass portions with different shapes (e.g., the mass portion 121 may be a first shape whereas the mass portion 122 may be a second shape different from the first shape). Likewise, the second set of mass portions 130 may also include two or more mass portions with different shapes (e.g., the mass portion 131 may be a first shape whereas the mass portion 132 may be a second shape different from the first shape). In another example, one or more mass portions of the first set of mass portions 120 and/or the second set of mass portions 130 may have a different color(s), marking(s), shape(s), density or densities, mass(es), volume(s), material(s) of construction, external surface texture(s), and/or any other physical property as compared to one or more mass portions of the first set of mass portions 120 and/or the second set of mass portions 130. The apparatus, methods, and articles of manufacture described herein are not limited in this regard.

Although the above examples may describe mass portions having a particular shape, the apparatus, methods, and articles of manufacture described herein may include mass portions of other suitable shapes (e.g., a portion of or a whole sphere, cube, cone, cylinder, pyramid, cuboidal, prism, frustum, rectangular, elliptical, or other suitable geometric shape). While the above examples and figures may depict multiple mass portions as a set of mass portions, two or more mass portions of the first set of mass portions 120 and/or the second set of mass portions 130 may be a single piece of mass portion. In one example, the first set of mass portions 120 may be a single piece of mass portion instead of a series of four separate mass portions. In another example, the second set of mass portions 130 may be a single piece of mass portion instead of a series of seven separate mass portions. The apparatus, methods, and articles of manufacture described herein are not limited in this regard.

Figure 12:
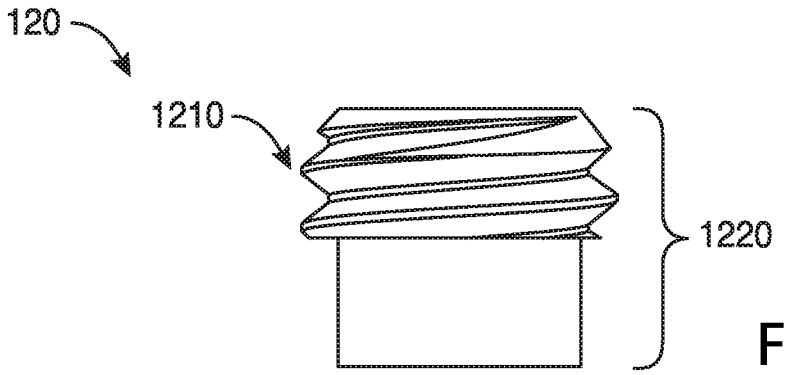
FIG. 12 depicts a side view of a mass portion associated with the example golf club head of FIG. 1.
Figure 13:
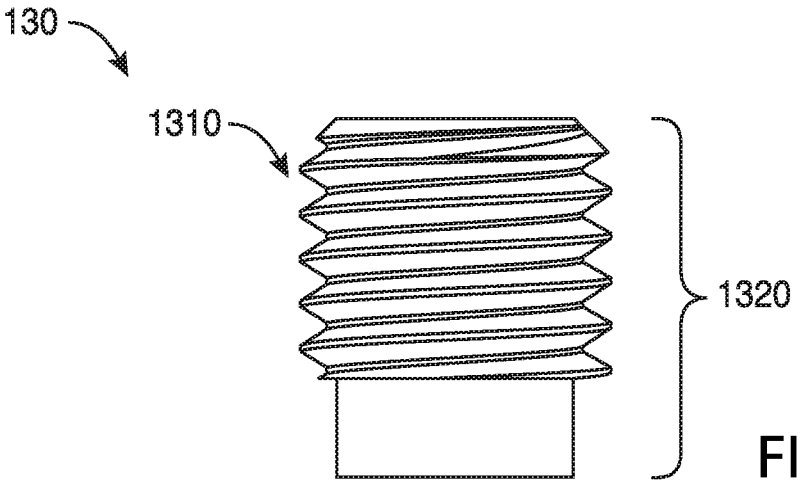
FIG. 13 depicts a side view of another mass portion associated with the example golf club head of FIG. 1.

Referring to FIGS. 12 and 13, for example, the first set of mass portions 120 and/or the second set of mass portions 130 may include threads, generally shown as 1210 and 1310, respectively, to engage with correspondingly configured threads in the ports to secure in the ports of the back portion 170 (e.g., generally shown as 1420 and 1430 in FIG. 14). Accordingly, one or more mass portions as described herein may be shaped similar to and function as a screw or threaded fastener for engaging threads in a port. For example, one or more mass portions of the first set of mass portions 120 and/or the second set of mass portions 130 may be a screw. One or more mass portions of the first set of mass portions 120 and/or the second set of mass portions 130 may not be readily removable from the body portion 110 with or without a tool. Alternatively, one or more mass portions of the first set of mass portions 120 and/or the second set of mass portions 130 may be readily removable (e.g., with a tool) so that a relatively heavier or lighter mass portion may replace one or more mass portions of the first and second sets of mass portions 120 and 130, respectively. In another example, one or more mass portions of the first set of mass portions 120 and/or the second set of mass portions 130 may be secured in the ports of the back portion 170 with epoxy or adhesive so that the one or more mass portions of the first set of mass portions 120 and/or the second set of mass portions 130 may not be readily removable. In yet another example, one or more mass portions of the first set of mass portions 120 and/or the second set of mass portions 130 may be secured in the ports of the back portion 170 with both epoxy and threads so that the one more mass portions of the first set of mass portions 120 and/or the second set of mass portions 130 may not be readily removable. In yet another example, one or more mass portions described herein may be press fit in a port. In yet another example, one or more mass portions described herein may be formed inside a port by injection molding. For example, a liquid metallic material (i.e., molten metal) or a plastic material (e.g. rubber, foam, or any polymer material) may be injected into a port. After the liquid material is cooled and/or cured inside the port, the resulting solid material (e.g., a metal material, a plastic material, or a combination thereof), may be a mass portion. The apparatus, methods, and articles of manufacture described herein are not limited in this regard.

As mentioned above, one or more mass portions of the first set of mass portions 120 and/or the second set of mass portions 130 may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. In yet another example, as illustrated in FIGS. 11-13, one or more mass portions of the first set of mass portions 120 and/or the second set of mass portions 130 may have a diameter 1110 of about 0.25 inch (6.35 millimeters) but one or more mass portions of the first set of mass portions 120 and/or the second set of mass portions 130 may be different in height. In particular, one or more mass portions of the first set of mass portions 120 may be associated with a first height 1220 (FIG. 12), and one or more mass portions of the second set of mass portions 130 may be associated with a second height 1320 (FIG. 13). The first height 1220 may be relatively shorter than the second height 1320. In one example, the first height 1220 may be about 0.125 inch (3.175 millimeters) whereas the second height 1320 may be about 0.3 inch (7.62 millimeters). In another example, the first height 1220 may be about 0.16 inch (4.064 millimeters) whereas the second height 1320 may be about 0.4 inch (10.16 millimeters). Alternatively, the first height 1220 may be equal to or greater than the second height 1320. Although the above examples may describe particular dimensions, one or more mass portions described herein may have different dimensions. The apparatus, methods, and articles of manufacture described herein are not limited in this regard.

Referring to FIG. 10, for example, the golf club head 100 may be associated with a ground plane 1010, a horizontal midplane 1020, and a top plane 1030. In particular, the ground plane 1010 may be a tangential plane to the sole portion 190 of the golf club head 100 when the golf club head 100 is at an address position (e.g., the golf club head 100 is aligned to strike a golf ball). A top plane 1030 may be a tangential plane to the top portion of the 180 of the golf club head 100 when the golf club head 100 is at the address position. The ground and top planes 1010 and 1030, respectively, may be substantially parallel to each other. The horizontal midplane 1020 may be vertically halfway between the ground and top planes 1010 and 1030, respectively.

The body portion 110 may include any number of ports (e.g., no ports, one port, two ports, etc.) above the horizontal midplane 1020 and/or below the horizontal midplane 1020. In one example, the body portion 110 may include a greater number of ports below the horizontal midplane 1020 than above the horizontal midplane 1020. In the illustrated example as shown in FIG. 14, the body portion 110 may include four ports (e.g., generally shown as ports 1421, 1422, 1423, and 1424) above the horizontal midplane 1020 and seven ports (e.g., generally shown as ports 1431, 1432, 1433, 1434, 1435, 1436, and 1437) below the horizontal midplane 1020. In another example (not shown), the body portion 110 may include two ports above the horizontal midplane 1020 and five ports below the horizontal midplane 1020. In yet another example (not shown), the body portion 110 may not have any ports above the horizontal midplane 1020 but have one or more ports below the horizontal midplane 1020. Accordingly, the body portion 110 may have more ports below the horizontal midplane 1020 than above the horizontal midplane 1020. Further, the body portion 110 may include a port at or proximate to the horizontal midplane 1020 with a portion of the port above the horizontal midplane 1020 and a portion of the port below the horizontal midplane 1020. Accordingly, the port may be (i) above the horizontal midplane 1020, (ii) below the horizontal midplane 1020, or (iii) both above and below the horizontal midplane 1020. The apparatus, methods, and articles of manufacture described herein are not limited in this regard.

To provide optimal perimeter weighting for the golf club head 100, the first set of mass portions 120 (e.g., generally shown as mass portions 121, 122, 123, and 124) may be configured to counter-balance the mass of the hosel 155. For example, as shown in FIG. 10, the first set of mass portions 120 (e.g., generally shown as mass portions 121, 122, 123 and 124) may be located at or near the periphery of the body portion 110 and extend to and/or between the top portion 180 and the toe portion 140. In other words, the first set of mass portions 120 may be located on the golf club head 100 at a generally opposite location relative to the hosel 155. In another example, at least a portion of the first set of mass portions 120 may extend at or near the periphery of the body portion 110 and extend along a portion of the top portion 180. In yet another example, at least a portion of the first set of mass portions 120 may extend at or near the periphery of the body portion 110 and extend along a portion of the toe portion 140. Further, the first set of mass portions 120 may be above the horizontal midplane 1020 of the golf club head 100. For example, the first set of mass portions 120 may be at or near the horizontal midplane 1020. In another example, a portion of the first set of mass portions 120 may be at or above the horizontal midplane 1020 and another portion of the first set of mass portions 120 may be at or below the horizontal midplane 1020. Accordingly, a set of mass portions, which may be a single mass portion, may have portions above the horizontal midplane 1020 and below the horizontal midplane 1020. The apparatus, methods, and articles of manufacture described herein are not limited in this regard.

At least a portion of the first set of mass portions 120 may be at or near the toe portion 140 to increase the MOI of the golf club head 100 about a vertical axis of the golf club head 100 that extends through the CG of the golf club head 100. Accordingly, the first set of mass portions 120 may be at or near the periphery of the body portion 110 and extend through the top portion 180 and/or the toe portion 140 to counter-balance the mass of the hosel 155 and/or increase the MOI of the golf club head 100. The locations of the first set of mass portions 120 (i.e., the locations of the first set of ports 1420) and the physical properties and materials of construction of the first set of mass portions 120 may be determined to optimally affect the mass, mass distribution, CG, MOI, structural integrity and/or or other static and/or dynamic characteristics of the golf club head 100. The apparatus, methods, and articles of manufacture described herein are not limited in this regard.

The second set of mass portions 130 (e.g., generally shown as mass portions 131, 132, 133, 134, 135, 136, and 137) may be configured to place the CG of the golf club head 100 at an optimal location and optimize the MOI of the golf club head 100. Referring to FIG. 10, all or a substantial portion of the second set of mass portions 130 may be generally at or near the sole portion 190. For example, the second set of mass portions 130 (e.g., generally shown as mass portions 131, 132, 133, 134, 135, 136, and 137) may be at or near the periphery of the body portion 110 and extend from the sole portion 190 to the toe portion 140. As shown in the example of FIG. 10, the mass portions 131, 132, 133, and 134 may be located at or near the periphery of the body portion 110 and extend along the sole portion 190 to lower the CG of the golf club head 100. The mass portions 135, 136 and 137 may be located at or near the periphery of the body portion 110 and extend to and/or between the sole portion 190 and the toe portion 140 to lower the CG and increase the MOI of the golf club head 100. For example, the MOI of the golf club head 100 about a vertical axis extending through the CG may increase. To lower the CG of the golf club head 100, all or a portion of the second set of mass portions 130 may be located closer to the sole portion 190 than to the horizontal midplane 1020. For example, the mass portions 131, 132, 133, 134, 135, and 136 may be closer to the sole portion 190 than to the horizontal midplane 1020. The locations of the second set of mass portions 130 (i.e., the locations of the second set of ports 1430) and the physical properties and materials of construction of the second set of mass portions 130 may be determined to optimally affect the mass, mass distribution, CG, MOI, structural integrity and/or or other static and/or dynamic characteristics of the golf club head 100. The apparatus, methods, and articles of manufacture described herein are not limited in this regard.

Figure 7:
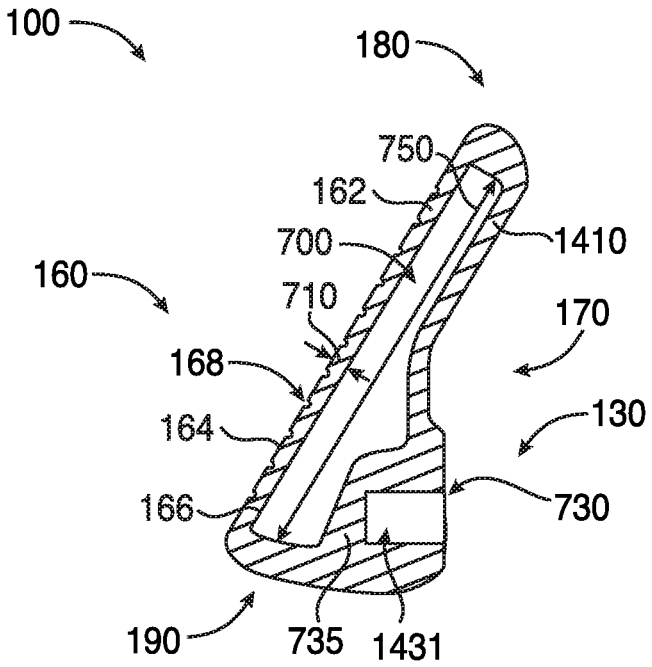
FIG. 7 depicts a cross-sectional view of the example golf club head of FIG. 1 along line 7-7.
Figure 8:
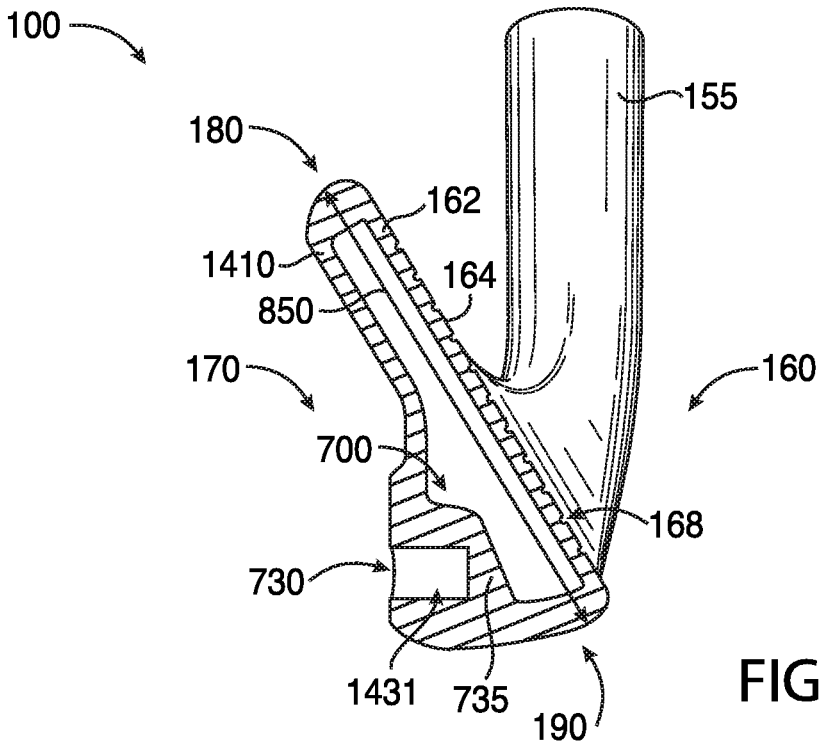
FIG. 8 depicts a cross-sectional view of the example golf club head of FIG. 1 along line 8-8.
Figure 9:
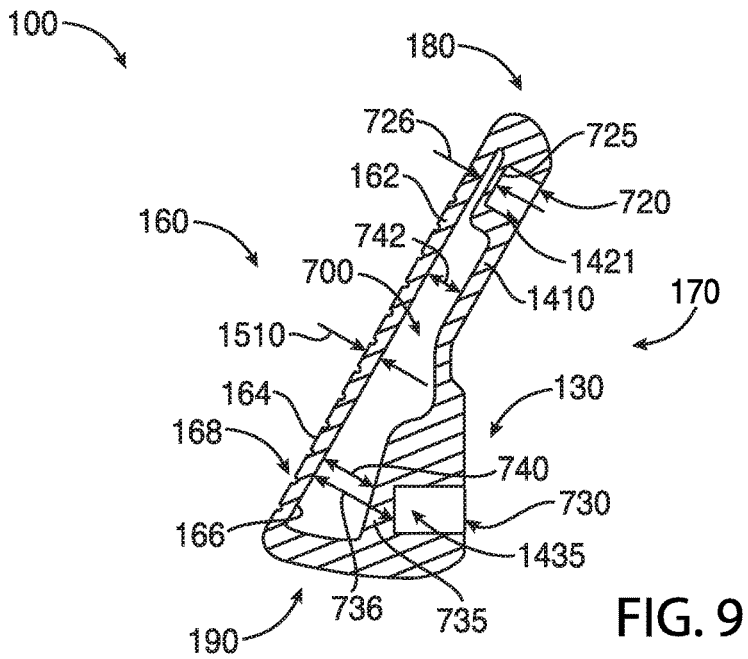
FIG. 9 depicts a cross-sectional view of the example golf club head of FIG. 1 along line 9-9.

Turning to FIGS. 7-9, for example, one or more mass portions of the first set of mass portions 120 and/or the second set of mass portions 130 may be located away from the back surface 166 of the face portion 162 (e.g., not directly coupled to each other). That is, one or more mass portions of the first set of mass portions 120 and/or the second set of mass portions 130 and the back surface 166 may be partially or entirely separated by an interior cavity 700 of the body portion 110. As shown in FIG. 14, for example, one or more ports of the first and second sets of ports 1420 and 1430 may include an opening (e.g., generally shown as 720 and 730) and a port wall (e.g., generally shown as 725 and 735). The port walls 725 and 735 may be integral portions of the back wall portion 1410 (e.g., a section of the back wall portion 1410) or the body portion 110 depending on the location of each port. The opening 720 may be configured to receive a mass portion such as mass portion 121. The opening 730 may be configured to receive a mass portion such as mass portion 135. The opening 720 may be located at one end of the port 1421, and the port wall 725 may be located or proximate to at an opposite end of the port 1421. In a similar manner, the opening 730 may be located at one end of the port 1435, and the port wall 735 may be located at or proximate to an opposite end of the port 1435. The port walls 725 and 735 may be separated from the face portion 162 (e.g., separated by the interior cavity 700). The port wall 725 may have a distance 726 from the back surface 166 of the face portion 162 as shown in FIG. 9. The port wall 735 may have a distance 736 from the back surface 166 of the face portion 162. The distances 726 and 736 may be determined to optimize the location of the CG of the golf club head 100 when the first and second sets of ports 1420 and 1430, respectively, receive mass portions as described herein. According to one example, the distance 736 may be greater than the distance 726 so that the CG of the golf club head 100 may be moved toward the back portion 170. As a result, a width 740 of a portion of the interior cavity 700 below the horizontal midplane 1020 may be greater than a width 742 of the interior cavity 700 above the horizontal midplane 1020. The apparatus, methods, and articles of manufacture described herein are not limited in this regard.

As described herein, the CG of the golf club head 100 may be relatively farther back away from the face portion 162 and relatively lower towards a ground plane (e.g., one shown as 1010 in FIG. 10) with all or a substantial portion of the second set of mass portions 130 being at or closer to the sole portion 190 than to the horizontal midplane 1020 and the first and second sets of mass portions 120 and 130, respectively being away from the back surface 166 than if the second set of mass portions 130 were directly coupled to the back surface 166. The body portion 110 may include any number of mass portions (e.g., no mass portions, one mass portion, two mass portions, etc.) and/or any configuration of mass portions (e.g., mass portion(s) integral with the body portion 110) above the horizontal midplane 1020 and/or below the horizontal midplane 1020. The locations of the first and second sets of ports 1420 and 1430 and/or the locations (e.g., internal mass portion(s), external mass portion(s), mass portion(s) integral with the body portion 110, etc.), physical properties and materials of construction of the first set of mass portions 120 and/or the second set of mass portions 130 may be determined to optimally affect the mass, mass distribution, CG, MOI characteristics, structural integrity and/or or other static and/or dynamic characteristics of the golf club head 100. Different from other golf club head designs, the interior cavity 700 of the body portion 110 and the location of the first set of mass portions 120 and/or the second set of mass portion 130 along the periphery of the golf club head 100 may result in a golf ball traveling away from the face portion 162 at a relatively higher ball launch angle and a relatively lower spin rate. As a result, the golf ball may travel farther (i.e., greater total distance, which includes carry and roll distances). The apparatus, methods, and articles of manufacture described herein are not limited in this regard.

While the figures may depict ports with a particular cross-section shape, the apparatus, methods, and articles of manufacture described herein may include ports with other suitable cross-section shapes. In one example, the ports of the first and/or second sets of ports 1420 and 1430 may have U-like cross-section shape. In another example, the ports of the first and/or second set of ports 1420 and 1430 may have V-like cross-section shape. One or more of the ports associated with the first set of mass portions 120 may have a different cross-section shape than one or more ports associated with the second set of mass portions 130. For example, the port 1421 may have a U-like cross-section shape whereas the port 1435 may have a V-like cross-section shape. Further, two or more ports associated with the first set of mass portions 120 may have different cross-section shapes. In a similar manner, two or more ports associated with the second set of mass portions 130 may have different cross-section shapes. The apparatus, methods, and articles of manufacture described herein are not limited in this regard.

The first and second sets of mass portions 120 and 130, respectively, may be similar in mass (e.g., all of the mass portions of the first and second sets 120 and 130, respectively, weigh about the same). Alternatively, the first and second sets of mass portions 120 and 130, respectively, may be different in mass individually or as an entire set. In particular, one or more mass portions of the first set of mass portions 120 (e.g., generally shown as 121, 122, 123, and 124) may have relatively less mass than one or more portions of the second set of mass portions 130 (e.g., generally shown as 131, 132, 133, 134, 135, 136, and 137). For example, the second set of mass portions 130 may account for more than 50% of the total mass from mass portions of the golf club head 100. As a result, the golf club head 100 may be configured to have at least 50% of the total mass from mass portions disposed below the horizontal midplane 1020. Two or more mass portions in the same set may be different in mass. In one example, the mass portion 121 of the first set 120 may have a relatively lower mass than the mass portion 122 of the first set 120. In another example, the mass portion 131 of the second set 130 may have a relatively lower mass than the mass portion 135 of the second set 130. Accordingly, more mass may be distributed away from the CG of the golf club head 100 to increase the MOI about the vertical axis through the CG. The apparatus, methods, and articles of manufacture described herein are not limited in this regard.

In one example, the golf club head 100 may have a mass in the range of about 220 grams to about 330 grams based on the type of golf club (e.g., a 4-iron versus a lob wedge). The body portion 110 may have a mass in the range of about 200 grams to about 310 grams with the first set of mass portions 120 and/or the second set of mass portions 130 having a mass of about 20 grams (e.g., a total mass from mass portions). One or more mass portions of the first set of mass portions 120 and/or the second set of mass portions 130 may have a mass greater than or equal to about 0.1 gram and less than or equal to about 20 grams. In one example, one or more mass portions of the first set 120 may have a mass of about 0.75 gram whereas one or more mass portions of the second set 130 may have a mass of about 2.4 grams. The sum of the mass of the first set of mass portions 120 or the sum of the mass of the second set of mass portions 130 may be greater than or equal to about 0.1 grams and less than or equal to about 20 grams. In one example, the sum of the mass of the first set of mass portions 120 may be about 3 grams whereas the sum of the mass of the first set of mass portions 130 may be about 16.8 grams. The total mass of the second set of mass portions 130 may weigh more than five times as much as the total mass of the first set of mass portions 120 (e.g., a total mass of the second set of mass portions 130 of about 16.8 grams versus a total mass of the first set of mass portions 120 of about 3 grams). The golf club head 100 may have a total mass of 19.8 grams from the first and second sets of mass portions 120 and 130, respectively (e.g., sum of 3 grams from the first set of mass portions 120 and 16.8 grams from the second set of mass portions 130). Accordingly, in one example, the first set of mass portions 120 may account for about 15% of the total mass from mass portions of the golf club head 100 whereas the second set of mass portions 130 may be account for about 85% of the total mass from mass portions of the golf club head 100. The apparatus, methods, and articles of manufacture described herein are not limited in this regard.

By coupling the first set of mass portions 120 and/or the second set of mass portions 130, respectively, to the body portion 110 (e.g., securing the first set of mass portions 120 and/or the second set of mass portions 130 in the ports on the back portion 170), the location of the CG and the MOI) of the golf club head 100 may be optimized. In particular, as described herein, the first set of mass portions 120 may lower the location of the CG towards the sole portion 190 and further back away from the face portion 162. Further, the first set of mass portions 120 and/or the second set of mass portions 130 may increase the MOI as measured about a vertical axis extending through the CG (e.g., perpendicular to the ground plane 1010). The MOI may also be higher as measured about a horizontal axis extending through the CG (e.g., extending towards the toe and heel portions 150 and 160, respectively, of the golf club head 100). As a result, the club head 100 may provide a relatively higher launch angle and a relatively lower spin rate than a golf club head without the first and/or second sets of mass portions 120 and 130, respectively. The apparatus, methods, and articles of manufacture described herein are not limited in this regard.

Although the figures may depict the mass portions as separate and individual parts that may be visible from an exterior of the golf club head 100, the two or more mass portions of the first set of mass portions 120 and/or the second set of mass portions 130 may be a single piece of mass portion that may be an exterior mass portion or an interior mass portion (i.e., not visible from an exterior of the golf club head 100). In one example, all of the mass portions of the first set 120 (e.g., generally shown as 121, 122, 123, and 124) may be combined into a single piece of mass portion (e.g., a first mass portion). In a similar manner, all of the mass portions of the second set 130 (e.g., generally shown as 131, 132, 133, 134, 135, 136, and 137) may be combined into a single piece of mass portion as well (e.g., a second mass portion). In this example, the golf club head 100 may have only two mass portions. In another example (not shown), the body portion 110 may not include the first set of mass portions 120, but include the second set of mass portions 130 in the form of a single piece of internal mass portion that may be farther from the heel portion 150 than the toe portion 140. In yet another example (not shown), the body portion 110 may not include the first set of mass portions 120, but include the second set of mass portions 130 with a first internal mass portion farther from the heel portion 150 than the toe portion 140 and a second internal mass portion farther from the toe portion 140 than the heel portion 150. The first internal mass portion and the second internal mass portion may be (i) integral parts of the body portion 110 or (ii) separate from the body portion 110 and coupled to the body portion 110. The apparatus, methods, and articles of manufacture described herein are not limited in this regard.

While the figures may depict a particular number of mass portions, the apparatus, methods, and articles of manufacture described herein may include more or less number of mass portions. In one example, the first set of mass portions 120 may include two separate mass portions instead of three separate mass portions as shown in the figures. In another example, the second set of mass portions 130 may include five separate mass portions instead of seven separate mass portions as shown in the figures. Alternatively as mentioned above, the apparatus, methods, and articles of manufacture described herein may not include any separate mass portions (e.g., the body portion 110 may be manufactured to include the mass of the separate mass portions as integral part(s) of the body portion 110). The apparatus, methods, and articles of manufacture described herein are not limited in this regard.

Referring to FIGS. 7-9, for example, the body portion 110 may be a hollow body including the interior cavity 700 extending between the front portion 160 and the back portion 170. Further, the interior cavity 700 may extend between the top portion 180 and the sole portion 190. The interior cavity 700 may be associated with a cavity height 750 ($H_C$), and the body portion 110 may be associated with a body height 850 ($H_B$). While the cavity height 750 and the body height 850 may vary between the toe and heel portions 140 and 150, the cavity height 750 may be at least 50% of a body height 850 ($H_C$>0.5*$H_B$). For example, the cavity height 750 may vary between 70%-85% of the body height 850. With the cavity height 750 of the interior cavity 700 being greater than 50% of the body height 850, the golf club head 100 may produce relatively more consistent feel, sound, and/or result when the golf club head 100 strikes a golf ball via the face portion 162 than a golf club head with a cavity height of less than 50% of the body height. The apparatus, methods, and articles of manufacture described herein are not limited in this regard.

In one example, the interior cavity 700 may be unfilled (i.e., empty space). The body portion 110 with the interior cavity 700 may weigh about 100 grams less than the body portion 110 without the interior cavity 700. Alternatively, the interior cavity 700 may be partially or entirely filled with a filler material (i.e., a cavity filling portion), which may include one or more similar or different types of materials. In one example, the filler material may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. For example, at least 50% of the interior cavity 700 may be filled with a TPE material to absorb shock, isolate vibration, and/or dampen noise when the golf club head 100 strikes a golf ball via the face portion 162. The apparatus, methods, and articles of manufacture described herein are not limited in this regard.

In another example, the filler material may be a polymer material such as an ethylene copolymer material that may absorb shock, isolate vibration, and/or dampen noise when the golf club head 100 strikes a golf ball via the face portion 162. In particular, at least 50% of the interior cavity 700 may be filled with a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Del. The DuPont™ HPF family of ethylene copolymers are injection moldable and may be used with conventional injection molding equipment and molds, provide low compression, and provide high resilience, i.e., relatively high coefficient of restitution (COR). The apparatus, methods, and articles of manufacture described herein are not limited in this regard.

For example, the filler material may have a density of less than or equal to 1.5 g/cm$^3$. The filler material may have a compression deformation value ranging from about 0.0787 inch (2 mm) to about 0.1968 inch (5 mm). The filler material may have a surface Shore D hardness ranging from 40 to 60. As mentioned above, the filler material may be associated with a relatively high coefficient of restitution (COR). The filler material may be associated with a first COR ($COR_1$) and the face portion 2462 may be associated with a second COR ($COR_2$), which may be similar or different from the first COR. The first and second CORs may be associated with a COR ratio (e.g., $COR_{12}$ ratio=$COR_1/COR_2$ or $COR_{21}$ ratio=$COR_2/COR_1$). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The golf club head 100 may be associated with a third COR ($COR_3$), which may be similar or different from the first COR and/or the second COR. As mentioned above, the filler material may be associated with the first COR. The first and third CORs may be associated with a COR ratio (e.g., $COR_{13}$ ratio=$COR_1/COR_3$ or $COR_{31}$ ratio=$COR_3/COR_1$). In one example, the COR ratio may be less than two (2). In another example, the COR ratio may be in a range from about 0.5 to about 1.5. In yet another example, the COR ratio may be in a range from about 0.8 to about 1.2. The apparatus, methods, and articles of manufacture described herein are not limited in this regard.

The CORs of the filler material, the face portion 162, and/or the golf club head 100 (e.g., the first COR ($COR_1$), the second COR ($COR_2$), and/or the third COR ($COR_3$), respectively) may be measured by methods similar to methods that measure the COR of a golf ball and/or a golf club head as defined by one or more golf standard organizations and/or governing bodies (e.g., United States Golf Association (USGA)). In one example, an air cannon device may launch or eject an approximately 1.55 inch (38.1 mm) spherical sample of the filler material at an initial velocity toward a steel plate positioned at about 4 feet (1.2 meters) away from the air cannon device. The sample may vary in size, shape or any other configuration. A speed monitoring device may be located at a distance in a range from 2 feet (0.6 meters) to 3 feet (0.9 meters) from the air cannon device. The speed monitoring device may measure a rebound velocity of the sample of the filler material after the sample of the filler material strikes the steel plate. The COR may be the rebound velocity divided by the initial velocity. In one example, the filler material may have a COR value in a range from approximately 0.50 to approximately 0.95 when measured with an initial velocity in a range from 100 ft/s (30.48 m/s) to 250 ft/s (76.2 m/s). In another example, the filler material may have a COR value in a range from approximately 0.65 to approximately 0.85 when measured with an initial velocity in a range from 100 ft/s (30.48 m/s) to 150 ft/s (45.72 m/s). In another example, the filler material may have a COR value in a range from approximately 0.75 to approximately 0.8 when measured with an initial velocity in a range 100 ft/s (30.48 m/s) to 150 ft/s (45.72 m/s). In another example, the filler material may have a COR value in a range from approximately 0.55 to approximately 0.90 when measured with an initial velocity in a range from 100 ft/s (30.48 m/s) and 250 ft/s (76.2 m/s). In another example, the filler material may have a COR value in a range from approximately 0.75 to approximately 0.85 when measured with an initial velocity in a range 110 ft/s (33.53 m/s) to 200 ft/s (60.96 m/s). In yet another example, the filler material may have a COR value in a range from approximately 0.8 to approximately 0.9 when measured with an initial velocity of about 125 ft/s (38.1 m/s). While a particular example may be described above, other methods may be used to measure the CORs of the filler material, the face portion 162, and/or the golf club head 100. The apparatus, methods, and articles of manufacture described herein are not limited in this regard.

When the face portion 162 of the golf club head 100 strikes a golf ball, the face portion 162 and the filler material may deform and/or compress. The kinetic energy of the impact may be transferred to the face portion 162 and/or the filler material. For example, some of the kinetic energy may be transformed into heat by the filler material or work done in deforming and/or compressing the filler material. Further, some of the kinetic energy may be transferred back to the golf ball to launch the golf ball at a certain velocity. A filler material with a relatively higher COR may transfer relatively more kinetic energy to the golf ball and dissipate relatively less kinetic energy. Accordingly, a filler material with a relatively high COR may generate relatively higher golf ball speeds because a relatively greater part of the kinetic energy of the impact may be transferred back to the golf ball to launch the golf ball from the golf club head 100.

The filler material may include a bonding portion. In one example, the bonding portion may be one or more bonding agents (e.g., one or more adhesive or epoxy materials). For example, the bonding agent may assist in bonding or adhering the filler material to at least the back surface 166 of the face portion 162. The bonding agent may also absorb shock, isolate vibration, and/or dampen noise when the golf club head 100 strikes a golf ball via the face portion 162. Further, the bonding agent may be an epoxy material that may be flexible or slightly flexible when cured. In one example, the filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minn. In another example, the filler material may include 3M™ Scotch-Weld™ DP100 Plus Clear adhesive. In yet another example, the filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Mich. In yet another example, the filler material may be LOCTITE® materials manufactured by Henkel Corporation, Rocky Hill, Conn. The apparatus, methods, and articles of manufacture described herein are not limited in this regard.

Further, the filler material may include a combination of one or more bonding agents such as any of the bonding agents described herein and one or more polymer materials such as any of the polymer materials described herein. In one example, the filler material may include one or more bonding agents that may be used to bond the polymer material to the back surface 166 of the face portion 162. The one or more bonding agents may be applied to the back surface 166 of the face portion 162. The filler material may further include one or more polymer materials may partially or entirely fill the remaining portions of the interior cavity 700. Accordingly, two or more separate materials may partially or entirely fill the interior cavity 700. The apparatus, methods, and articles of manufacture described herein are not limited in this regard.

The filler material may only include one or more polymer materials that adhere to inner surface(s) of the interior cavity 700 without a separate bonding agent (e.g., an adhesive or epoxy material). For example, the filler material may include a mixture of one or more polymer materials and one or more bonding agents (e.g., adhesive or epoxy material(s)). Accordingly, the mixture including the one or more polymer materials and the one or more bonding agents may partially or entirely fill the interior cavity 700 and adhere to inner surface(s) of the interior cavity 700. In another example, the interior cavity 700 may be partially or entirely filled with one or more polymer materials without any bonding agents. In yet another example, the interior cavity 700 may be partially or entirely filled with one or more bonding agents and/or adhesive materials such as an adhesive or epoxy material. The apparatus, methods, and articles of manufacture described herein are not limited in this regard.

Figure 15:
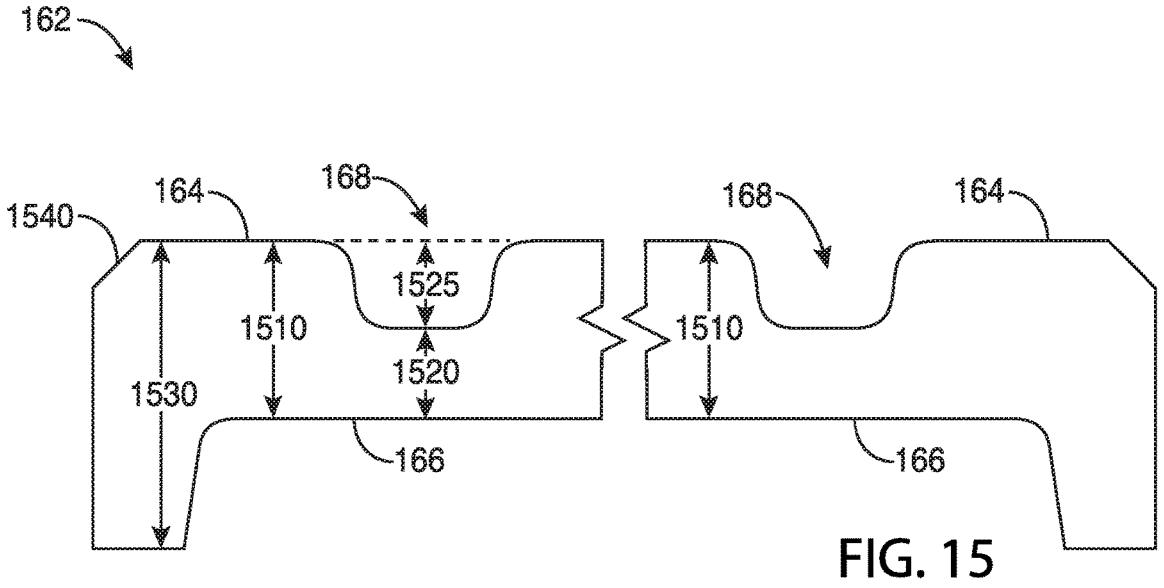
FIG. 15 depicts a cross-sectional view of a face portion of the example golf club head of FIG. 1.

Turning to FIG. 15, for example, a thickness of the face portion 162 may be a first thickness 1510 ($T_1$) or a second thickness 1520 ($T_2$). The first thickness 1510 may be a thickness of a section of the face portion 162 adjacent to a groove 168 whereas the second thickness 1520 may be a thickness of a section of the face portion 162 below the groove 168. For example, the first thickness 1510 may be a maximum distance between the front surface 164 and the back surface 166. The second thickness 1520 may be based on the groove 168. In particular, the groove 168 may have a groove depth 1525 ($D_{groove}$). The second thickness 1520 may be a maximum distance between the bottom of the groove 168 and the back surface 166. The sum of the second thickness 1520 and the groove depth 1525 may be substantially equal to the first thickness 1510 (e.g., $T_2+D_{groove}=T_1$). Accordingly, the second thickness 1520 may be less than the first thickness 1510 (e.g., $T_2<T_1$).

To lower and/or move the CG of the golf club head 100 further back, mass from the front portion 160 of the golf club head 100 may be removed by using a relatively thinner face portion 162. For example, the first thickness 1510 or the second thickness 1520 may be less than or equal to 0.1 inch (2.54 millimeters). In another example, the first thickness 1510 may be about 0.075 inch (1.905 millimeters) (e.g., $T_1$=0.075 inch). With the support of the back wall portion 1410 to form the interior cavity 700 and filling at least a portion of the interior cavity 700 with an elastic polymer material, the face portion 162 may be relatively thinner (e.g., $T_1$<0.075 inch) without degrading the structural integrity, sound, and/or feel of the golf club head 100. In one example, the first thickness 1510 may be less than or equal to 0.060 inch (1.524 millimeters) (e.g., T1≤0.060 inch). In another example, the first thickness 1510 may be less than or equal to 0.040 inch (1.016 millimeters) (e.g., $T_1$≤0.040 inch). Based on the type of material(s) used to form the face portion 162 and/or the body portion 110, the face portion 162 may be even thinner with the first thickness 1510 being less than or equal to 0.030 inch (0.762 millimeters) (e.g., $T_1$≤0.030 inch). The groove depth 1525 may be greater than or equal to the second thickness 1520 (e.g., $D_{groove}\geq T_2$). In one example, the groove depth 1525 may be about 0.020 inch (0.508 millimeters) (e.g., $D_{groove}$=0.020 inch). Accordingly, the second thickness 1520 may be about 0.010 inch (0.254 millimeters) (e.g., $T_2$=0.010 inch). In another example, the groove depth 1525 may be about 0.015 inch (0.381 millimeters), and the second thickness 1520 may be about 0.015 inch (e.g., $D_{groove}=T_2$=0.015 inch). Alternatively, the groove depth 1525 may be less than the second thickness 1520 (e.g., $D_{groove}<T_2$). Without the support of the back wall portion 1410 and the elastic polymer material to fill in the interior cavity 700, a golf club head may not be able to withstand multiple impacts by a golf ball on a face portion. In contrast to the golf club head 100 as described herein, a golf club head with a relatively thin face portion but without the support of the back wall portion 1410 and the elastic polymer material to fill in the interior cavity 700 (e.g., a cavity-back golf club head) may produce unpleasant sound (e.g., a tinny sound) and/or feel during impact with a golf ball. The apparatus, methods, and articles of manufacture described herein are not limited in this regard.

Based on manufacturing processes and methods used to form the golf club head 100, the face portion 162 may include additional material at or proximate to a periphery of the face portion 162. Accordingly, the face portion 162 may also include a third thickness 1530, and a chamfer portion 1540. The third thickness 1530 may be greater than either the first thickness 1510 or the second thickness 1520 (e.g., $T_3>T_1>T_2$). In particular, the face portion 162 may be coupled to the body portion 110 by a welding process. For example, the first thickness 1510 may be about 0.030 inch (0.762 millimeters), the second thickness 1520 may be about 0.015 inch (0.381 millimeters), and the third thickness 1530 may be about 0.050 inch (1.27 millimeters). Accordingly, the chamfer portion 1540 may accommodate some of the additional material when the face portion 162 is welded to the body portion 110.

Figure 16:
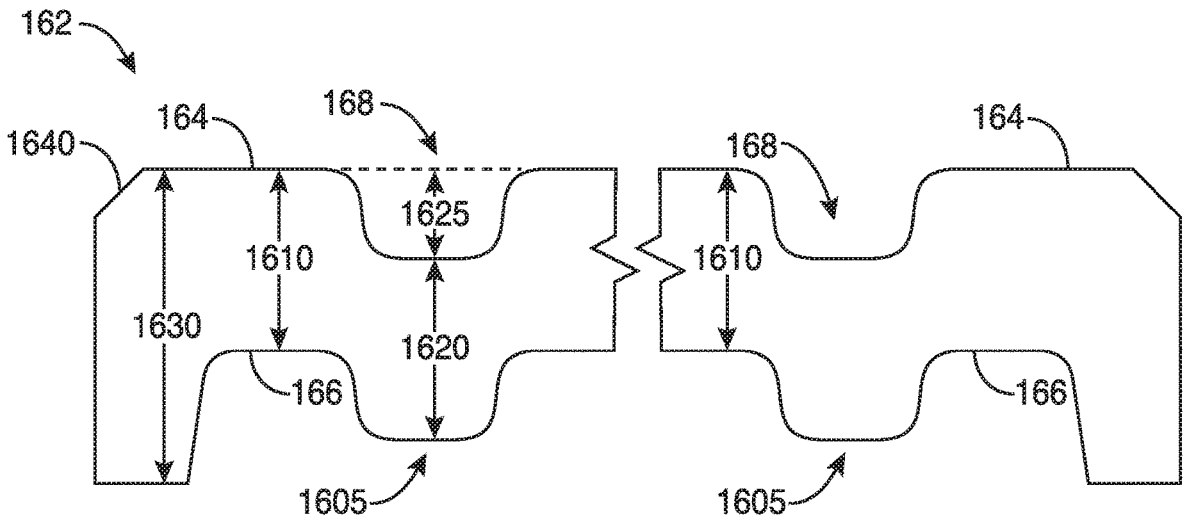
FIG. 16 depicts a cross-sectional view of another face portion of the example golf club head of FIG. 1.

As illustrated in FIG. 16, for example, the face portion 162 may include a reinforcement section, generally shown as 1605, below one or more grooves 168. In one example, the face portion 162 may include a reinforcement section 1605 below each groove. Alternatively, face portion 162 may include the reinforcement section 1605 below some grooves (e.g., every other groove) or below only one groove. The face portion 162 may include a first thickness 1610, a second thickness 1620, a third thickness 1630, and a chamfer portion 1640. The groove 168 may have a groove depth 1625. The reinforcement section 1605 may define the second thickness 1620. The first and second thicknesses 1610 and 1620, respectively, may be substantially equal to each other (e.g., $T_1=T_2$). In one example, the first and second thicknesses 1610 and 1620, respectively, may be about 0.030 inch (0.762 millimeters) (e.g., $T_1=T_2$=0.030 inch). The groove depth 1625 may be about 0.015 inch (0.381 millimeters), and the third thickness 1630 may be about 0.050 inch (1.27 millimeters). The groove 168 may also have a groove width. The width of the reinforcement section 1605 may be greater than or equal to the groove width. The apparatus, methods, and articles of manufacture described herein are not limited in this regard.

Alternatively, the face portion 162 may vary in thickness at and/or between the top portion 180 and the sole portion 190. In one example, the face portion 162 may be relatively thicker at or proximate to the top portion 180 than at or proximate to the sole portion 190 (e.g., thickness of the face portion 162 may taper from the top portion 180 towards the sole portion 190). In another example, the face portion 162 may be relatively thicker at or proximate to the sole portion 190 than at or proximate to the top portion 180 (e.g., thickness of the face portion 162 may taper from the sole portion 190 towards the top portion 180). In yet another example, the face portion 162 may be relatively thicker between the top portion 180 and the sole portion 190 than at or proximate to the top portion 180 and the sole portion 190 (e.g., thickness of the face portion 162 may have a bell-shaped contour). The apparatus, methods, and articles of manufacture described herein are not limited in this regard. As described herein, the interior cavity 700 may be partially or fully filled with a filler material, which may be a polymer material, a bonding agent (such as an adhesive or epoxy material), or a combination of polymer material(s) and bonding agent(s) to at least partially provide structural support for the face portion 162. In particular, the filler material may also provide vibration and/or noise dampening for the body portion 110 when the face portion 162 strikes a golf ball. Alternatively, the filler material may only provide vibration and/or noise dampening for the body portion 110 when the face portion 162 strikes a golf ball. In one example, the body portion 110 of the golf club head 100 (e.g., an iron-type golf club head) may have a body portion volume ($V_b$) between about 2.0 cubic inches (32.77 cubic centimeters) and about 4.2 cubic inches (68.83 cubic centimeters). The volume of the filler material filling the interior cavity ($V_e$), such as the interior cavity 700, may be between 0.5 and 1.7 cubic inches (8.19 and 27.86 cubic centimeters, respectively). A ratio of the filler material volume ($V_e$) to the body portion volume ($V_b$) may be expressed as:

$$0.2 \le \frac{V_e}{V_b} \le 0.5$$

Where: $V_e$ is the filler material volume in units of $in^3$, and
$V_b$ is the body portion volume in units of $in^3$.

In another example, the ratio of the filler material volume ($V_e$) to the body portion volume ($V_b$) may be between about 0.2 and about 0.4. In yet another example, the ratio of the filler material volume ($V_e$) to the body portion volume ($V_b$) may be between about 0.25 and about 0.35. The apparatus, methods, and articles of manufacture described herein are not limited in this regard.

Based on the amount of filler material filling the interior cavity, for example, the thickness of the face portion may be between about 0.025 inches (0.635 millimeters) and about 0.1 inch (2.54 millimeters). In another example, the thickness of the face portion ($T_f$) may be between about 0.02 inches (0.508 millimeters) and about 0.09 inches (2.286 millimeters). The thickness of the face portion ($T_f$) may depend on the volume of the filler material in the interior cavity ($V_e$), such as the interior cavity 700. The ratio of the thickness of the face portion ($T_f$) to the volume of the filler material ($V_e$) may be expressed as:

$$0.01 \le \frac{T_f}{V_e} \le 0.2$$

Where: $T_f$ is the thickness of the face portion in units of inches, and
$V_e$ is the filler material volume in units of $in^3$.

In one example, the ratio of the thickness of the face portion ($T_f$) to the volume of the filler material ($V_e$) may be between 0.02 and 0.09. In another example, the ratio of the thickness of the face portion ($T_f$) to the volume of the filler material ($V_e$) may be between 0.04 and 0.14. The thickness of the face portion ($T_f$) may be the same as $T_1$ and/or $T_2$ mentioned above. The apparatus, methods, and articles of manufacture described herein are not limited in this regard.

The thickness of the face portion ($T_f$) may depend on the volume of the filler material in the interior cavity ($V_e$), such as the interior cavity 700, and the body portion volume ($V_b$). The volume of the filler material ($V_e$) may be expressed as:

$$V_e = a*V_b + b \pm c*T_f$$

$$a \cong 0.48$$

$$b \cong -0.38$$

$$0 \le c \le 10$$

Where: $V_e$ is the filler material volume in units of $in^3$,
$V_b$ is the body portion volume in units of $in^3$, and
$T_f$ is the thickness of the face portion in units of inches.

As described herein, for example, the body portion volume ($V_b$) may be between about 2.0 cubic inches (32.77 cubic centimeters) and about 4.2 cubic inches (68.83 cubic centimeters). In one example, the thickness of the face portion ($T_f$) may be about 0.03 inches (0.762 millimeters). In another example, the thickness of the face portion ($T_f$) may be about 0.06 inches (1.524 millimeters). In yet another example, the thickness of the face portion ($T_f$) may be about 0.075 inches (1.905 millimeters). The apparatus, methods, and articles of manufacture described herein are not limited in this regard.

Further, the volume of the filler material ($V_e$) when the interior cavity is fully filled with the filler material may be similar to the volume of the interior cavity ($V_c$). Accordingly, when the interior cavity is fully filled with a filler material, the volume of the filler material ($V_e$) in any of the equations provided herein may be replaced with the volume of the interior cavity ($V_c$). Accordingly, the above equations expressed in terms of the volume of the interior cavity ($V_c$) may be expressed as:

$$0.2 \le \frac{Vc}{Vb} \le 0.5$$

$$0.01 \le \frac{Tf}{Vc} \le 0.2$$

$$Vc = a.Vb + b \pm a.Tf$$

$$a \cong 0.48$$

$$b \cong -0.38$$

$$0 \le c \le 10$$

Where: $V_c$ is the volume of the interior cavity in units of $in^3$,
$V_b$ is the body portion volume in units of $in^3$, and
$T_f$ is the thickness of the face portion in units of inches.

As described herein, the filler material may include a bonding agent that may be bonded to the back surface 166 of the face portion 162 to attach the remaining portions of the filler material to the back surface 166 of the face portion 162, dampen noise and vibration, provide a certain feel and sound for the golf club head, and/or at least partially structurally support the face portion 162. The thickness of the bonding agent and/or a portion of the filler material may depend on a thickness of the face portion 162. In one example, a relationship between a thickness of the face portion 162 and a thickness of a bonding agent and/or a portion of the filler material may be expressed as:

$$0.1 \leq \frac{T_f}{T_a} \leq 4.0$$

Where:

$T_f$ is the thickness of the face portion in units of inches, and $T_a$ is the thickness of the bonding agent and/or the thickness of the filler material in units of inches.

In one example, the bonding agent and/or the filler material may have a thickness ranging from 0.02 inch (0.51 millimeters) to 0.2 inch (5.08 millimeters). In another example, the bonding agent and/or the filler material may be have a thickness ranging from 0.04 inch (0.1.02 millimeters) to 0.08 inch (2.03 millimeters). In another example, the bonding agent and/or the filler material may be have a thickness ranging from 0.03 inch (0.76 millimeters) to 0.06 inch (1.52 millimeters). In yet another example, the bonding agent and/or the filler material may have a thickness ranging from 0.01 inch (0.25 millimeters) to 0.3 inch (7.62 millimeters). The apparatus, methods, and articles of manufacture described herein are not limited in this regard.

Figure 17:
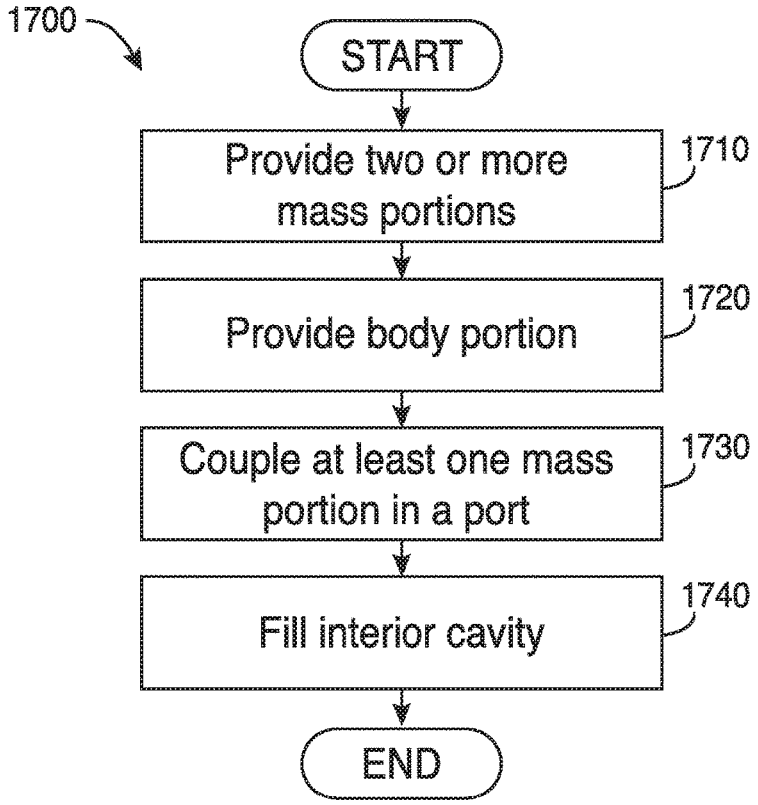
FIG. 17 depicts one manner in which the example golf club head described herein may be manufactured.

FIG. 17 depicts one manner in which the example golf club head described herein may be manufactured. In the example of FIG. 17, the process 1700 may begin with providing one or more mass portions, generally shown as the first and second sets of mass portions 120 and 130, respectively (block 1710). The first set of mass portions 120 and/or the second set of mass portions 130 may be made of a first material such as a tungsten-based material, a titanium-based material, a steel-based material, an aluminum-based material, a non-metal material, any combination thereof, or other suitable type of materials. In one example, the mass portions of the first and second sets 120 and 130, respectively, may be tungsten-alloy screws.

The process 1700 may provide a body portion 110 having the face portion 162, the interior cavity 700, and the back portion 170 with two or more ports, generally shown as 1420 and 1430 (block 1720). The body portion 110 may be made of a second material, which may be different than the first material or similar to the first material. The body portion 110 may be manufactured using an investment casting process, a billet forging process, a stamping process, a computer numerically controlled (CNC) machining process, a die casting process, any combination thereof, or other suitable manufacturing processes. In one example, the body portion 110 may be made of 17-4 PH stainless steel using a casting process. In another example, the body portion 110 may be made of other suitable type of stainless steel (e.g., Nitronic® 50 stainless steel manufactured by AK Steel Corporation, West Chester, Ohio) using a forging process. By using Nitronic® 50 stainless steel to manufacture the body portion 110, the golf club head 100 may be relatively stronger and/or more resistant to corrosion than golf club heads made from other types of steel. One or more ports of the body portion 110 may include an opening and a port wall. For example, the port 1421 may include the opening 720 and the port wall 725 with the opening 720 and the port wall 725 being on opposite ends of each other. The interior cavity 700 may separate the port wall 725 of the port 1421 and the back surface 166 of the face portion 162. In a similar manner, the port 1435 may include the opening 730 and the port wall 735 with the opening 730 and the port wall 735 being on opposite ends of each other. The interior cavity 700 may separate the port wall 735 of the port 1435 and the back surface 166 of the face portion 162.

The process 1700 may couple one or more mass portions of the first and second sets of mass portions 120 and 130 into one of the one or more ports (blocks 1730). In one example, the process 1700 may insert and secure the mass portion 121 in the port 1421, and the mass portion 135 in the port 1435. The process 1700 may use various manufacturing methods and/or processes to secure the first set of mass portions 120 and/or the second set of mass portions 130 in the ports such as the ports 1421 and 1435 (e.g., epoxy, welding, brazing, mechanical lock(s), any combination thereof, etc.).

Figure 18:
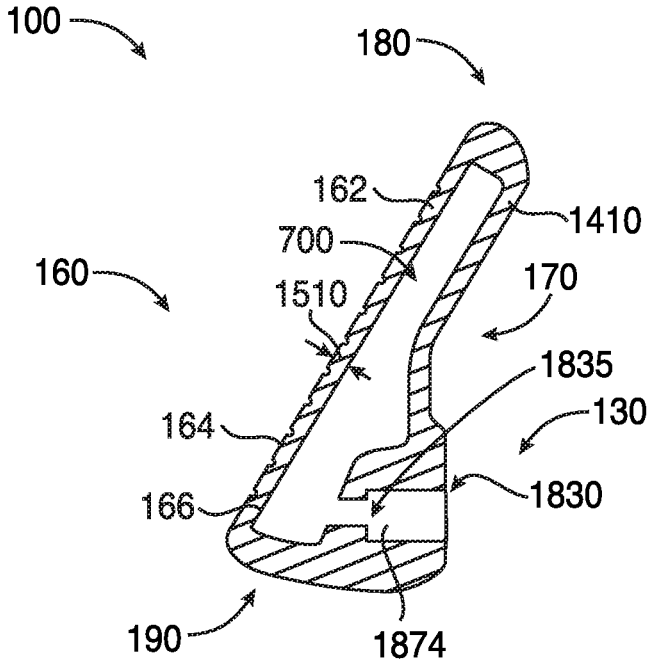
FIG. 18 depicts another cross-sectional view of the example golf club head of FIG. 4 along line 18-18.

The process 1700 may partially or entirely fill the interior cavity 700 with a filler material, which may be one or a combination of a polymer material (e.g., an ethylene copolymer material such as DuPont™ HPF family of materials) (block 1740) and/or a bonding agent (e.g., an adhesive or epoxy material such as 3M™ Scotch-Weld™ Epoxy Adhesives DP100, DP100 Plus, DP100NS and DP100FR). In one example, the filler material may fill at least 50% of the interior cavity 700. As mentioned above, the filler material may absorb shock, isolate vibration, and/or dampen noise in response to the golf club head 100 striking a golf ball. In one example, the interior cavity 700 may be filled with filler material, which may be a polymer material, a thermoplastic elastomer material, a thermoplastic polyurethane material, a bonding agent, and/or a combination thereof. In another example, the interior cavity 700 may be entirely filled with a bonding agent. As illustrated in FIG. 18, for example, the golf club head 100 may include one or more ports (e.g., one shown as 1431 in FIG. 14) with a first opening 1830 and a second opening 1835. The second opening 1835 may be used to access the interior cavity 700. In one example, the process 1700 (FIG. 17) may fill the interior cavity 700 with a filler material by injecting the filler material into the interior cavity 700 from the first opening 1830 via the second opening 1835. The first and second openings 1830 and 1835, respectively, may be same or different in size and/or shape. While the above example may describe and depict a particular port with a second opening, any other ports of the golf club head 100 may include a second opening (e.g., the port 1421). The apparatus, methods, and articles of manufacture described herein are not limited in this regard.

Referring back to FIG. 17, the example process 1700 is merely provided and described in conjunction with other figures as an example of one way to manufacture the golf club head 100. While a particular order of actions is illustrated in FIG. 17, these actions may be performed in other temporal sequences. For example, two or more actions depicted in FIG. 17 may be performed sequentially, concurrently, or simultaneously. In one example, blocks 1710, 1720, 1730, and/or 1740 may be performed simultaneously or concurrently. Although FIG. 17 depicts a particular number of blocks, the process may not perform one or more blocks. In one example, the interior cavity 700 may not be filled (i.e., block 1740 may not be performed). The apparatus, methods, and articles of manufacture described herein are not limited in this regard. Referring back to FIGS. 1-14, the face portion 162 may include a non-smooth back surface to improve adhesion and/or mitigate delamination between the face portion 162 and the elastic polymer material used to fill the interior cavity 700 (e.g., FIG. 7). Various methods and/or processes such as an abrasive blasting process (e.g., a bead blasting process, a sand blasting process, other suitable blasting process, or any combination thereof) and/or a milling (machining) process may be used to form the back surface 166 into a non-smooth surface. For example, the back surface 166 may have with a surface roughness (Ra) ranging from 0.5 to 250 pin (0.012 to 6.3 μm). The apparatus, methods, and articles of manufacture are not limited in this regard.

Figure 19:
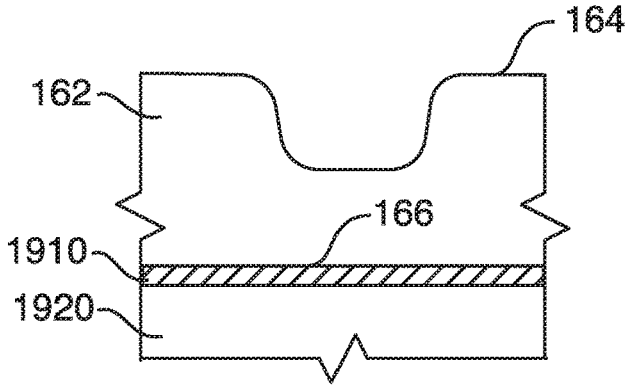
FIG. 19 depicts a cross-sectional view of the example golf club head of FIG. 1.

Referring to FIG. 19, for example, the golf club head 100 may include the face portion 162, a bonding portion 1910, and a polymer material 1920. The bonding portion 1910 may provide connection, attachment and/or bonding of the polymer material 1920 to the face portion 162. In one example, the bonding portion 1910 and/or the polymer material 1920 may define a filler material as described herein. The bonding portion 1910 may be a bonding agent such as any of adhesive or epoxy materials described herein, a tacky material, a combination of bonding agents, a bonding structure or attachment device (i.e., a physical and/or mechanical structure or device), a combination of bonding structures and/or attachment devices, and/or a combination of one or more bonding agents, one or more bonding structures and/or one or more attachment devices. The bonding portion 1910 may be integral with the polymer material 1920 to partially or entirely fill the interior cavity 700. In other words, the polymer material 1920 may include inherent bonding properties. For example, the bonding portion 1910 may be a bonding agent mixed with the polymer material 1910 to provide bonding of the mixture to the back surface 166 of the face portion 162 and/or other inner surface(s) of the body portion 110. In one example, the bonding portion may include one or more surface textures or surface structures on the back surface 166 of the face portion 162 to assist in adhesion of the polymer material to the back surface 166 of the face portion. The apparatus, methods, and articles of manufacture are not limited in this regard.

For example, the golf club head 100 may include a bonding agent such as any adhesive or epoxy materials described herein to improve adhesion and/or mitigate delamination between the face portion 162 and the polymer material 1920 used to fill the interior cavity 700 of the golf club head 100 (e.g., FIG. 7). The bonding portion 1910 may be applied to the back surface 166 of the face portion 162 to bond the polymer material 1920 to the face portion 162 (e.g., extending between the back surface 166 and the polymer material 1920). For example, the bonding portion 1910 may be applied before or during when the interior cavity 700 is filled with the polymer material 1920 via an injection molding process or other suitable process. The apparatus, methods, and articles of manufacture are not limited in this regard.

Figure 20:
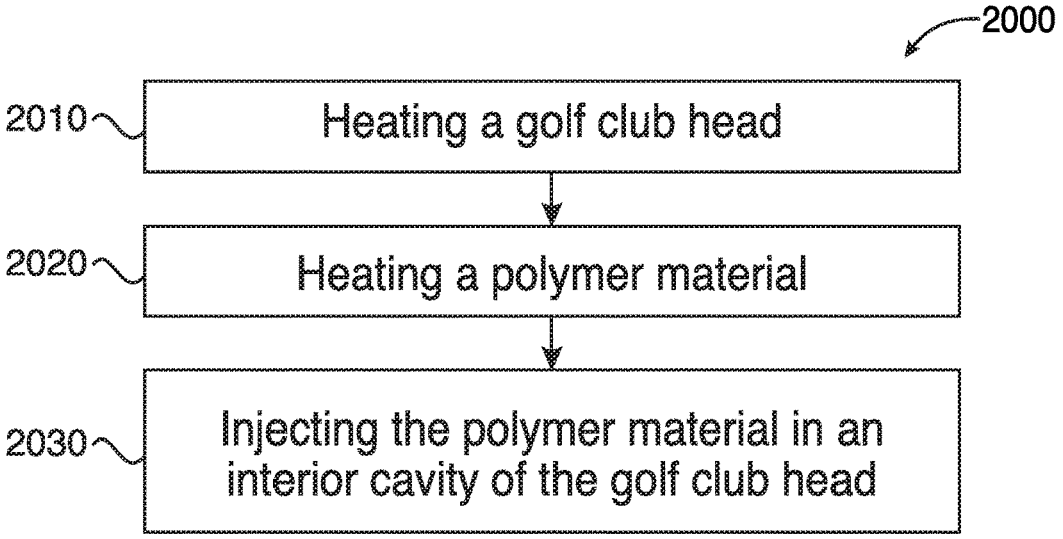
FIG. 20 depicts another manner in which an example golf club head described herein may be manufactured.

FIG. 20 depicts one manner to partially or entirely fill the interior cavity 700 of the golf club head 100 or any of the golf club heads described herein with a filler material. The process 2000 may begin with heating the golf club head 100 to a certain temperature (block 2010). In one example, the golf club head 100 may be heated to a temperature ranging between 150° C. and 250° C., which may depend on factors such as the vaporization temperature of the one or more components of the filler material to be injected in the interior cavity 700. The filler material may then be heated to a certain temperature (block 2020). In one example, the filler material may be a non-foaming and injection-moldable thermoplastic elastomer (TPE) material. Accordingly, the filler material may be heated to reach a liquid or a flowing state prior to being injected into the interior cavity 700. The temperature at which the filler material may be heated may depend on the type of polymer material used to form the filler material. The heated filler material may be injected into the interior cavity 700 to partially or fully fill the interior cavity 700 (block 2030). The filler material may be injected into the interior cavity 700 from one or more of the ports described herein (e.g., one or more ports of the first and second sets of ports 1420 and 1430, respectively, shown in FIG. 14). One or more other ports may allow the air inside the interior cavity 700 displaced by the filler material to vent from the interior cavity 700. In one example, the golf club head 100 may be oriented horizontally as shown in FIG. 14 during the injection molding process. The filler material may be injected into the interior cavity 700 from ports 1431 and 1432. The ports 1421, 1422 and/or 1423 may serve as air ports for venting the displaced air from the interior cavity 700. Thus, regardless of the orientation of the golf club head 100 during the injection molding process, the filler material may be injected into the interior cavity 700 from one or more lower positioned ports while one or more upper positioned ports may serve as air vents. The mold (e.g., the golf club head 100) may then be cooled passively (e.g., at room temperature) or actively so that the filler material reaches a solid state and adheres to the back surface 166 of the face portion 162. The filler material may directly adhere to the back surface 166 of the face portion 162. Alternatively, the filler material may adhere to the back surface 166 of the face portion 162 with the aid of the one or more structures on the back surface 166 and/or the bonding portion 1910 shown in FIG. 19 (e.g., a bonding agent as described herein). The apparatus, methods, and articles of manufacture described herein are not limited in this regard.

As described above, the filler material may be heated to a liquid state (i.e., non-foaming) and solidifies after being injection molded in the interior cavity 700. A filler material with a low modulus of elasticity may provide vibration and/or noise dampening for the face portion 162 when the face portion 162 impacts a golf ball. For example, a polymer material that foams when heated may provide vibration and/or noise dampening. However, such a foaming polymer material may not have sufficient rigidity to provide structural support to a relatively thin face portion because of possible excessive deflection and/or compression of the polymer material when absorbing the impact of a golf ball. In one example, the one or more components of the filler material that is injection molded in the interior cavity 700 may have a relatively high modulus of elasticity to provide structural support to the face portion 162 and yet elastically deflect to absorb the impact forces experienced by the face portion 162 when striking a golf ball. Thus, a non-foaming and injection moldable polymer material with a relatively high modulus of elasticity may be used for partially or entirely filling the interior cavity 700 to provide structural support and reinforcement for the face portion 162 in addition to providing vibration and noise dampening. That is, the non-foaming and injection moldable polymer material may be a structural support portion for the face portion 162. The apparatus, methods, and articles of manufacture are not limited in this regard.

As described herein, the filler material may include a bonding portion. The bonding portion may include an adhesive or epoxy material with a thickness to provide structural support for the face portion 162. Accordingly, the filler material may include a foaming polymer material to provide vibration and noise dampening whereas the bonding portion may provide structural support for the face portion 162. The thickness of the bonding portion may depend on a thickness and physical properties of the face portion 162 as described herein. The apparatus, methods, and articles of manufacture are not limited in this regard.

Figure 21:
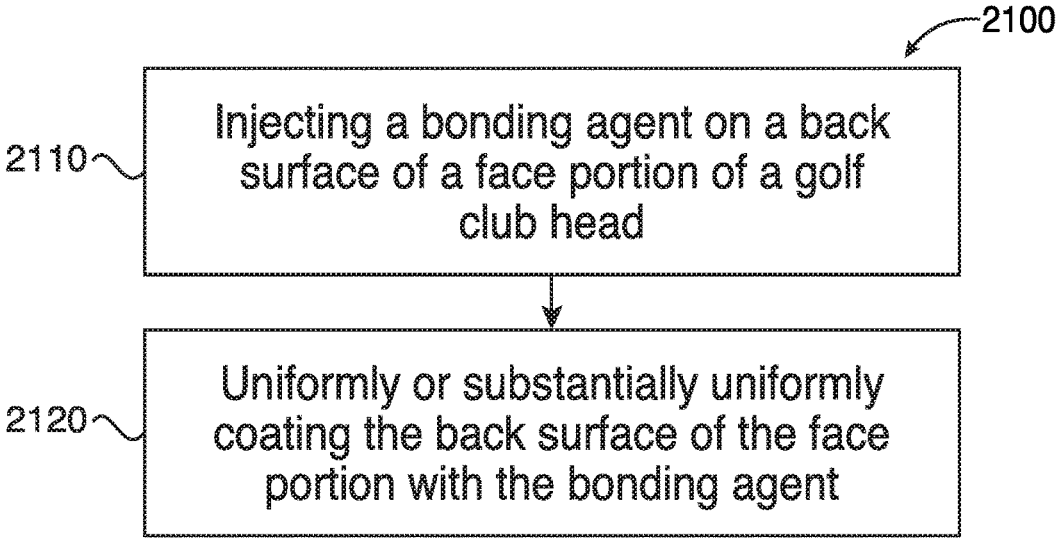
FIG. 21 depicts yet another manner in which an example golf club head described herein may be manufactured.

As described herein, the filler material may include a bonding agent (e.g., an adhesive or epoxy material) and a polymer material. FIG. 21 depicts one manner in which a bonding agent as described herein may be applied to a golf club head prior to partially or entirely filling the interior cavity 700. In the example of FIG. 21, the process 2100 may begin with injecting a bonding agent on the back surface 166 of the face portion 162 (block 2110). The bonding agent may be injected on the back surface 166 prior to or after heating the golf club head as described above depending on the properties of the bonding agent. The bonding agent may be injected through one or more of the first set of ports 1420 and/or the second set of ports 1430. The bonding agent may be injected on the back surface 166 through several or all of the first set of ports 1420 and the second set of ports 1430. For example, an injection instrument such as a nozzle or a needle may be inserted into each port until the tip or outlet of the instrument is near the back surface 166. The bonding agent may then be injected on the back surface 166 from the outlet of the instrument. Additionally, the instrument may be moved, rotated and/or swiveled while inside the interior cavity 700 so that the bonding agent is injected onto an area of the back surface 166 surrounding the instrument. For example, the outlet of the injection instrument may be moved in a circular pattern while inside a port to inject the bonding agent in a corresponding circular pattern on the back surface 166. Each of the first set of ports 1420 and the second set of ports 1430 may be utilized to inject a bonding agent on the back surface 166. However, utilizing all of first ports 1420 and/or the second set of ports 1430 may not be necessary. For example, using every other adjacent port may be sufficient to inject a bonding agent on the entire back surface 166. In another example, ports 1421, 1422 1431, 1433 and 1436 may be used to inject the bonding agent on the back surface 166. The apparatus, methods, and articles of manufacture are not limited in this regard.

The process 2100 may also include spreading the bonding agent on the back surface 166 (block 2120) after injection of the bonding agent onto the back surface 166 so that a generally uniform coating of the bonding agent is provided on the back surface 166. According to one example, the bonding agent may be spread on the back surface 166 by injecting air into the interior cavity 700 through one or more of the first set of ports 1420 and the second set of ports 1430. The air may be injected into the interior cavity 700 and on the back surface 166 by inserting an air nozzle into one or more of the first set of ports 1420 and the second set of ports 1430. According to one example, the air nozzle may be moved, rotated and/or swiveled at a certain distance from the back surface 166 so as to uniformly blow air onto the bonding agent to spread the bonding agent on the back surface 166 for a uniform coating or a substantially uniform coating of the bonding agent on the back surface 166. The apparatus, methods, and articles of manufacture are not limited in this regard.

The example process 2100 is merely provided and described in conjunction with other figures as an example of one way to manufacture the golf club head 100. While a particular order of actions is illustrated in FIG. 21, these actions may be performed in other temporal sequences. Further, two or more actions depicted in FIG. 21 may be performed sequentially, concurrently, or simultaneously. The process 2100 may include a single action of injecting and uniformly or substantially uniformly coating the back surface 166 with the bonding agent. In one example, the bonding agent may be injected on the back surface 166 by being converted into fine particles or droplets (i.e., atomized) and sprayed on the back surface 166. Accordingly, the back surface 166 may be uniformly or substantially uniformly coated with the bonding agent in one action (i.e., a substantially uniform coating of bonding agent particles, droplets or beads). A substantially uniform coating of the back surface 166 with the bonding agent may be defined as a coating having slight non-uniformities due to the injection process or the manufacturing process. However, such slight non-uniformities may not affect the bonding of the polymer material to the back surface 166 with the bonding agent as described herein. For example, spraying the bonding agent on the back surface 166 may result in overlapping regions of the bonding agent having a slightly greater coating thickness than other regions of the bonding agent on the back surface 166. The apparatus, methods, and articles of manufacture are not limited in this regard.

Figure 22:
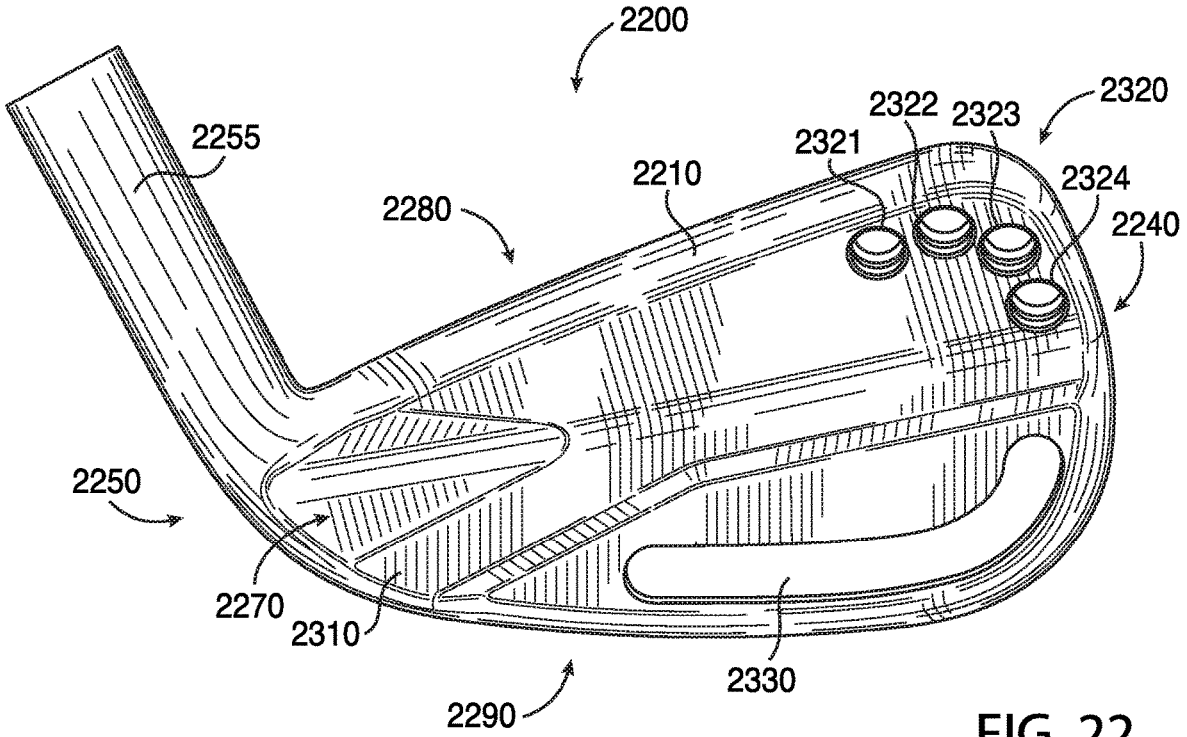
FIG. 22 depicts a front view of a golf club head according to an embodiment of the apparatus, methods, and articles of manufacture described herein.
Figure 23:
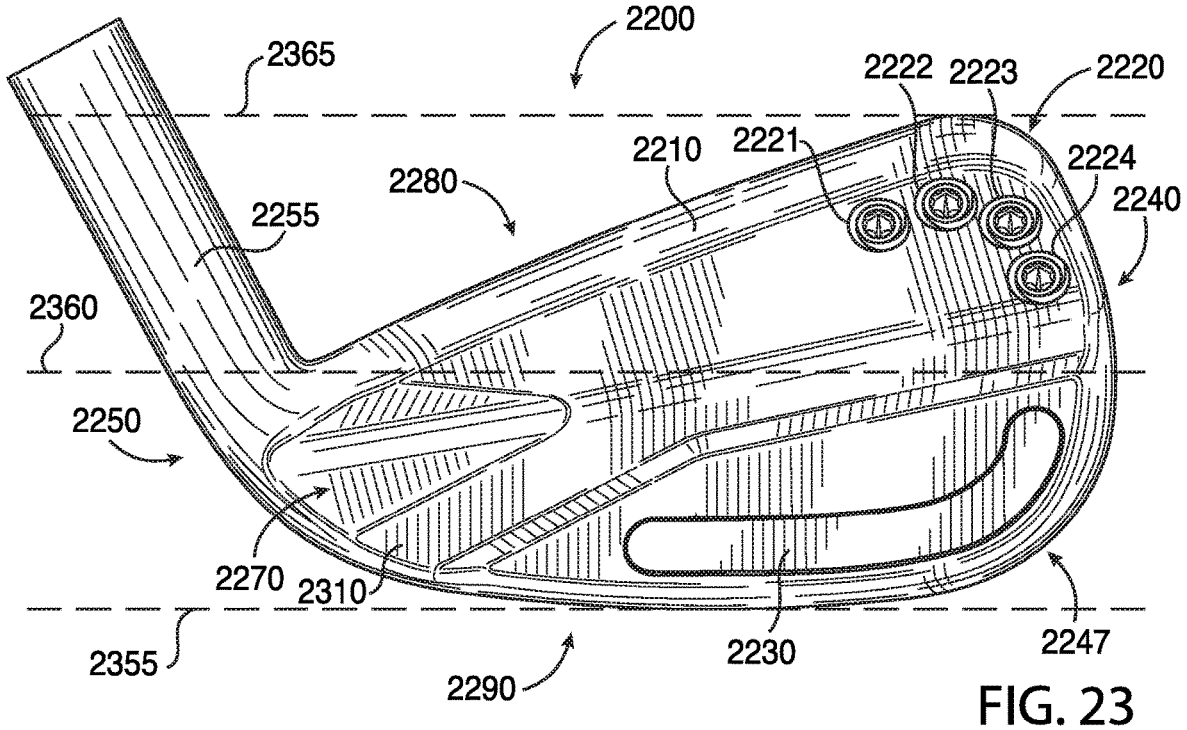
FIG. 23 depicts a rear view of the example golf club head of FIG. 22.
Figure 24:
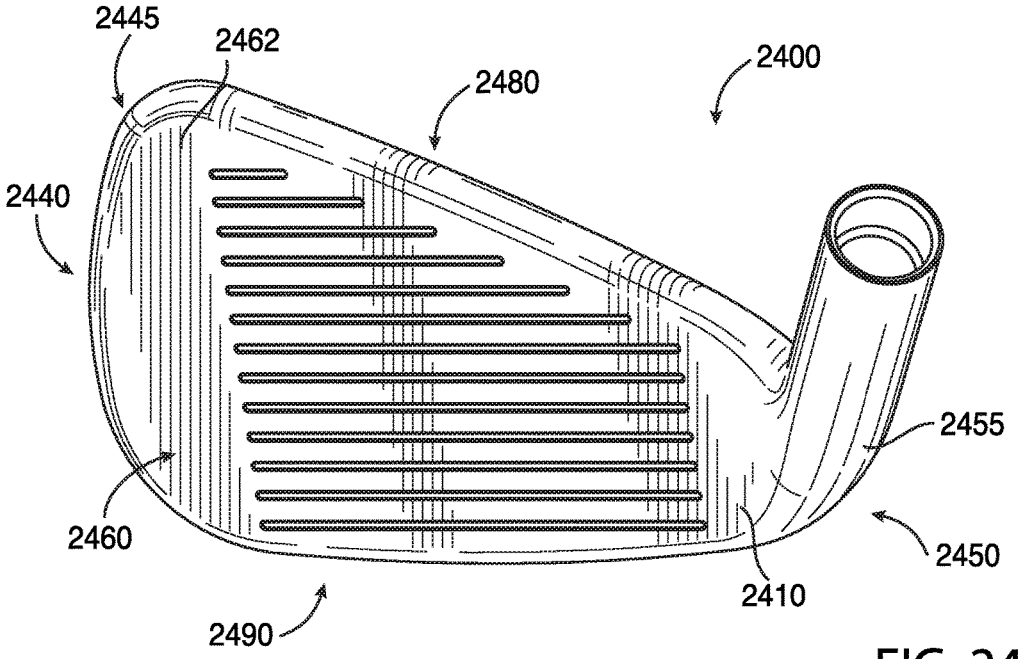
FIG. 24 depicts a front perspective view of a golf club head according to an embodiment of the apparatus, methods, and articles of manufacture described herein.

As described herein, any two or more of the mass portions may be configured as a single mass portion. In the example of FIGS. 22 and 23, a golf club head 2200 may include a body portion 2210 and one or more mass portions, generally shown as a first set of mass portions 2220 (e.g., shown as mass portions 2221, 2222, 2223, and 2224) and a second mass portion 2230. The body portion 2210 may be made of a first material whereas the first set of mass portions 2220 and/or the second mass portion 2230 may be made of a second material. The first and second materials may be similar or different materials. The first and second materials of the body portion 2210 and/or the first and second mass portions 2220 and 2230, respectively, may be similar to the first and second materials of the golf club head 100. The body portion 2210 may include a toe portion 2240, a heel portion 2250, a front portion (not shown), a back portion 2270 with a back wall portion 2310, a top portion 2280, and a sole portion 2290. The heel portion 2250 may include a hosel portion 2255 configured to receive a shaft (not shown) with a grip (not shown) on one end, and the golf club head 2200 on the opposite end of the shaft to form a golf club. The front portion may be similar to the front portion 160 of the golf club head 100. Further, the golf club head 2200 may be the same type of golf club head as any of the golf club heads described herein. The apparatus, methods, and articles of manufacture are not limited in this regard.

The body portion 2210 may include one or more ports along a periphery of the body portion 2210, generally shown as a first set of ports 2320 (e.g., shown as ports 2321, 2322, 2323, and 2324) and a second port 2330. Each port of the first set of ports 2320 may be associated with a port diameter and at least one port of the first set of ports 2320 may be separated from an adjacent port similar to any of the ports described herein. The apparatus, methods, and articles of manufacture are not limited in this regard.

One or more mass portion of the first set of mass portions 2220 (e.g., shown as mass portions 2221, 2222, 2223, and 2224) may be disposed in a port of the first set of ports 2320 (e.g., shown as ports 2321, 2322, 2323, and 2324) located at or proximate to the toe portion 2240 and/or the top portion 2280 on the back portion 2270. The physical properties and/or configurations of the first set of ports 2320 and the first set of mass portions 2220 may be similar to the golf club head 100. The apparatus, methods, and articles of manufacture are not limited in this regard.

The second port 2330 may have any configuration and/or extend to and/or between the toe portion 2240 and the heel portion 2250. As illustrated in FIG. 22, for example, the second port 2330 may be a recess extending from the toe portion 2240 or a location proximate to the toe portion 2240 to the sole portion 2290 or a location proximate to the sole portion 2290. Accordingly, the second port 2330 may resemble an L-shaped recess. The second mass portion 2230 may resemble the shape of the second port 2330 and may be disposed in the second port 2330. The second mass portion 2230 may be partially or fully disposed in the second port 2330. The second mass portion 2230 may have any shape such as oval, rectangular, triangular, or any geometric or non-geometric shape. The second port 2330 may be shaped similar to the second mass portion 2230. However, portion(s) of the second mass portion 2230 that are inserted in the second port 2330 may have similar shapes as the second port 2330. In one example (not shown), the second port 2330 may have a generally rectangular shape and located at or near the sole portion 2290 extending to and/or between the toe portion 2240 and the heel portion 2250. Accordingly, at least a portion of the second mass portion 2230 may have a similar shape as the second port 2330. As described herein, any of the mass portions described herein, including the first mass portions 2220 and the second mass portion 2230 may be coupled to the back portion 2270 of the body portion 2210 with various manufacturing methods and/or processes (e.g., a bonding process, a welding process, a brazing process, a mechanical locking method, any combination thereof, or other suitable manufacturing methods and/or processes). The second mass portion 2230 may be a polymer material that may be injection molded into the second port 2330 as described herein. Also as described herein, any of the mass portions described herein including the mass portion 2230 may be integral with the body portion 2210. The apparatus, methods, and articles of manufacture are not limited in this regard.

The second mass portion 2230 may affect the location of the CG of the golf club head 100 and the MOI of the golf club head about a vertical axis that extends through the CG of the golf club head 2200. All or a substantial portion of the second mass portion 2230 may be generally near the sole portion 2290. For example, the second mass portion 2230 may be near the periphery of the body portion 2210 and extend to and/or between the sole portion 2290 and the toe portion 2240. As shown in the example of FIG. 23, the second mass portion 2230 may be located at or proximate to the periphery of the body portion 2210 and partially or substantially extend at or proximate to the sole portion 2290. A portion of the second mass portion 2230 may be located near the periphery of the body portion 2210 and extend to and/or between the sole portion 2290 and the toe portion 2240 to lower the CG and increase the MOI of the golf club head 2200 about a vertical axis that extends through the CG. To lower the CG of the golf club head 2200, all or a portion of the second mass portion 2230 may be located closer to the sole portion 2290 than to a horizontal midplane 2360 of the golf club head 2200. The horizontal midplane 2360 may be vertically halfway between the ground and top planes 2355 and 2365, respectively. The location of the second mass portion 2230 (i.e., the location of the second port 2330) and the physical properties and materials of construction of the mass portions of the second port 2230 may be determined to optimally affect the mass, mass distribution, CG, MOI characteristics, structural integrity and/or or other static and/or dynamic characteristics of the golf club head 2200. The apparatus, methods, and articles of manufacture described herein are not limited in this regard.

As illustrated in FIGS. 24-29, a golf club head 2400 may include a body portion 2410, and one or more mass portions, generally shown as a first set of mass portions 2420 (e.g., shown as mass portions 2421 and 2422), a second set of mass portions 2430 (e.g., shown as mass portions 2431, 2432, 2433, 2434, 2435, 2436, and 2437), and a third mass portion 2412. The third mass portion 2412 may be a continuous one-piece portion coupled to the body portion 2410. In other words, the third mass portion 2412 may be integrally manufactured with the body portion 2410. Alternatively, the third mass portion 2412 may be a separate piece from the body portion 2410 and is attached to the body portion 2410 as described herein. The second set of mass portions 2430 (e.g., shown as mass portions 2431, 2432, 2433, 2434, 2435, 2436, and 2437) may be coupled to the third mass portion 2412 as described herein. The body portion 2410 may include a toe portion 2440, a heel portion 2450, a front portion 2460, a back portion 2470, a top portion 2480, and a sole portion 2490. The heel portion 2450 may include a hosel portion 2455 configured to receive a shaft (not shown) with a grip (not shown) on one end and the golf club head 2400 on the opposite end of the shaft to form a golf club. The front portion 2460 may include a face portion 2462 (e.g., a strike face). The body portion 2410 may be similar to the body portion of any of the golf club heads described herein. Further, the golf club head 2400 may be any type of golf club head such as any of the golf club heads described herein and be manufactured by any of the methods described herein (e.g., the process 1700 shown in FIG. 17). The apparatus, methods, and articles of manufacture are not limited in this regard.

The body portion 2410, the first set of mass portions 2420, the second set of mass portions 2430, and/or the third mass portion 2412 may be made of similar or different materials. For example, the body portion 2410, the first set of mass portions 2420, the second set of mass portions 2430, and/or the third mass portion 2412 may be made of steel, aluminum, titanium, tungsten, metal alloys, polymers, composite materials, or any combinations thereof. The material(s) of the golf club head 2400, the first set of mass portions 2420, the second set of mass portions 2430, and/or the third mass portion 2412 may be similar to any of the golf club heads and the mass portions described herein such as the golf club head 100. The apparatus, methods, and articles of manufacture are not limited in this regard.

Figure 25:
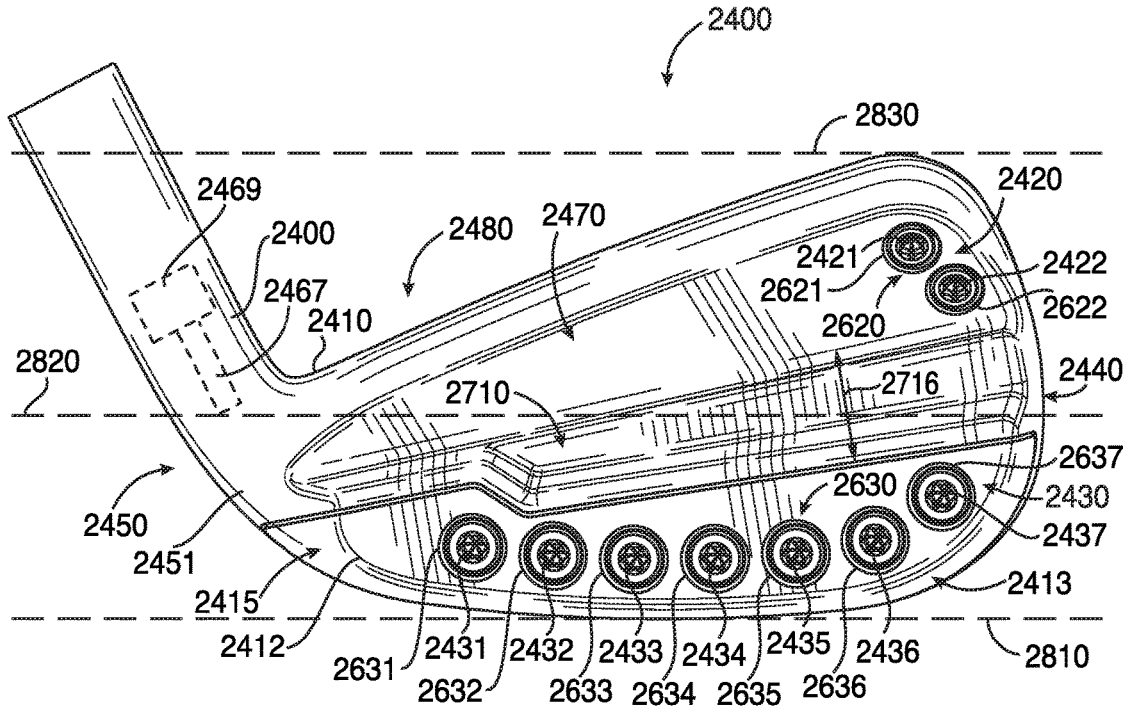
FIG. 25 depicts a rear perspective view of the example golf club head of FIG. 24.
Figure 26:
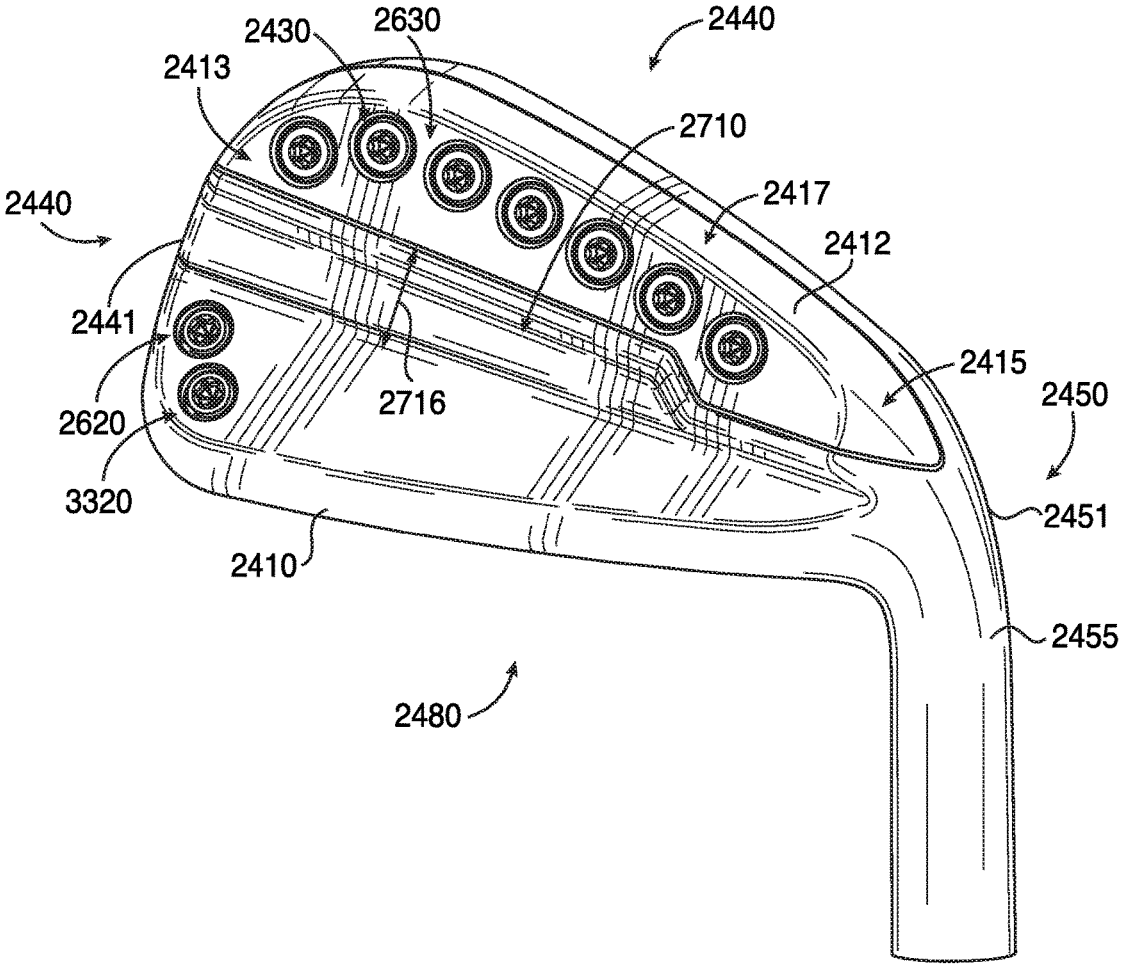
FIG. 26 depicts another rear perspective view of the example golf club head of FIG. 24.

Turning to FIG. 25, for example, the golf club head 2400 may be associated with a ground plane 2810, a horizontal midplane 2820, and a top plane 2830. In particular, the ground plane 2810 may be a plane substantially parallel with the ground and tangential to the sole portion 2490 of the golf club head 2400 when the golf club head 2400 is at an address position (e.g., the golf club head 2400 is aligned to strike a golf ball). The top plane 2830 may be a tangential to the top portion 2480 of the golf club head 2400 when the golf club head 2400 is at the address position. The ground and top planes 2810 and 2830, respectively, may be substantially parallel to each other. The horizontal midplane 2820 may be located at half the vertical distance between the ground and top planes 2810 and 2830, respectively.

The third mass portion 2412 may be a portion of the golf club head 2400 made from a different material than the body portion 2410. The third mass portion 2412 may be located on the back portion 2470 below the horizontal midplane 2820 of the golf club head 2400. In one example (not shown), a portion of the third mass portion 2412 may be at or above the horizontal midplane 2820. The third mass portion 2412 may be made of a material with a relatively greater density than the material of the body portion 2410 to lower the CG of the golf club head 2400 and/or to move the CG of the golf club head 2400 toward the back of the golf club head 2400. In one example, the body portion 2410 may be made of a low density and high strength metal such as titanium or titanium alloy material(s), and the third mass portion 2412 may be made of a high density material such as tungsten or tungsten alloy material(s). In addition or alternatively, at least a portion of the body portion 2410 may be made of a high strength and low density material such as composite materials whereas the third mass portion 2412 may be made of a high density material such as tungsten material(s). Accordingly, the CG of the golf club head 2400 may be located lower than the CG of a comparable golf club head entirely made of a low density material such as titanium and/or composite material(s). The apparatus, methods, and articles of manufacture described herein are not limited in this regard.

The body portion 2410 may include one or more ports along a periphery of the body portion 2410 or the back portion 2470, generally shown as a first set of ports 2620 (e.g., shown as ports 2621 and 2622) and a second set of ports 2630 (e.g., shown as ports 2631, 2632, 2633, 2634, 2635, 2636 and 2637). One or more ports may be an opening of the body portion 2410. The first set of ports 2620 and the second set of ports 2630, respectively, may be ports configured to receive one or more mass portions of the first set of mass portions 2420 and/or the second set of mass portions 2430 similar to the example(s) of the golf club head 100 as described herein. The first set of ports 2620 (e.g., generally shown as ports 2621 and 2622) may be recesses or bores of the body portion 2410 configured to receive one or more mass portions of the first set of mass portions 2420 and/or mass portions of the second set of mass portions 2430. The second set of ports 2630 (e.g., generally shown as ports 2631, 2632, 2633, 2634, 2635, 2636 and 2637) may be recesses or bores of the third mass portion 2412 configured to receive one or more mass portions of the first set of mass portions 2420 and/or mass portions of the second set of mass portions 2430. One or more mass portions of the first and second sets of mass portions 2420 and 2430, respectively, may be coupled to one or more ports of the first and second sets of ports 2620 and 2630, respectively, with various manufacturing methods and/or processes (e.g., a bonding process, a welding process, a brazing process, a mechanical locking method, any combination thereof, or other suitable manufacturing methods and/or processes) such as the methods and processes described herein. The locations of the ports, the distances between the ports, the configurations and/or properties of the ports and the mass portions (e.g., dimensions and/or masses) may be similar to any of the golf club heads, ports and/or mass portions described herein. The apparatus, methods, and articles of manufacture described herein are not limited in this regard.

The third mass portion 2412 may be made of a material with a relatively greater density than the material of the body portion 2410. In one example, the third mass portion 2412 may be made of tungsten or tungsten alloy material(s) whereas the body portion 2410 may be made of titanium or titanium alloy material(s). Referring back to FIG. 25, for example, the third mass portion 2412 may be located below the horizontal midplane 2820 of the golf club head 2400 and on the back portion 2470 of the golf club head 2400 to place the CG of the golf club head 2400 lower and farther back as compared to a comparable golf club head substantially made of the same material as the material of the body portion 2410. The apparatus, methods, and articles of manufacture described herein are not limited in this regard.

Figure 27:
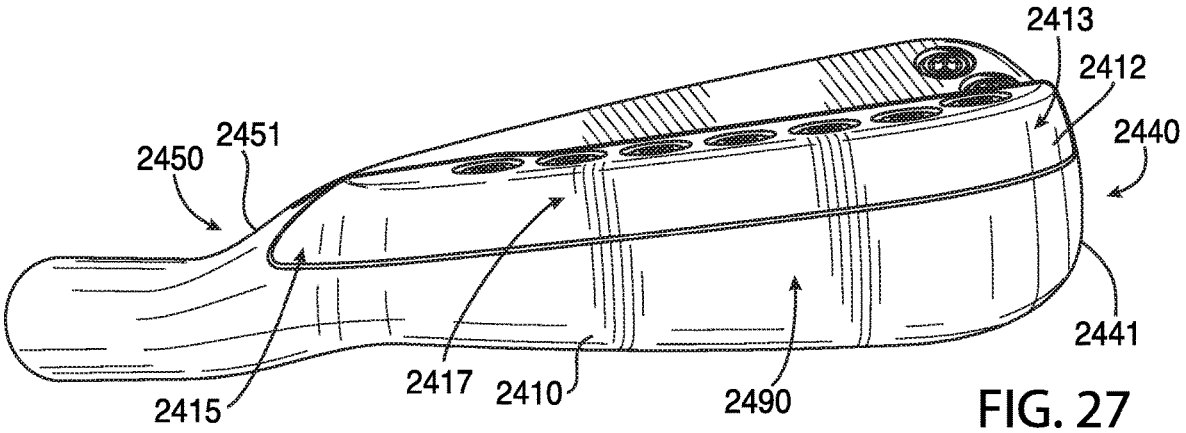
FIG. 27 depicts a perspective bottom view of the example golf club head of FIG. 24.
Figure 28:
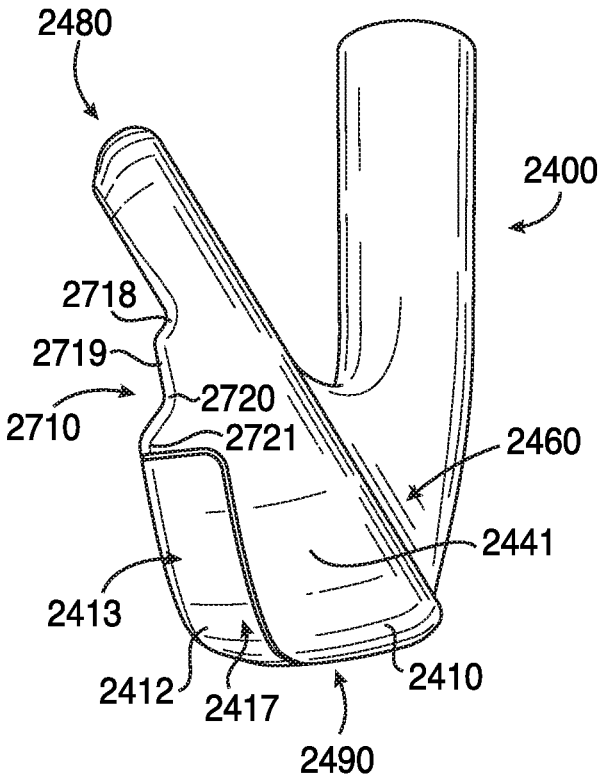
FIG. 28 depicts a perspective toe-side view of the example golf club head of FIG. 24.
Figure 29:
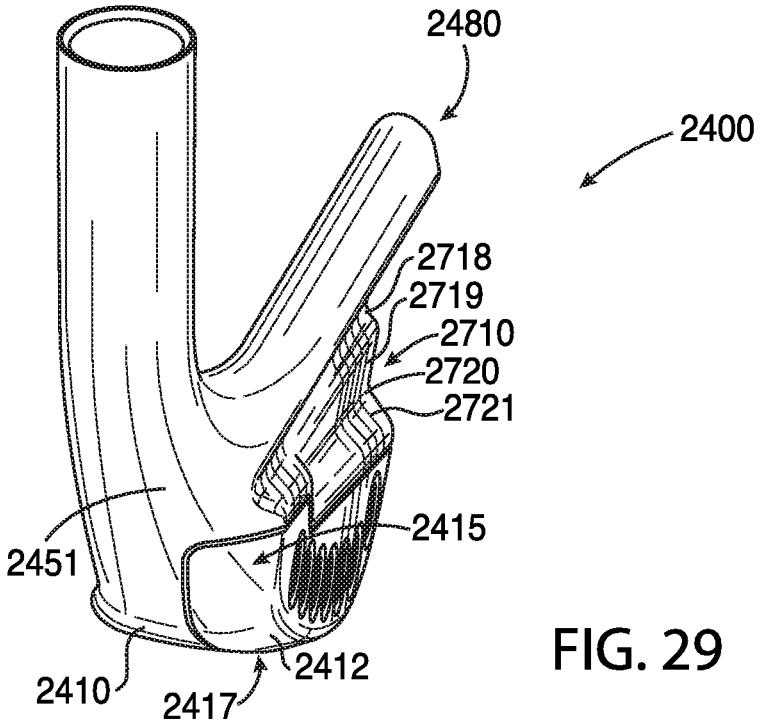
FIG. 29 depicts a perspective heel-side view of the example golf club head of FIG. 24.
Figure 30:
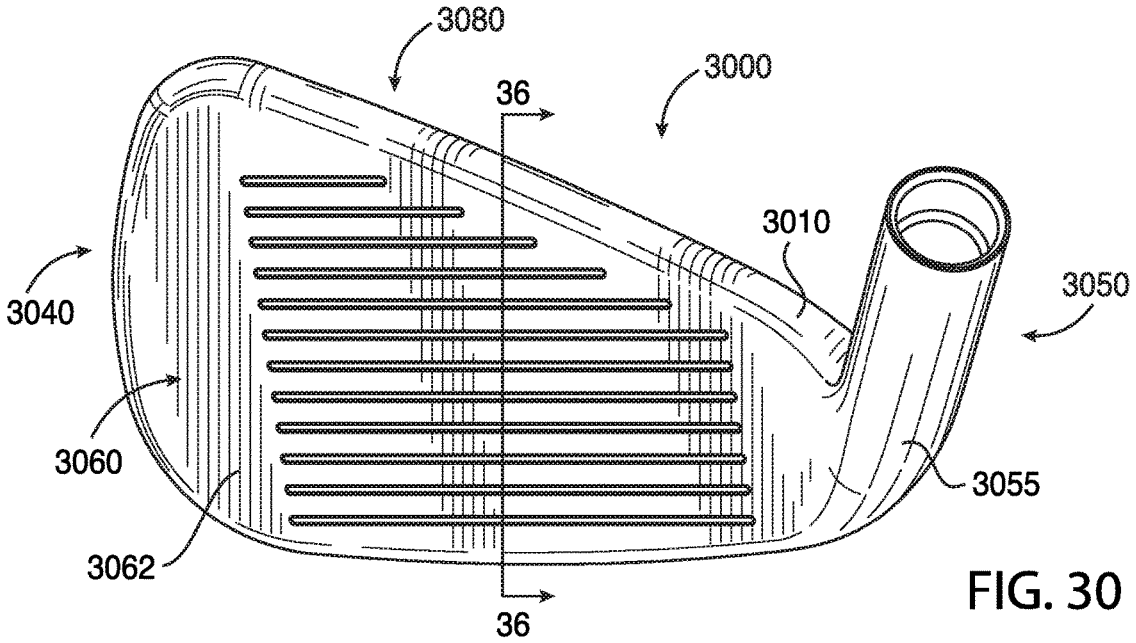
FIG. 30 depicts a front view of a golf club head according to an embodiment of the apparatus, methods, and articles of manufacture described herein.
Figure 31:
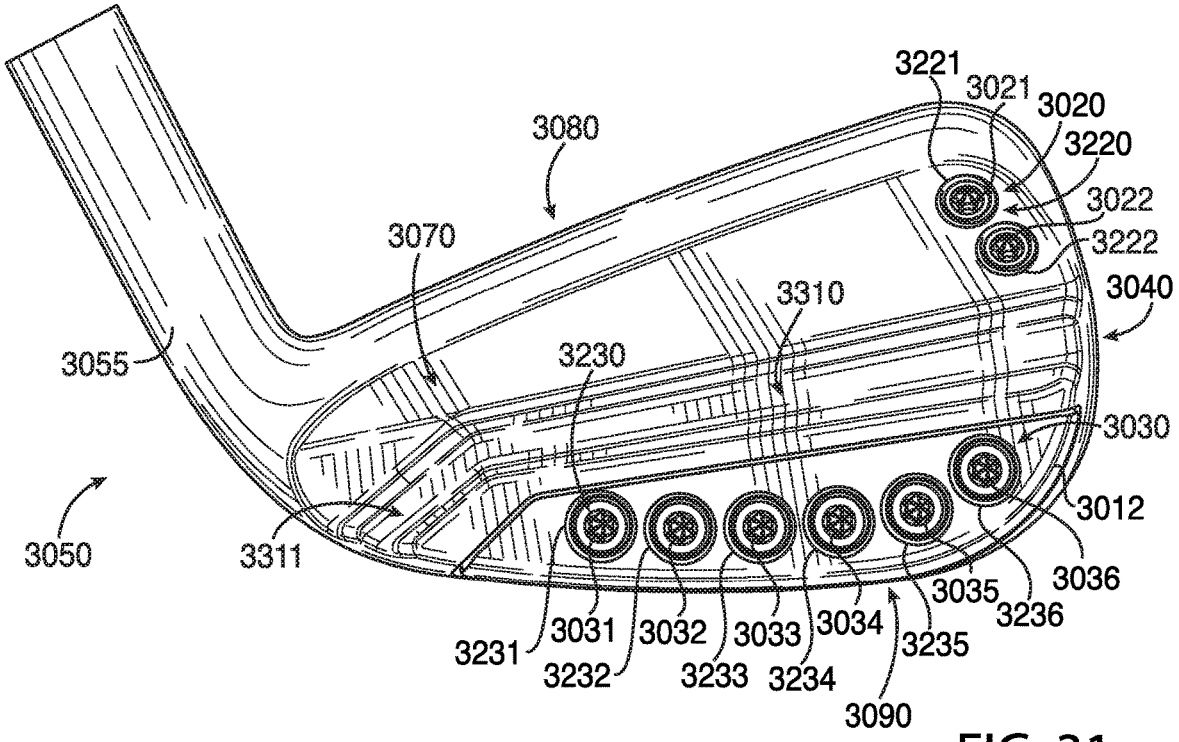
FIG. 31 depicts a rear view of the example golf club head of FIG. 30.
Figure 32:
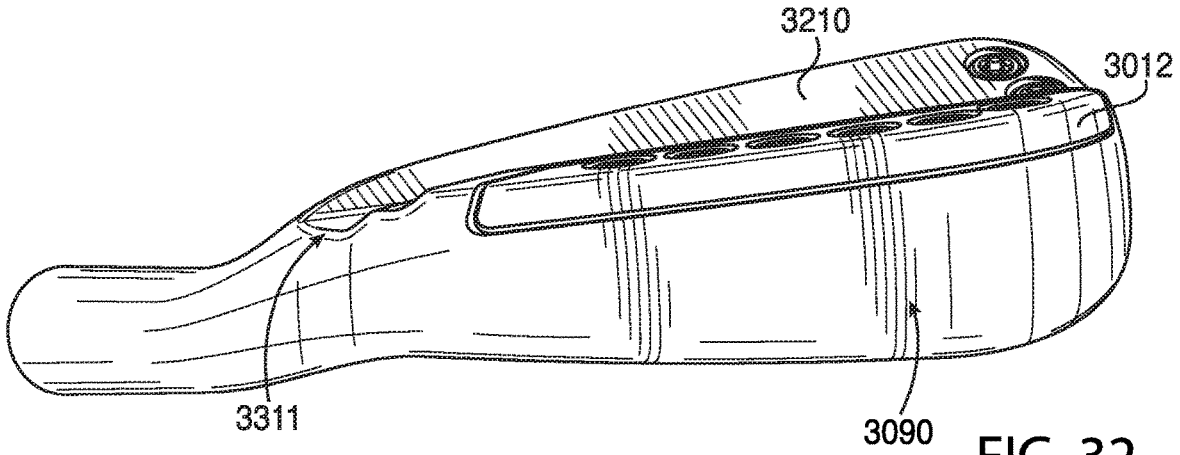
FIG. 32 depicts a bottom view of the example golf club head of FIG. 30.
Figure 33:
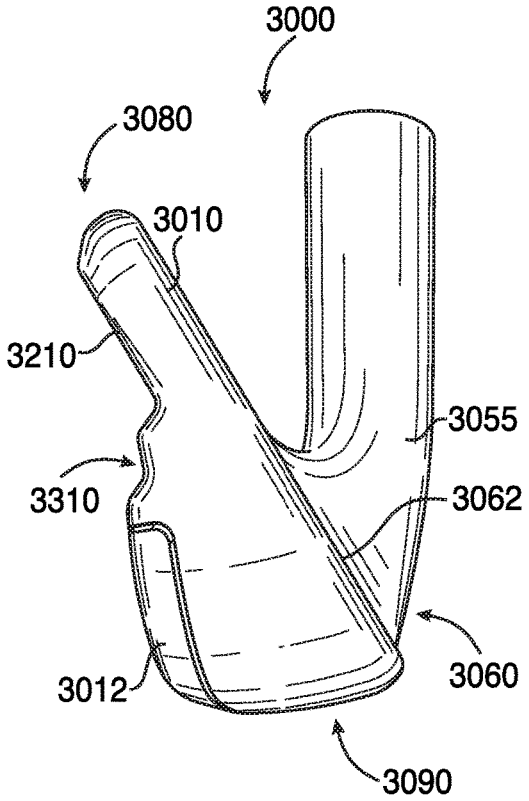
FIG. 33 depicts a perspective toe-side view of the example golf club head of FIG. 30.
Figure 34:
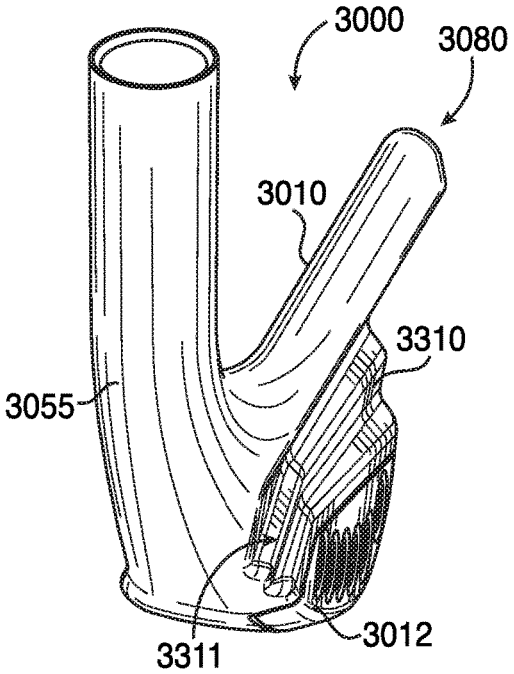
FIG. 34 depicts a perspective heel-side view of the example golf club head of FIG. 30.
Figure 35:
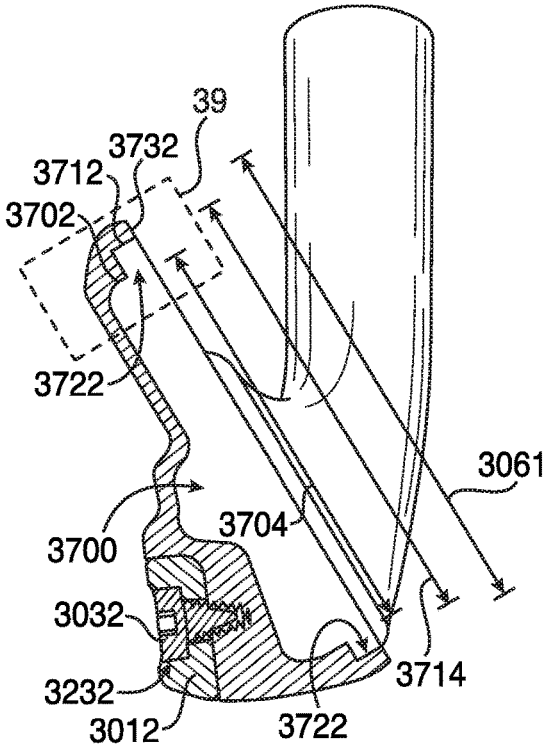
FIGS. 35 and 36 depict a perspective cross-sectional view of the example golf club head of FIG. 30 taken at section lines 35-35 of FIG. 37.
Figure 36:
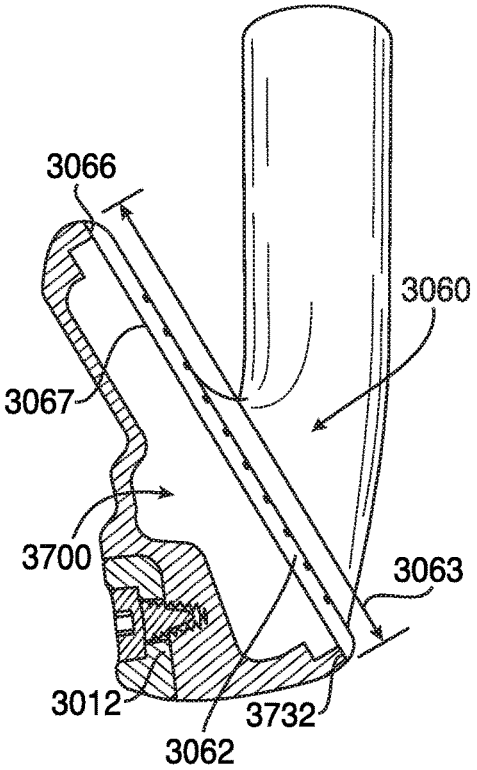

The third mass portion 2412 may include a third mass-toe portion 2413, a third mass heel-portion 2415 and a third mass-bottom portion 2417. The third mass portion 2412 may extend to and/or between the toe portion 2440, the heel portion 2450, and/or the sole portion 2490. For example, the third mass portion 2412 may extend to the toe portion edge 2441 of the toe portion 2440 of the golf club head 2400 so that the third mass portion 2412 may be a portion of the toe portion 2440 of the golf club head 2400 as shown in FIG. 28. The third mass portion 2412 may extend to the heel portion edge 2451 of the heel portion 2450 of the golf club head 2400 so that the heel portion 2415 of the third mass portion 2412 may be a portion of the heel portion 2450 of the golf club head 2400 as shown in FIG. 29. The third mass portion 2412 may extend to the bottom edge of the sole portion 2490 of the golf club head 2400 so that the third mass portion 2412 may be a portion of the sole portion 2490 of the golf club head 2400 as shown in FIG. 27. Accordingly, the third mass portion 2412 may be a portion of the golf club head 2400 extending to and/or between a location below the horizontal midplane 2820 of the golf club head and the sole portion 2490 of the golf club head 2400, and extending to and/or between the toe portion 2440 and the heel portion 2450 of the golf club head 2400. The apparatus, methods, and articles of manufacture described herein are not limited in this regard.

The third mass-toe portion 2413 of the third mass portion 2412 may have a larger mass than the third mass-heel portion 2415 of the third mass portion 2412 to shift more mass toward the toe portion 2440 of the golf club head 2400 to increase the MOI of the golf club head 2400. Accordingly, the third mass portion 2412 may have a relatively larger third mass-toe portion 2413 that may taper to a relatively smaller third mass-heel portion 2415. The tapering of the third mass portion 2412 from the third mass-toe portion 2413 of the third mass portion 2412 to the third mass-heel portion 2415 of the third mass portion 2412 may be defined by a reduction in the height, a reduction in the width and/or a reduction in size and/or shape of the cross sectional area of the third mass portion 2412. The apparatus, methods, and articles of manufacture described herein are not limited in this regard.

In one example, the third mass-heel portion 2415 of the third mass portion 2412 at or proximate to the heel portion 2450 of the golf club head 2400 may include a material with a relatively lower density than the remaining material of the third mass portion 2412 to lower the mass of the golf club head 2400 at or proximate to the heel portion 2450 and/or to provide more mass at or proximate to the toe portion 2440 of the golf club head 2400. In one example, the body portion 2410 may be made of a material with a relatively greater density than titanium or titanium alloy material(s) such as steel material. Accordingly, the third mass portion 2412 may include a reduced mass portion at or proximate to the heel portion 2450 of the golf club head 2400 to lower the mass of the golf club head 2400 at or proximate the heel portion 2450 to balance the golf club head 2400 and move the CG toward a center portion of the golf club head 2400. For example, a portion of the third mass portion 2412 at or proximate to the third mass-heel portion 2415 of the third mass portion 2412 may include a portion (not shown) that may include a material with a relatively lower density than the remaining material of the third mass portion 2412. In one example, a portion of the third mass portion 2412 at or proximate to the third mass-heel portion 2415 of the third mass portion 2412 may include aluminum or aluminum alloy material(s). The apparatus, methods, and articles of manufacture described herein are not limited in this regard.

The third mass portion 2412 may be a separate piece from the body portion 2410 and may be removed from the body portion 2410. Accordingly, the third mass portion 2412 may be removed and exchanged with another third mass portion 2412 having a different mass to allow for adjustability of the mass distribution and/or the total mass of the golf club head 2400. The third mass portion 2412 may be attached to the body portion 2410 by one or more mass portions of the second set of mass portions 2430. For example, one or more of the ports of the second set of ports 2630 may be through bores of the third mass portion 2412 that align with corresponding recesses or bores (not shown) on the body portion 2410. One or more mass portions of the second set of mass portions 2430 may be inserted into the one or more ports of the second set of ports 2630 and extend through the recesses or bores on the body portion 2410 to fasten the third mass portion 2412 to the body portion 2410. The second set of mass portions 2430 (e.g., mass portions 2431, 2432, 2433, 2434, 2435, 2436 and 2437) may be configured to place the CG of the golf club head 2400 at an optimal location and/or optimize the MOI of the golf club head about a vertical axis (not shown) that extends through the CG of the golf club head 2400 similar to the second mass portions 130 of the golf club head 100. The apparatus, methods, and articles of manufacture described herein are not limited in this regard.

In one example, the body portion 2410 or any of the body portions of the golf club heads described herein may be made of one or more metal or metal alloy material(s), non-metallic materials such as composite materials, plastic materials, or wood, and/or any combinations thereof. The third mass portion 2412 may be made of a material that has a greater density than the material of the body portion 2410. For example, the body portion 2410 may be made of titanium or titanium alloy material(s) whereas the third mass portion 2412 may be made of tungsten or tungsten alloy material(s). Accordingly, the hosel portion 2455 may be made of the same material as the material of the body portion 2410 or a different material. To balance the mass of the golf club head 2400 due to the hosel portion 2455 being made of a low-density metal material such as titanium or titanium alloy material(s), the golf club head 2400 may include hosel mass portions 2467 and 2469. The hosel mass portion 2467 may be permanently attached to the hosel portion 2465 whereas the hosel mass portion 2469 may be removable and exchangeable with other hosel mass portions to balance the mass of the golf club head 2400 at the hosel portion 2465. The hosel mass portions 2467 and 2469 may be a fourth set of mass portions for the golf club head 2400. Accordingly, the golf club head 2400 may include a first set of mass portions 2420 and/or a fourth set of mass portions defined by the hosel mass portions 2467 and 2469 above or proximate to the horizontal midplane 2820, and a second set of mass portions 2430 and/or a fourth mass portion below or proximate to the horizontal midplane 2820. In one example, the hosel mass portions 2467 and 2469 and the first set of mass portions 2420 may be collectively the first set of mass portions, and the second set of mass portions 2430 and the third mass portion 2412 may be collectively the second set of mass portions. The apparatus, methods, and articles of manufacture described herein are not limited in this regard.

The mass portions of the second set of mass portions 2430 may have similar or different masses. In one example, the mass portions 2431, 2432, 2433, 2434 and 2435 may be made of a material with a relatively lower density than the mass portions 2436 and 2437. For example, the mass portions 2431, 2432, 2433, 2434 and 2435 may be made of titanium or titanium alloy material(s), while the mass portions 2436 and 2437 may be made of tungsten or tungsten alloy material(s). The mass portions 2431, 2432, 2433, 2434 and 2435 may be changed with mass portions having relatively greater or less mass to affect the swing weight of the golf club head 2400. Accordingly, the total mass of the mass portions 2436 and 2437 may be greater than the total mass of the mass portions 2431, 2432, 2433, 2434 and 2435 to increase the MOI of the golf club head 2400. In one example, the mass of one or more of the mass portions may progressively increase from the heel portion 2450 to the toe portion 2440. In another example, the mass of one or more of the mass portions 2431, 2432, 2433, 2434 and 2435 may progressively increase from the heel portion 2450 to the toe portion 2440 whereas the mass of one or more the mass portions 2436 and 2437 may be constant and greater than the mass of any of the mass portions 2431, 2432, 2433, 2434 and 2435. In yet another example, each of the mass portions 2431, 2432, 2433, 2434 and 2435 may have similar masses, and each of the mass portions 2436 and 2437 may also have similar masses but greater than the mass of any of the mass portions 2431, 2432, 2433, 2434 and 2435. The apparatus, methods, and articles of manufacture described herein are not limited in this regard.

Alternatively, two or more mass portions in the same set may be different in mass. In one example, the mass portion 2421 of the first set 2420 may have a relatively less mass than the mass portion 2422 of the first set 2420. In another example, the mass portion 2431 of the second set 2430 may have a relatively less mass than the mass portion 2435 of the second set 2430. Accordingly, more mass may be distributed away from the heel portion 2450 to increase the MOI about the vertical axis through the CG.

While the figures may depict ports with a particular cross-section shape, the apparatus, methods, and articles of manufacture described herein may include ports with other suitable cross-section shapes. The ports of the first and/or second sets of ports 2620 and 2630, respectively, may have cross-sectional shapes that are similar to the cross-sectional shapes of any of the ports described herein. The apparatus, methods, and articles of manufacture described herein are not limited in this regard.

The first and second sets of mass portions 2420 and 2430, respectively, may be similar in mass (e.g., all of the mass portions of the first and second sets 2420 and 2430, respectively, may weigh about the same). Alternatively, one or more mass portions of the first and second sets of mass portions 2420 and 2430, respectively, may be different in mass individually or as an entire set. In particular, one or more mass portions of the first set 2420 (e.g., shown as 2421 and 2422) may have relatively less mass than any of the mass portions of the second set 2430 (e.g., shown as 2431, 2432, 2433, 2434, 2435, 2436 and 2437). For example, the second set of mass portions 2430 may account for more than 41% of the total mass of the mass portion(s) of the golf club head 2400. In another example, the second set of mass portions 2430 may account for between 55% and 75% of the total mass of the mass portion(s) of the golf club head 2400. In yet another example, the second set of mass portions 2430 may account for between 60% and 90% of the total mass of the mass portion(s) of the golf club head 2400. As a result, the golf club head 2400 may be configured to have at least 41% of the total mass of the mass portion(s) disposed below the horizontal midplane 2820. Further, the total mass of the mass portion(s) may be greater below the horizontal midplane 2820 that the total mass of the mass portion(s) above the horizontal midplane 2820. The mass of the body portion 2410, one or more mass portions of the first set of mass portions 2420, the total mass of the first set of mass portions 2420, one or more mass portions of the second set of mass portions 2430, and/or the total mass of the second set of mass portions 2430 may be similar to the golf club head 100 as described herein. The apparatus, methods, and articles of manufacture described herein are not limited in this regard.

With the first and second sets of mass portions 2420 and 2430, (e.g., securing the first and second sets of mass portions 2420 and 2430 in the ports on the body portion 2410 and/or having first and second sets of mass portion being integral with the body portion 2410), and having the third mass portion 2412 being made of a material with a relatively greater density than the material of the body portion 2410, the location of the CG and the MOI of the golf club head 2400 may be optimized. In particular, the third mass portion 2412 and the first and second sets of mass portions 2420 and 2430, respectively, may lower the location of the CG towards the sole portion 2490 and further back away from the face portion 2462. Further, the MOI may be higher as measured about a vertical axis extending through the CG (e.g., perpendicular to the ground plane 2810). The MOI may also be higher as measured about a horizontal axis extending through the CG (e.g., extending towards the toe and heel portions 2450 and 2460, respectively, of the golf club head 2400). As a result, the club head 2400 may provide a relatively higher launch angle and a relatively lower spin rate than a golf club head without the third mass portion 2412 and the first and second sets of mass portions 2420 and 2430, respectively. The apparatus, methods, and articles of manufacture described herein are not limited in this regard.

Although the figures may depict the mass portions as separate and individual parts visible from an exterior of the golf club head 2400, one or more mass portions of the first set of mass portions 2420 and/or the second set of mass portions 2430, respectively, may be a single piece of an exterior mass portion and/or an interior mass portion (e.g., not visible from an exterior of the golf club head 100). In one example, all of the mass portions of the first set 2420 (e.g., shown as 2421 and 2422) may be combined into a single piece of mass portion (e.g., a first mass portion). In a similar manner, all of the mass portions of the second set 2430 (e.g., 2431, 2432, 2433, 2434, 2435, 2436 and 2437) may be combined into a single piece of mass portion as well (e.g., a second mass portion). In this example, the golf club head 2400 may have only two mass portions. In another example (not shown), the body portion 2410 may not include the first set of mass portions 2420, but include the second set of mass portions 2430 as a single piece of interior mass portion located farther from the heel portion 2450 than the toe portion 2440. In yet another example (not shown), the body portion 2410 may not include the first set of mass portions 2420, but include the second set of mass portions 2430 with a first interior mass portion located farther from the heel portion 2450 than the toe portion 2440 and a second interior mass portion located farther from the toe portion 2440 than the heel portion 2450. The first interior mass portion and the second interior mass portion may be (i) integral parts of the body portion 2410 or (ii) separate from the body portion 2410 and coupled to the body portion 2410. The apparatus, methods, and articles of manufacture described herein are not limited in this regard.

The body portion 2410 of the golf club head 2400 may be a hollow body including the interior cavity (not shown) similar to the golf club head 100. Further, the interior cavity may be unfilled, partially filled with one or more filler materials, or entirely filled with one or more filler materials similar to the golf club head 100 as described herein. The apparatus, methods, and articles of manufacture described herein are not limited in this regard.

Referring back to FIGS. 24-29, for example, the back portion 2470 may include a channel 2710 with a length extending to and/or between the toe portion 2440 and the heel portion 2450. The channel 2710 may extend parallel (not shown) to the horizontal midplane 2820 or extend at an angle relative to the horizontal midplane 2820 as shown in the example of FIG. 25. The channel 2710 may extend from a location at or proximate to the toe portion edge 2441 of the toe portion 2440 at or near the horizontal midplane 2820 to a location at or proximate to the heel portion edge 2451 of the heel portion 2450 below the horizontal midplane 2820. In one example (not shown), the channel 2710 may extend from the toe portion edge 2441 to a location between the toe portion 2440 and the heel portion 2450. In another example (not shown), the channel 2710 may extend from the heel portion edge 2451 of the heel portion 2450 to a location between the toe portion 2440 and the heel portion 2450. In yet another example, the channel 2710 may partially extend to and/or between the toe portion 2440 and the heel portion 2450. The apparatus, methods, and articles of manufacture described herein are not limited in this regard.

In one example, as shown in FIGS. 24-29, the top channel width ($W_{CT}$) 2716 may decrease in a direction from the toe portion 2440 to the heel portion 2450. The top channel width 2716 may be between 0.22 inch (0.55 cm) and 0.65 inch (1.66 cm) at the toe portion edge 2441, and between 0.15 inch (0.29 cm) and 0.37 inch (1.16 cm) at the heel portion edge 2451. In another example, the top channel width 2716 may be between 0.30 inch (0.77 cm) and 0.57 inch (1.35 cm) at the toe portion edge 2441, and between 0.21 inch (0.54 cm) and 0.31 inch (1.01 cm) at the heel portion edge 2451. In another example, the top channel width 2716 may be between 0.28 inch (0.94 cm) and 0.5 inch (1.27 cm) at the toe portion edge 2441, and between 0.26 inch (0.66 cm) and 0.26 inch (0.89 cm) at the heel portion edge 2451. The apparatus, methods, and articles of manufacture described herein are not limited in this regard.

The top channel width 2716 may decrease in a direction from the toe portion edge 2441 to the heel portion edge 2451. In another example, the top channel width 2716 may increase in a direction from the toe portion edge 2441 to the heel portion edge 2451. In yet another example, the top channel width 2716 may remain constant in a direction from the toe portion edge 2441 to the heel portion edge 2451. The top channel width 2716 may vary in any manner in a direction from the toe portion edge 2441 to the heel portion edge 2451. For example, the top channel width 2716 may vary in a direction from the toe portion edge 2441 to the heel portion edge 2451 by between 25% and 75% of the top channel width 2716 at or proximate to the toe portion edge 2441. In another example, the top channel width 2716 may vary in a direction from the toe portion edge 2441 to the heel portion edge 2451 by between 26% and 65%. In another example, the top channel width 2716 may vary in a direction from the toe portion edge 2441 to the heel portion edge 2451 by between 31% and 60%. In yet another example, the top channel width 2716 may decrease continuously and uniformly in a direction from the toe portion edge 2441 to the heel portion edge 2451 (shown in FIGS. 24-29). In yet another example, the top channel width 2716 may increase continuously and uniformly in a direction from the toe portion edge 2441 to the heel portion edge 2451 (not shown). In yet another example, the top channel width 2716 may change in a discontinuous or step-wise manner (not shown) in a direction from the toe portion edge 2441 to the heel portion edge 2451 (not shown). The apparatus, methods, and articles of manufacture described herein are not limited in this regard.

As illustrated in the example of FIGS. 24-29, the channel 2710 may include a first groove portion 2718, a first step portion 2719, a second groove portion 2720, and a second step portion 2721. Each of the first and second groove portions 2718 and 2720, respectively, may include side walls that form a generally right angle, an acute angle, or an obtuse angle relative to the channel width 2716 or a bottom portion of each groove portion, respectively. Accordingly, the groove portions 2718 and 2720 may define valley-shaped groove portions. The areas of joinder between the sidewalls of the groove portions 2718 and 2720 and the bottom portion of each groove portion may include a chamfer or a transition region. The channel 2710 may have any shape or configuration. In one example, the channel 2710 may have U-shaped cross section along a portion or the entire length of the channel 2710. In another example, the channel 2710 may have a square or rectangular cross section along a portion or the entire length of the channel 2710. In yet another example, the channel 2710 may be a longitudinal recess in the body portion 2410 without having any multiple groove and or step portions. The apparatus, methods, and articles of manufacture described herein are not limited in this regard.

The depth each groove portion 2718 and 2720 may be generally constant or may vary in a direction from the toe portion edge 2441 to the heel portion edge 2451. In one example, the depth each groove portion 2718 and/or 2720 may decrease in a direction from the toe portion edge 2441 to the heel portion edge 2451. In another example, as shown in FIGS. 24-29, the depth each groove portion 2718 and/or 2720 may increase in a direction from the toe portion edge 2441 to the heel portion edge 2451. In one example, the depth each groove portion 2718 and/or 2720 may be between 0.04 inch (0.09 cm) and 0.11 inch (0.28 cm) at the toe portion edge 2441 and between 0.06 inch (0.16 cm) and 0.19 inch (0.48 cm) at the heel portion edge 2451. In another example, the depth each groove portion 2718 and/or 2720 may be between 0.05 inch (0.13 cm) and 0.09 inch (0.24 cm) at the toe portion edge 2441 and between 0.09 inch (0.22 cm) and 0.16 inch (0.32 cm) at the heel portion edge 2451. In another example, the depth each groove portion 2718 and/or 2720 may be between 0.06 inch (0.16 cm) and 0.08 inch (0.21 cm) at the toe portion edge 2441 and between 0.11 inch (0.27 cm) and 0.14 inch (0.28 cm) at the heel portion edge 2451. The apparatus, methods, and articles of manufacture described herein are not limited in this regard.

The first step portion 2719 may define a transition portion between the first groove portion 2718 and the second groove portion 2720. The second step portion 2719 may define a transition portion between the second groove portion 2720 and the portion back wall portion 2610 below the channel 2710. The width of the first step portion 2719 and/or the second step portion 2721 may be generally constant or may vary in a direction from the toe portion edge 2441 to the heel portion edge 2451. In one example, the width of the first step portion 2719 and/or the second step portion 2721 may decrease in a direction from the toe portion edge 2441 to the heel portion edge 2451. In another example, the width of the first step portion 2719 and/or the second step portion 2721 may increase in a direction from the toe portion edge 2441 to the heel portion edge 2451. The apparatus, methods, and articles of manufacture described herein are not limited in this regard.

The channel 2710 may define a portion of the body portion 2410 from which mass has been removed to form the channel 2710. The removed mass defined by the channel 2710 may be redistributed to other portions of the body portion 2410 to provide certain characteristics to the golf club head 2400. At least a portion of the removed mass defined by the channel 2710 may be redistributed below the horizontal midplane 2820 of the body portion 2410 to lower the CG of the golf club head 2400 while maintaining or substantially maintaining the overall mass of the body portion 2410. Further, at least a portion of the removed mass defined by the channel 2710 may be redistributed below the horizontal midplane 2820 of the body portion 2410 and closer to the toe portion 2440 than the heel portion 2450 to increase the MOI of the golf club head 2400. In one example, the removed mass defined by the channel 2710 may be redistributed and incorporated into the body portion 2410 below the horizontal midplane 2820 by increasing the volume of the body portion 2410 below the horizontal midplane 2820. Accordingly, the volume and the mass of the body portion 2410 below the horizontal midplane 2820 may be increased. In another example, the removed mass defined by the channel 2710 may be redistributed and incorporated into the third mass portion 2412. In another example, the removed mass defined by the channel 2710 may be redistributed and incorporated into the body portion 2410 as additional mass portion(s). The increased mass below the horizontal midplane 2820 and/or toward the toe portion 2440 may lower the CG and/or increase the MOI of the golf club head 2400. The apparatus, methods, and articles of manufacture described herein are not limited in this regard. The configuration of the channel 2710, such as width, depth, volume, cross-sectional shape, and/or any other characteristics described herein may vary as the channel 2710 extends to and/or between the toe portion 2440 and the heel portion 2450. Accordingly, the mass that is removed from the body portion 2410 due to the presence of the channel 2710 may similarly vary. According to another example, the masses of one or more of the mass portions of the second set of mass portions 2430 may correspondingly vary in a direction from the toe portion 2440 to the heel portion 2450 at a similar rate, a substantially similar rate, or a discrete and step-wise (e.g., mass portions varying in groups of multiple mass portions) yet generally similar rate as the variation in the channel configuration in a direction from the toe portion 2440 to the heel portion 2450. In yet another example, all of the mass portions of the second set of mass portions 2430 may have similar masses. The apparatus, methods, and articles of manufacture described herein are not limited in this regard.

The masses of one or more of the mass portion(s) of the first set of mass portions 2420 and/or the second set of mass portions 2430 may vary. The mass of one or more mass portion(s) may be increased and/or decreased by changing the length, diameter, and/or the material(s) of construction of the mass portions. For example, the mass of a mass portion may be increased by increasing the length of the mass portion without increasing the diameter of the mass portion so that the mass portion can be used in any of the ports of the body portion 2410. In another example, the mass of a mass portion may be increased by using a material with a relatively greater density for the mass portion. The apparatus, methods, and articles of manufacture described herein are not limited in this regard.

In one example, the masses of one or more mass portion(s) the second set of mass portions 2430 may decrease in a direction from the toe portion 2440 to the heel portion 2450 to increase the MOI of the golf club head 2400. In one example, one or more mass portion(s) of the mass portions of the second set of mass portions 2430 may have a lower mass relative to an adjacent mass portion of the second set of mass portions 2430 in a direction from the toe portion 2440 to the heel portion 2450. In another example, groups of mass portions of the second set of mass portions 2430 may have similar masses and yet have a smaller overall mass than an adjacent group of mass portions in a direction from the toe portion 2440 to the heel portion 2450. Accordingly, the masses of the mass portions of the second set of mass portions 2430 may decrease in a direction from the toe portion 2440 to the heel portion 2450 individually, in groups or in any manner. The apparatus, methods, and articles of manufacture described herein are not limited in this regard.

Turning to FIGS. 30-38, a golf club head 3000 may include a body portion 3010. The body portion 3010 may include a toe portion 3040, a heel portion 3050, a front portion 3060, a back portion 3070, a top portion 3080, and a sole portion 3090. The heel portion 3050 may include a hosel portion 3055 configured to receive a shaft (not shown) with a grip (not shown) on one end and the golf club head 3000 on the opposite end of the shaft to form a golf club. The front portion 3060 may include a face portion 3062 (e.g., a strike face). The golf club head 3000 may be any type of golf club head such as any of the golf club heads described herein and be manufactured by any of the methods described herein and illustrated in FIG. 17. The golf club head 3000 may be similar to the golf club head 100. The apparatus, methods, and articles of manufacture are not limited in this regard.

The body portion 3010 may include one or more mass portions, generally shown as a first set of mass portions 3020 (e.g., shown as mass portions 3021 and 3022), a second set of mass portions 3030 (e.g., shown as mass portions 3031, 3032, 3033, 3034, 3035, and 3036), and a third mass portion 3012. The body portion 3010 may include one or more ports along a periphery of the body portion 3010, generally shown as a first set of ports 3220 (e.g., shown as ports 3221 and 3222) and a second set of ports 3230 (e.g., shown as ports 3231, 3232, 3233, 3234, 3235, and 3236). The body portion 3010, the first set of ports 3220, the second set of ports 3230, the first set of mass portions 3020, and the second set of mass portions 3030 may be similar to the corresponding parts of the golf club heads 100 and/or 2400. The apparatus, methods, and articles of manufacture are not limited in this regard.

As shown in FIGS. 30-34, for example, the third mass portion 3012 may be an integral part of the body portion 3010 and made of one or more material(s) that are similar to or different from the material(s) of the body portion 3010. In another example, the third mass portion 3012 may be similar to the third mass portion 2412 of the golf club head 2400. Accordingly, in one example (not shown), the third mass portion 3012 may be a separate piece from the body portion 3010 and may be removable from the body portion 3010. In another example, all or portion(s) of the third mass portion 3012 may be made of similar material(s) as the third mass portion 2412. The apparatus, methods, and articles of manufacture are not limited in this regard.

The back portion 3070 may include a channel 3310 with a length extending in a direction from the toe portion 3040 to the heel portion 3050. The channel 3310 may be similar to the channel 2710 of the golf club head 2400. The channel 2710 of the golf club head 2400 may extend from the toe portion 2440 to the heel portion 2450 at an angle relative to the horizontal midplane 2820 as shown in the example of FIG. 25. The channel 3310 may similarly extend from the toe portion 3040 of the body portion 3010 toward the heel portion 3050. The channel 3310, however, may include a portion 3311 proximate to the heel portion 3050 that extends toward the heel portion 3050 and the sole portion 3090. The apparatus, methods, and articles of manufacture described herein are not limited in this regard.

The body portion 3010 of the golf club head 3000 may be a hollow body portion including an interior cavity 3700 similar to the body portion 110 of the golf club head 100. Further, the interior cavity 3700 may be unfilled, partially filled with one or more filler materials, or entirely filled with one or more filler materials similar to the interior cavity 700 of the golf club head 100 as described herein. The apparatus, methods, and articles of manufacture described herein are not limited in this regard.

For example, as shown in FIGS. 35-39, the interior cavity 3700 may include a first inner perimeter portion 3702 proximate to the front portion 3060 with a first inner perimeter portion height ($H_{PP1}$) 3704 and a second inner perimeter portion 3712 located more forward that the first inner perimeter portion 3702 with a second inner perimeter portion height ($H_{PP2}$) 3714. The second inner perimeter portion height 3714 may define the largest dimension of the interior cavity 3700 in a direction from the top portion 3080 to the sole portion 3090. The second inner perimeter portion height 3714 may be greater than the first inner perimeter portion height 3704 to define an undercut portion 3722 at or near the front portion 3060. The front portion 3060 may have a front edge height ($H_{FE}$) 3061, which may define the height of the most forward part of the front portion 3060. Accordingly, the front portion 3060 may include a perimeter ledge portion 3732 with a perimeter ledge portion width ($W_{PLP}$) 3734. The perimeter ledge portion width 3734 may be the difference between the front edge height 3061 and the second inner perimeter portion height 3714 (e.g., $W_{PLP}=H_{FE}-H_{PP2}$). The perimeter ledge portion width 3734 may extend around all or portion(s) of the front portion 3060 in a continuous or discontinuous manner (e.g., including segments and/or gaps). The perimeter ledge portion 3732 may define an outer boundary of the front portion 3060. The perimeter ledge portion 3732 may be an exterior surface portion of the body portion 3010 at the front portion 3060 outside the interior cavity 3700 and forward of the undercut portion 3722. Any one or more of the transition regions between the first inner perimeter portion 3702, the second inner perimeter portion 3712, the undercut portion 3722, and the perimeter ledge portion 3732 may be configured to reduce stress concentration areas at or proximate to the transition regions and/or the attachment area of the face portion 3062 to the perimeter ledge portion 3732. For example, the transition region between the undercut portion 3722 and the perimeter ledge portion 3732 may be chamfered to reduce the stress on the face portion 3062 when the face portion 3062 strikes a golf ball. The apparatus, methods, and articles of manufacture described herein are not limited in this regard.

Figure 38:
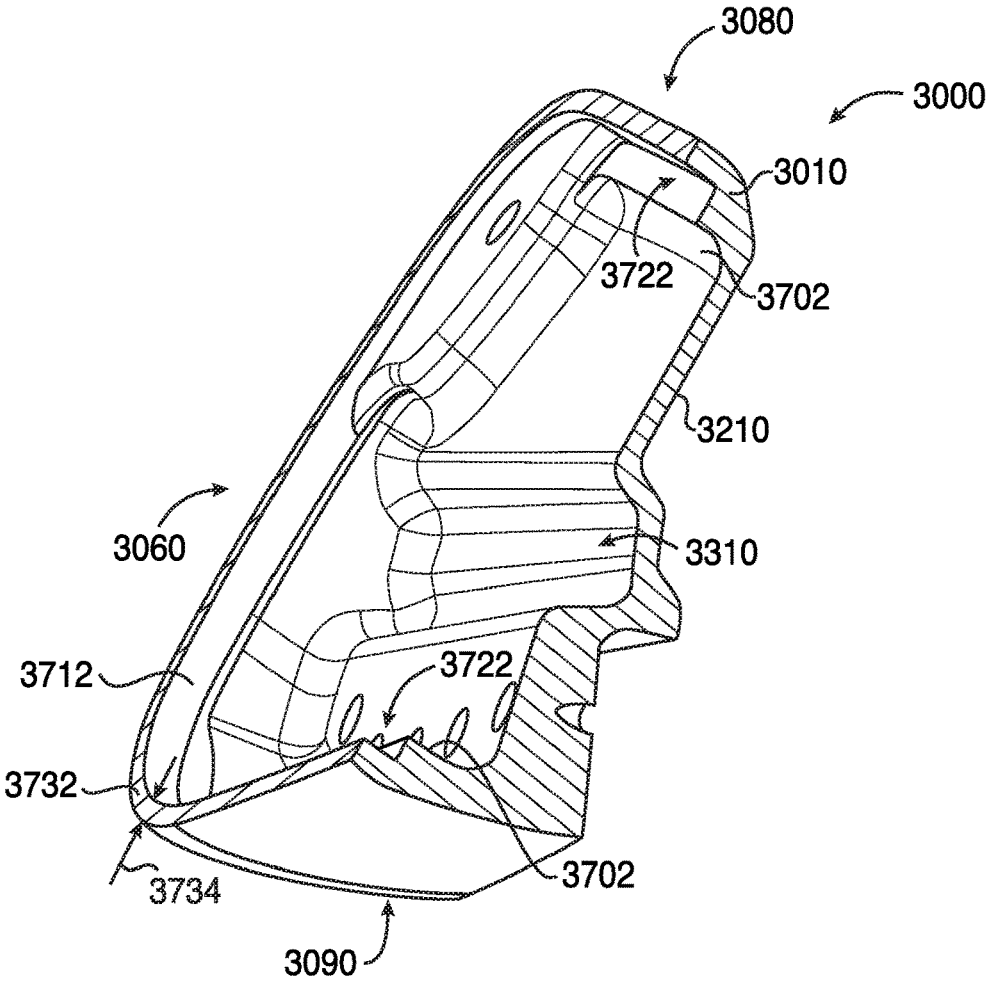
FIG. 38 depicts a perspective cross-sectional view of the example golf club head of FIG. 30 taken at section lines 38-38 of FIG. 37.
Figure 39:
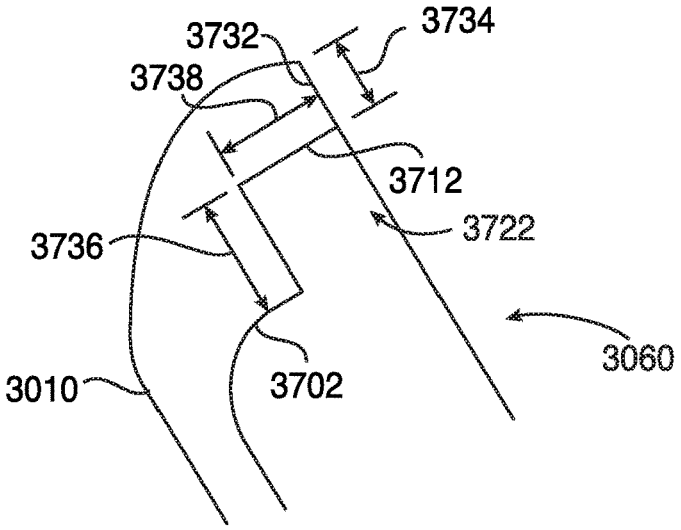
FIG. 39 depicts an enlarged view of area 39 of FIG. 35.

As illustrated in FIG. 38, for example, the configuration (e.g., dimensions, cross-sectional shape, etc.) of the undercut portion 3722 at or proximate to any location around the perimeter of the front portion 3060 may determine the configuration of the perimeter ledge portion 3732 including the perimeter ledge portion width 3734 at or proximate to that particular location. The undercut portion 3722 may have an undercut portion height ($H_{UC}$) 3736 and an undercut portion depth ($D_{UC}$) 3738 at or proximate to any location around the perimeter of the front portion 3060. In one example, the undercut portion height 3736 may be between about 0.05 inch (1.27 millimeters) and about 0.15 inch (3.81 millimeters), and the undercut portion depth 3738 may be between about 0.06 inch (1.52 millimeters) and about 0.14 inch (3.56 millimeters) at or proximate to one or more locations around the perimeter of the front portion 3060. In another example, the undercut portion height 3736 may be between about 0.075 inch (1.08 millimeters) and about 0.125 inch (3.18 millimeters), and the undercut portion depth 3738 may be between about 0.08 inch (2.03 millimeters) and about 0.12 inch (3.05 millimeters) at or proximate to one or more locations around the perimeter of the front portion 3060. In yet another example, the undercut portion height 3736 may be between about 0.09 inch (2.29 millimeters) and about 0.11 inch (2.79 millimeters), and the undercut portion depth 3738 may be between about 0.09 inch (2.29 millimeters) and about 0.11 inch (2.79 millimeters) at or proximate to one or more locations around the perimeter of the front portion 3060. The undercut portion height 3736 and/or the undercut portion depth 3738 may be less than or greater than the ranges described herein. The configuration (e.g., dimensions, cross-sectional shape, etc.) of the undercut portion 3722 may be constant or vary around the perimeter of the front portion 3060. For example, the undercut portion 3722 may have an undercut portion height 3736 of 0.1 inch (2.54 millimeters) at or around at one location on the front portion 3060 but an undercut portion height 3736 of 0.075 inch (1.91 millimeters) at or around another location on the front portion 3060. The configuration (e.g., dimensions, cross-sectional shape, etc.) of the undercut portion 3722 may be constant or vary for different types of golf club heads. For example, different iron-type golf club heads may have similar or different configuration (e.g., dimensions, cross-sectional shape, etc.) of the undercut portion 3722. While the figures may depict a substantially right-angle undercut portion, the apparatus, methods, and articles of manufacture described herein may include a radiused undercut portion. The apparatus, methods, and articles of manufacture described herein are not limited in this regard.

The face portion 3062 may have a face portion height ($H_{FP}$) 3063, which may be similar to the front edge height ($H_{FE}$) 3061. Accordingly, the perimeter ledge portion 3732 may define a surface for the face portion 3062 to attach to the body portion 3010. The face portion 3062 may be attached to the perimeter ledge portion 3732 by welding, soldering, using one or more adhesives, and/or other suitable methods. In another example, the face portion 3062 may be an integral part of the body portion 3010. The apparatus, methods, and articles of manufacture described herein are not limited in this regard.

As mentioned above, the difference between the front edge height 3061 and the second inner perimeter portion height 3714 may define the perimeter ledge portion width 3734. Accordingly, the configuration of the undercut portion 3722 may determine the perimeter ledge portion width 3734 and other configuration(s) of the perimeter ledge portion 3732. As mentioned above, the face portion 3062 may attach to the front portion 3060 of the body portion 3010. The face portion 3062 may include a face perimeter portion 3066 to attach to the perimeter ledge portion 3732 of the front portion 3060. The face portion 3062 may include a strike portion 3067, which may extend from opposing sides of the perimeter ledge portion 3732. The strike portion 3067 of the face portion 3062 may be a portion of the face portion 3062 that bends as the face portion 3062 strikes a golf ball (not shown). In another example, the strike portion 3067 may include one or more grooves. The height of the strike portion 3067 may be similar to the second inner perimeter portion height 3714. The location of the perimeter ledge portion 3732 and the perimeter ledge portion width 3734 may provide a relatively large face portion strike portion 3067 (e.g., large second inner perimeter portion height 3712) to provide relatively greater flexibility to strike a golf ball. The undercut portion 3722 may be made as large as possible considering the physical characteristics and materials of the golf club head 3000 and/or the face portion 3062 (e.g., face portion thickness) to provide a perimeter ledge portion 3732 with as small as possible perimeter ledge portion width 3734 to increase the size of the face portion strike portion 3067 as much as possible. The increased size of the strike portion 3067 of the face portion 3062 may increase ball speed and/or distance for an individual using the golf club head 3000. The apparatus, methods, and articles of manufacture described herein are not limited in this regard.

The perimeter ledge portion width 3734 may be constant or vary along the perimeter of the front portion 3060. In one example, the perimeter ledge portion width 3734 may be constant in a range between about 0.04 inch (1.02 millimeters) and about 0.14 inch (3.56 millimeters). In another example, the perimeter ledge portion width 3734 may be constant in a range between about 0.06 inch (1.52 millimeters) and about 0.12 inch (3.05 millimeters). In yet another example, the perimeter ledge portion width 3734 may be constant in a range between and about 0.08 inch (2.03 millimeters) and about 0.1 inch (2.54 millimeters). In addition or alternatively, the perimeter ledge portion width 3734 may vary along the perimeter of the front portion 3060 in any of the width ranges described herein. The apparatus, methods, and articles of manufacture described herein are not limited in this regard.

Figure 37:
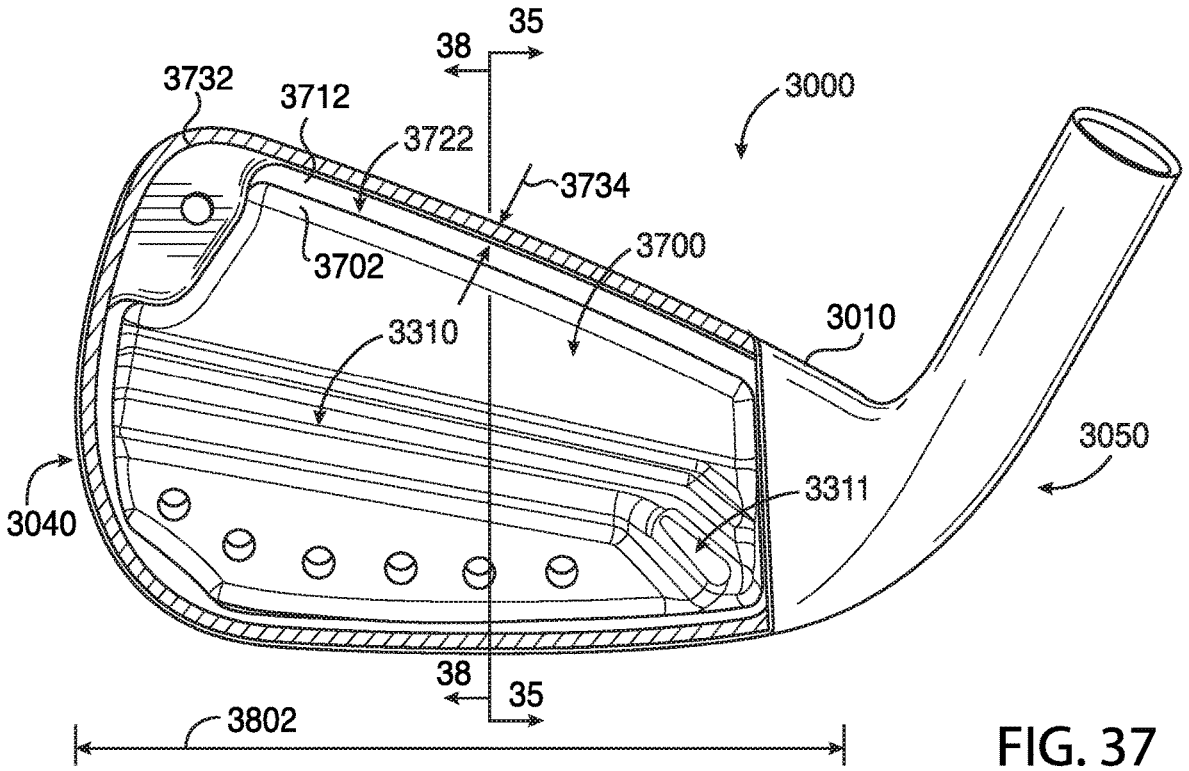
FIG. 37 depicts a front perspective view of the example golf club head of FIG. 30 shown with the face portion removed.

Although the figures may depict and the above examples may describe particular dimensions, the first inner perimeter portion 3702, the second inner perimeter portion 3712, the undercut portion 3722, the perimeter ledge portion 3732, and/or the face portion 3062 may vary in lengths, widths, etc. The configurations of the first inner perimeter portion 3702, the second inner perimeter portion 3712, the undercut portion 3722, the perimeter ledge portion 3732, and/or the face portion 3062 described herein may be applicable along a width 3802 of the front portion 3060 (e.g., as shown in FIG. 37). Further, the configurations of the first inner perimeter portion 3702, the second inner perimeter portion 3712, the undercut portion 3722, the perimeter ledge portion 3732 and/or the face portion 3062 described herein may be applicable along all or parts of the perimeter of the front portion 3060. The apparatus, methods, and articles of manufacture described herein are not limited in this regard.

Figure 40:
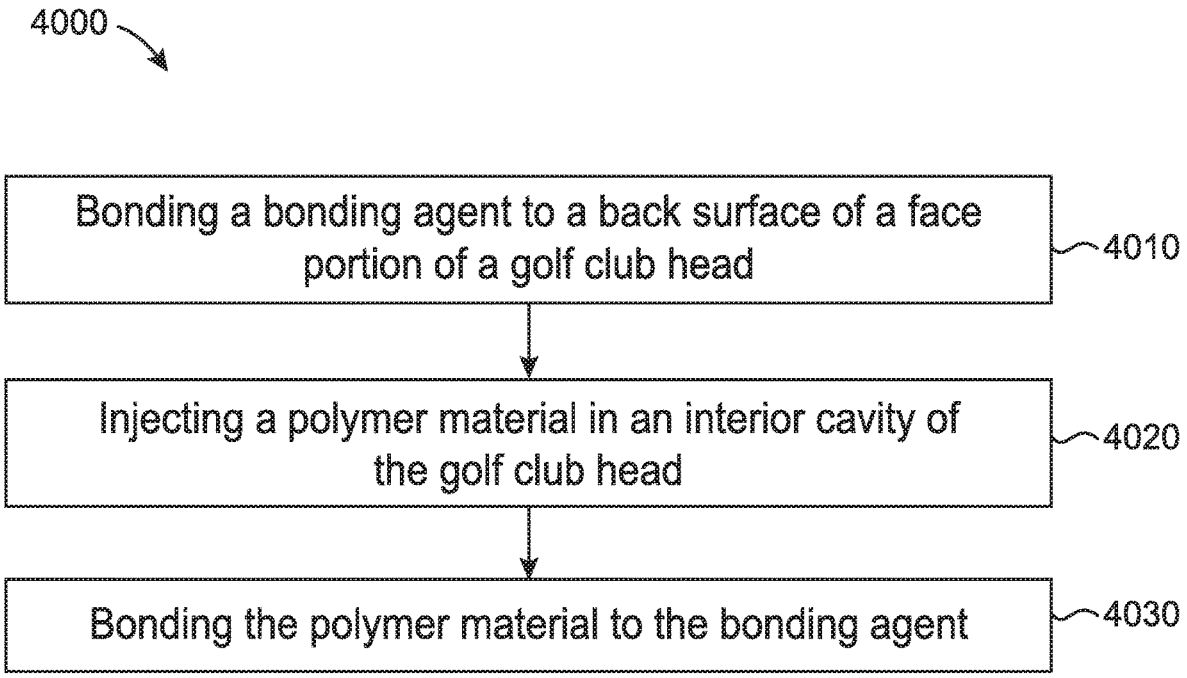
FIG. 40 depicts yet another manner in which an example golf club head described herein may be manufactured.
Figure 41:
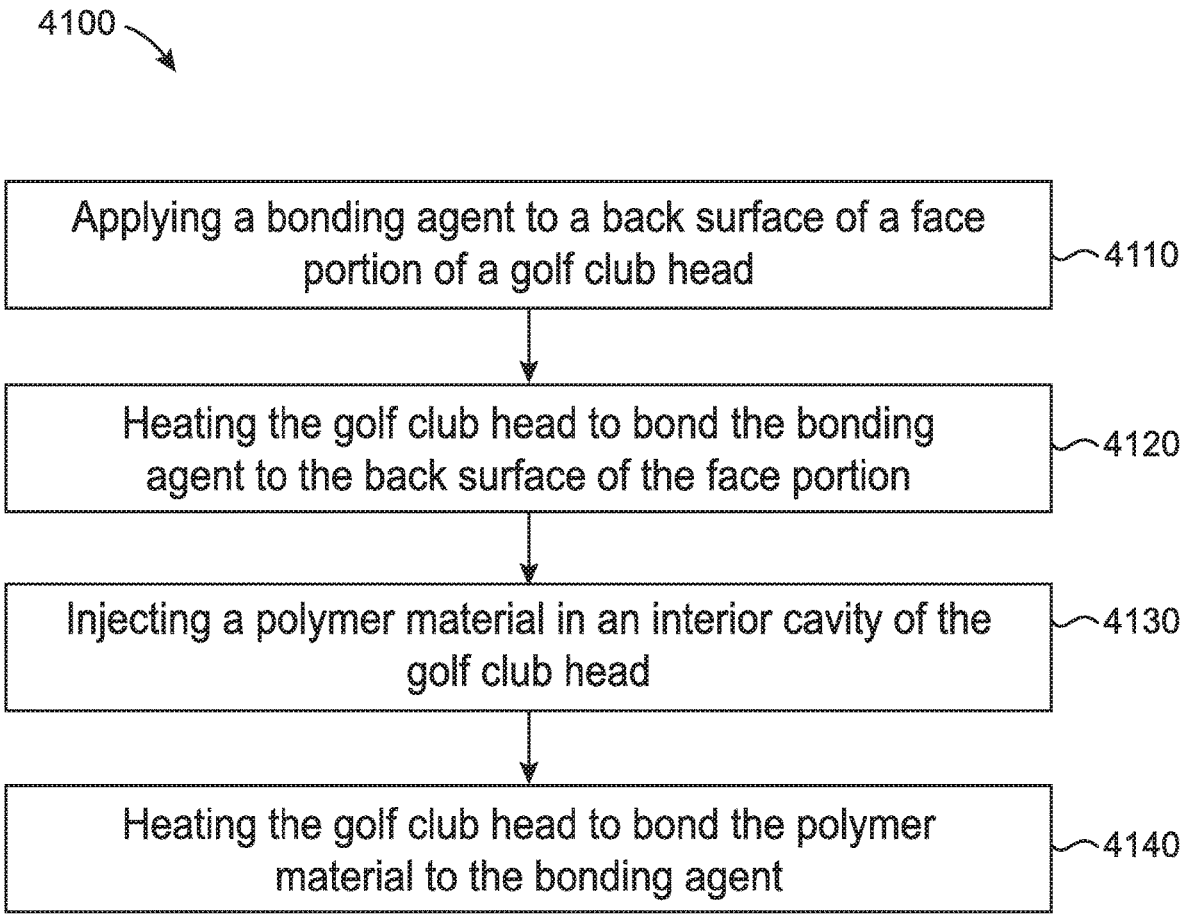
FIG. 41 depicts yet another manner in which an example golf club head described herein may be manufactured.
Figure 42:
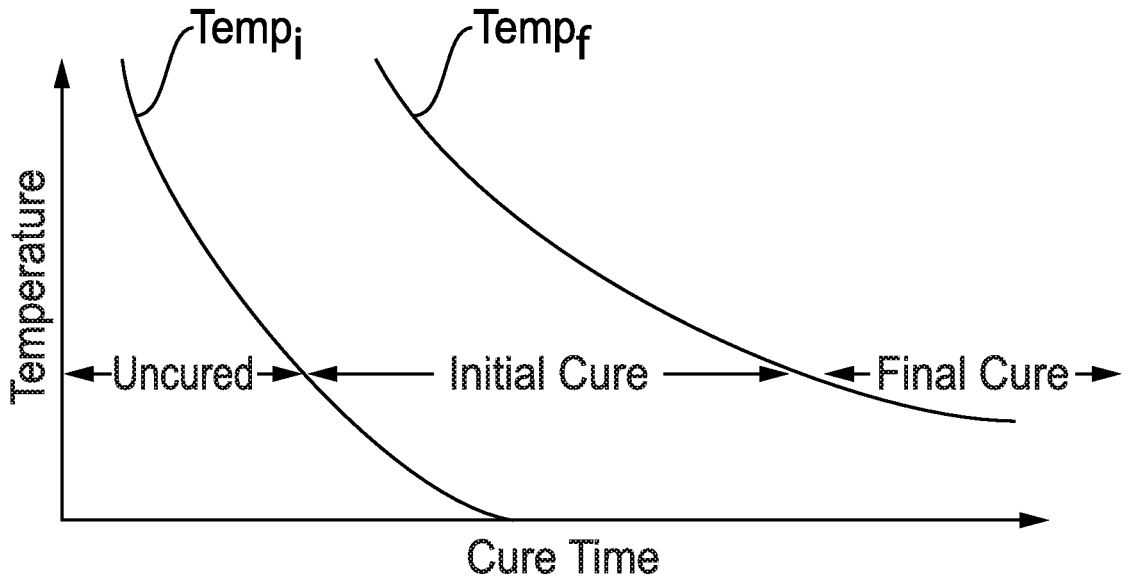
FIG. 42 depicts an example of curing a bonding agent.

For brevity, the description of processes described herein with reference to FIGS. 40-42 may be provided in reference to the golf club head 100. However, any apparatus, methods, and articles of manufacture described herein is applicable to any of the golf club heads described herein. FIG. 40 depicts one manner that the interior cavity of any of the golf club heads described herein may be partially or entirely filled with one or more filler materials such as any of the filler materials described herein. The example process 4000 may begin with bonding a bonding agent to the back surface 166 of the face portion 162 of the golf club head 100 (block 4010). The bonding agent may have an initial bonding state, which may be a temporary bonding state, and a final bonding state, which may be a permanent bonding state. The initial bonding state and the final bonding states may be activated when the bonding agent is exposed to heat, radiation, and/or other chemical compounds. For example, as described herein, the bonding agent may be an epoxy having an initial cure state and a final cure state that are activated by the epoxy being heated to different temperatures for a period of time, respectively, by conduction, convention, and/or radiation. In another example, the bonding agent may be a bonding material that is activated to an initial bonding state and a final bonding state by being exposed to different doses and/or duration of ultraviolet radiation, respectively. In another example, the bonding agent may be a bonding material that is activated to an initial bonding state and a final bonding state by being exposed to different compounds or different amounts of the same compound, respectively. According to the process 4000, the bonding agent may be bonded to the back surface 166 of the face portion 162 by being activated to the initial bonding state. A polymer material is then injected in the interior cavity 700 of the golf club head 100 (block 4020). The example process 4000 then includes bonding the polymer material to the bonding agent (block 4030). Bonding the polymer material to the bonding agent may include activating the bonding agent to the final bonding state to permanently bond the polymer material to the bonding agent and to permanently bond the bonding agent to the back surface 166 of the face portion 162. The example process 4000 is merely provided and described in conjunction with other figures as an example of one way to manufacture the golf club head 100. While a particular order of actions is illustrated in FIG. 40, these actions may be performed in other temporal sequences. Further, two or more actions depicted in FIG. 40 may be performed sequentially, concurrently, or simultaneously.

FIG. 41 depicts one manner that the interior cavity 700 of the golf club head 100 or any of the golf club heads described herein may be partially or entirely filled with one or more filler materials such any of the filler materials described herein. The process 4100 may begin with applying a bonding agent (e.g., a bonding portion 1910 of FIG. 19) to the back surface 166 of the face portion 162 of the golf club head 100 (block 4110). The bonding agent may be any type of adhesive and/or other suitable materials. In one example, the bonding agent may be an epoxy. Prior to applying the bonding agent, the golf club head 100 may be cleaned to remove any oils, other chemicals, debris or other unintended materials from the golf club head 100 (not shown). The bonding agent may be applied on the back surface 166 as described herein depending on the properties of the bonding agent. The bonding agent may be applied to the back surface 166 of the face portion 162 through one or more of the first set of ports 1420 and/or the second set of ports 1430. For example, the bonding agent may be in liquid form and injected on the back surface 166 through several or all of the first set of ports 1420 and the second set of ports 1430. An injection instrument (not shown) such as a nozzle or a needle may be inserted into each port until the tip or outlet of the injection instrument is near the back surface 166. The bonding agent may then be injected on the back surface 166 from the outlet of the injection instrument. Additionally, the injection instrument may be moved, rotated, and/or swiveled while inside the interior cavity 700 so that the bonding agent may be injected onto an area of the back surface 166 surrounding the injection instrument. For example, the outlet of the injection instrument may be moved in a circular pattern while inside a port to inject the bonding agent in a corresponding circular pattern on the back surface 166. Each of the first set of ports 1420 and the second set of ports 1430 may be utilized to inject a bonding agent on the back surface 166. However, utilizing all of first ports 1420 and/or the second set of ports 1430 may not be necessary. For example, using every other adjacent port may be sufficient to inject a bonding agent on the entire back surface 166. In another example, ports 1421, 1422 1431, 1433 and 1436 may be used to inject the bonding agent on the back surface 166. The apparatus, methods, and articles of manufacture are not limited in this regard.

The example process 4100 may also include spreading or overlaying the bonding agent on the back surface 166 (not shown) after injecting the bonding agent onto the back surface 166 so that a generally uniform coating of the bonding agent is provided on the back surface 166. According to one example, the bonding agent may be spread on the back surface 166 by injecting air into the interior cavity 700 through one or more ports of the first set of ports 1420 and/or the second set of ports 1430. The air may be injected into the interior cavity 700 and on the back surface 166 by inserting an air nozzle into one or more ports of the first set of ports 1420 and/or the second set of ports 1430. According to one example, the air nozzle may be moved, rotated and/or swiveled at a certain distance from the back surface 166 to uniformly blow air onto the bonding agent and spread the bonding agent on the back surface 166 for a uniform coating or a substantially uniform coating of the bonding agent on the back surface 166. Further, the golf club head 100 may be pivoted back and forth in one or several directions so that the bonding agent may spread along a portion or substantially the entire area of the back surface 166 of the face portion 162. In one example, the golf club head 100 may be vibrated with the back surface 166 of the face portion 162 in a generally horizontal orientation so that the bonding agent may spread or overlay on the back surface 166 in a uniform coating manner or a substantially uniform coating manner. The apparatus, methods, and articles of manufacture are not limited in this regard.

The example process 4100 is merely provided and described in conjunction with other figures as an example of one way to manufacture the golf club head 100 or any of the golf club heads described herein. While a particular order of actions is illustrated in FIG. 41, these actions may be performed in other temporal sequences. Further, two or more actions depicted in FIG. 41 may be performed sequentially, concurrently, or simultaneously. The example process 4100 may include a single action (not shown) of injecting and uniformly or substantially uniformly coating the back surface 166 with the bonding agent. In one example, the bonding agent may be injected on the back surface 166 by being converted into fine particles or droplets (i.e., atomized) and sprayed on the back surface 166. Accordingly, the back surface 166 may be uniformly or substantially uniformly coated with the bonding agent in one action. A substantially uniform coating of the bonding agent on the back surface 166 may be defined as a coating having slight non-uniformities due to the injection process or the manufacturing process. However, such slight non-uniformities may not affect the bonding of the elastic polymer material or elastomer material to the back surface 166 with the bonding agent as described herein. For example, spraying the bonding agent on the back surface 166 may result in overlapping regions of the bonding agent having a slightly greater coating thickness than other regions of the bonding agent on the back surface 166. The apparatus, methods, and articles of manufacture are not limited in this regard.

In one example as shown in FIG. 42, the bonding agent may be an epoxy having different curing states based on the temperature and the amount of time to which the epoxy may be exposed. The bonding agent may have an uncured state, an initial cure state, and a final cure state. In one example, the uncured state may be a liquid state, the initial cure state may be gel or a semi-solid/semi-liquid state, and the final cure state may be a solid state. The bonding agent may transition from the uncured state to the initial cure state when the bonding agent is heated to a temperature between an initial cure state temperature ($Temp_i$) and a final cure state temperature ($Temp_f$) for a period of time. Accordingly, an initial cure state temperature range may be defined by temperatures that are greater than or equal to the initial cure state temperature $Temp_i$ and less than the final cure state temperature $Temp_f$. The bonding agent may transition from the initial cure state to the final cure state when the bonding agent may be heated to a temperature greater than or equal to the final cure state temperature $Temp_f$ for a period of time. Accordingly, a final cure state temperature range may be defined by temperatures that are greater than or equal to the final cure state temperature $Temp_f$. The initial cure state temperature $Temp_i$ and the final cure state temperature $Temp_f$ may vary based on the amount of time that the bonding agent may be heated. In particular, a transition from the uncured state to the initial cure state and a transition from the initial cure state to the final cure state may be dictated by certain temperature and time profiles based on the properties of the bonding agent. At a temperature below the initial cure temperature $Temp_i$, the bonding agent may be in the uncured state (e.g., a liquid state). In the initial cure state, the bonding agent may form an initial bond with an object and become pliable to be manipulated (e.g., moved, spread, overlay, etc.) without obtaining full cross linking or forming a permanent bond. In other words, the bonding agent may form an initial bond with an object and be manipulated without forming a permanent bond. In the final cure state, the bond of the bonding agent (e.g., cross linking for a bonding agent that includes epoxy) may be complete or become permanently set.

The bonding agent may be applied to the back surface 166 of the face portion 162 when the bonding agent is in the uncured state, which may be a liquid state. Subsequently, the golf club head 100 and/or the bonding agent may be heated to a first temperature $Temp_1$ that is greater than or equal to the initial cure state temperature $Temp_i$ and less than the final cure state temperature $Temp_f$ to change the bonding agent from an uncured state to an initial cure state (i.e., an initial cure state temperature range) (block 4120). Accordingly, the bonding agent may form an initial bond with the back surface 166 of the face portion 162. After bonding the bonding agent to the back surface 166, the golf club head 100 may be cooled for a period of time at ambient or room temperature (not shown). Accordingly, the bonding agent may be in an initial cured state and bonded to the back surface 166 of the face portion 162 so that the bonding agent may be bonded to the back surface 166 during the injection molding of a polymer material in the interior cavity 700. Ambient or room temperature may be defined as a room temperature ranging between 5° C. (32° F.) and 31° C. (104° F.). The first temperature $Temp_1$ and duration by which the golf club head 100 and/or the bonding agent heated to the first temperature $Temp_1$ may depend on the curing or bonding properties of the bonding agent. The apparatus, methods, and articles of manufacture are not limited in this regard.

After the bonding agent is bonded to the back surface 166 of the face portion 162, the golf club head 100 may be heated (i.e., pre-heating the golf club head 100) prior to receiving a polymer material (not shown). The golf club head 100 may be heated so that when the polymer material is injected in the golf club head 100, the polymer material is not cooled by contact with the golf club head and remains in a flowing liquid form to fill the internal cavity 700. The temperature at which the golf club head is heated, which may be referred to herein as a third temperature, may be similar to the temperature of the polymer material when being injected into the internal cavity 700. However, the temperature at which the golf club head is heated may be less than the final cure temperature $Temp_f$ of the bonding agent. Accordingly, the bonding agent may not transition from the initial cure state to the final cured state during the injection molding process. Further, the pre-heating temperature of the golf club head 100 may be determined so that excessive cooling of the golf club head 100 may not be necessary after injection molding the polymer material in the internal cavity 700. Prior to being injected into the internal cavity 700, the polymer material may also be heated to a liquid state (not shown). The temperature at which the polymer material may be heated may depend on the type of polymer material used to partially or fully fill the interior cavity 700. Further, the temperature at which the polymer material is heated may be determined so that shrinkage of the polymer material is reduced during the injection molding process. However, as described herein, the polymer material may be heated to a temperature that is less than the final cure temperature $Temp_f$ of the bonding agent. The apparatus, methods, and articles of manufacture are not limited in this regard.

As described herein, the cavity 700 may be partially or fully filled with a polymer material by injecting the polymer material in the cavity 700 (block 4130). The injection speed of the polymer material may be determined so that the interior cavity 700 may be slowly filled to provide a better fill while allowing air to escape the interior cavity 700 and allowing the injected polymer material to rapidly cool. For example, the polymer material may be a non-foaming and injection-moldable thermoplastic elastomer (TPE) material. The polymer material may be injected into the interior cavity 700 from one or more of the ports described herein (e.g., one or more ports of the first and second sets of ports 1420 and 1430, respectively, shown in FIG. 14). One or more other ports may allow the air inside the interior cavity 700 displaced by the polymer material to vent from the interior cavity 700. In one example, the golf club head 100 may be oriented horizontally as shown in FIG. 14 during the injection molding process. The polymer material may be injected into the interior cavity 700 from ports 1431 and 1432. The ports 1421, 1422 and/or 1423 may serve as air ports for venting the displaced air from the interior cavity 700. Thus, regardless of the orientation of the golf club head 100 during the injection molding process, the polymer material may be injected into the interior cavity 700 from one or more lower positioned ports while one or more upper positioned ports may serve as air vents.

According to one example, any one of the ports or any air vent of the golf club head 100 used as air port(s) for venting the displaced air may be connected to a vacuum source (not shown) during the injection molding process. Accordingly, air inside the interior cavity 700 and displaced by the polymer material may be removed from the interior cavity 700 by the vacuum source. Accordingly, trapped air pocket(s) in the interior cavity 700 and/or a non-uniform filling of the interior cavity 700 with the polymer material may be reduced. The apparatus, methods, and articles of manufacture described herein are not limited in this regard.

After injecting the polymer material into the interior cavity 700, the golf club head 100 may be heated to a second temperature $Temp_2$ that is greater than or equal to the final cure temperature $Temp_f$ of the bonding agent to reactivate the bonding agent to bond the polymer material to the bonding agent (i.e., a final cure state temperature range) (block 5040). The second temperature $Temp_2$ and the duration by which the golf club head 100 is heated to the second temperature $Temp_2$ may depend on the properties of the bonding agent as shown in FIG. 42 to form a permanent bond between the golf club head 100 and the bonding agent and between the polymer material and the bonding agent. The golf club head 100 may be then cooled at ambient or room temperature (not shown). According to one example, the characteristic time (CT) of the golf club head 100 may be measured (not shown) after manufacturing the golf club head 100 as described herein. CT measurements may determine if the golf club head 100 conforms to CT rules established by one or more golf governing bodies.

The heating and cooling processes described herein may be performed by conduction, convention, and/or radiation. For example, all of the heating and cooling processes may be performed by using heating or cooling systems that employ conveyor belts that move the golf club head 100 through a heating or cooling environment for a period of time as described herein. The apparatus, methods, and articles of manufacture described herein are not limited in this regard.

Although a particular order of actions may be described herein with respect to one or more processes, these actions may be performed in other temporal sequences. Further, two or more actions in any of the processes described herein may be performed sequentially, concurrently, or simultaneously.

While the above examples may described an iron-type or a wedge-type golf club head, the apparatus, methods, and articles of manufacture described herein may be applicable to other types of golf club heads.

A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The terms "and" and "or" may have both conjunctive and disjunctive meanings. The terms "a" and "an" are defined as one or more unless this disclosure indicates otherwise. The term "coupled" and any variation thereof refer to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby", "neighboring", etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. An iron-type golf club head comprising:

a body portion associated with a first mass and made from a first material, the body portion having a toe portion with a toe portion edge, a heel portion with a heel portion edge, a top portion, a sole portion with a sole portion edge, a front portion, a back portion with a back wall portion, and an interior cavity;

a face portion having a thickness of less than or equal to 1.905 millimeter (0.075 inch) and coupled to the front portion to enclose the interior cavity;

a plurality of mass portions having a first set of mass portions and a second set of mass portions, at least one mass portion of the first set of mass portions or the second set of mass portions associated with a second mass and made of a second material with a greater density than the first material;

a third mass portion associated with a third mass and made from a third material and removably coupled to the body portion, the third mass portion having a plurality of first ports, each port of the plurality of first ports having an opening on the back wall portion and longitudinally extending from the opening toward the face portion, each port of the plurality of first ports configured to receive a mass portion of the first set of mass portions or a mass portion of the second set of mass portions;

a polymer material in the interior cavity;

a bonding portion configured to bond the polymer material to the face portion; and a second port on the body portion connected to the interior cavity, wherein the interior cavity is partially or entirely filled with the polymer material from the second port, wherein a maximum distance between the top portion and the sole portion is greater than a maximum distance between the face portion and the back wall portion, wherein the third mass portion extends from a location at or below a horizontal midplane of the body portion to the sole portion edge including a portion of the sole portion edge, wherein the third mass portion extends from a location at or below the horizontal midplane to the toe portion edge including a portion of the toe portion edge, wherein the third mass portion includes a portion of an external surface of the back wall portion of the back portion below the horizontal midplane, wherein a ratio of the thickness of the face portion and a thickness of the bonding portion is greater than or equal to 0.1 and less than or equal 4.0, wherein the first mass is substantially greater than the second mass, wherein the third mass is substantially greater than the second mass, and wherein the first mass is greater than or equal to the third mass.

2. An iron-type golf club head as defined in claim 1, wherein the interior cavity is associated with an interior cavity volume, and wherein the interior cavity volume is related to a body portion volume by the equation $0.2 \leq V_c/V_b < 0.5$, where $V_c$ is the interior cavity volume in units of $in^3$, and $V_b$ is the body portion volume in units of $in^3$.

3. An iron-type golf club head as defined in claim 1, wherein the polymer material is associated with a first coefficient of restitution (COR), wherein the golf club head is associated with a second COR, and wherein the first and second CORs are associated with a COR ratio of less than two (2).

4. An iron-type golf club head as defined in claim 1, wherein at least one mass portion of the first set of mass portions and at least one mass portion of the second set of mass portions have at least one different physical property.

5. An iron-type golf club head as defined in claim 1, wherein the third material has a higher density than the first material.

6. An iron-type golf club head as defined in claim 1, wherein the third mass portion is attached to the body portion with at least one mass portion of the first set of mass portions or the second set of mass portions through one of the ports of the plurality of first ports.

7. An iron-type golf club head as defined in claim 1, wherein a distance between the horizontal midplane and a portion of the third mass portion at or proximate to the toe portion edge is substantially less than a distance between the horizontal midplane and a portion of the third mass portion at or proximate to the heel portion edge.

* * * * *